US005447297A

United States Patent [19]

Murata et al.

[11] Patent Number: 5,447,297

[45] Date of Patent: Sep. 5, 1995

[54] SHEET POST-PROCESSING APPARATUS

[75] Inventors: Mitsushige Murata, Yokohama; Kenji Kobayashi, Tokyo; Norifumi Miyake, Kawasaki; Kazuo Onodera, Ibaraki, all of Japan

[73] Assignee: Canon Kabushiki Kaisha, Tokyo, Japan

[21] Appl. No.: 82,102

[22] Filed: Jun. 28, 1993

[30] Foreign Application Priority Data

Jun. 26, 1992 [JP] Japan ..... 4-193117
Jun. 27, 1992 [JP] Japan ..... 4-193408

[51] Int. Cl.[6] ..... B42C 1/12; G03G 21/00
[52] U.S. Cl. ..... 270/53; 355/324
[58] Field of Search ..... 270/53, 58; 355/323, 355/324

[56] References Cited

U.S. PATENT DOCUMENTS 3,995,748 12/1976 Looney ..... 270/53 X
4,479,641 10/1984 Bean et al. ..... 270/53
4,616,821 10/1986 Boeve et al. ..... 355/323 X
4,928,941 5/1990 Uto et al. ..... 270/53
4,930,761 6/1990 Naito et al. .
4,986,520 1/1991 Shido et al. .
4,988,085 1/1991 Maekawa et al. ..... 270/53
4,989,853 2/1991 Matysek et al. ..... 270/58
5,007,625 4/1991 Kremers et al. ..... 270/58 X
5,021,837 6/1991 Uto et al. ..... 270/53 X
5,090,673 2/1992 Kitahara et al. .
5,104,106 4/1992 Shido et al. .
5,186,445 2/1993 Nakanishi et al. ..... 270/53

FOREIGN PATENT DOCUMENTS 0286859 12/1986 Japan ..... 355/323

*Primary Examiner*—John E. Ryznic
*Attorney, Agent, or Firm*—Fitzpatrick, Cella, Harper & Scinto

[57] ABSTRACT

A sheet post-processing apparatus includes a tray for accommodating discharged sheets; binding device for binding the sheets discharged to the tray; a stacker, juxtaposed with the tray, for accommodating a set of sheets on the tray; and a controller for discriminating whether binding mode or non-binding mode is selected, and for changing stacking way of the set of sheets on the stacker.

4 Claims, 52 Drawing Sheets

SHEET POST-PROCESSING APPARATUS

FIELD OF THE INVENTION AND RELATED ART

The present invention relates to a sheet post-processing apparatus provided with binding means, more particularly to a sheet post-processing apparatus in which sets of sheets stapled on trays are discharged to a stacker. A sheet post-processing apparatus is known, in which, however, the bound or stapled sheets and unbound sheets are discharged to the stacker all together, and the sets are not divided.

In addition, the bound or stapled set of sheets has a larger thickness at the stapled side. In the sheet set accommodating apparatus for accommodating a number of sets of sheets, the thickness of the sets of sheet increases significantly at the stapled side. Therefore, the inclination of the surface accommodated thereon is different between the stapled sheet sets and the unstapled sheet sets. Therefore, the stacking stability is poor either in the stapling mode or non-stapling mode.

SUMMARY OF THE INVENTION

Accordingly, it is a principal object of the present invention to provide a sheet post-processing apparatus capable of stably supporting sets of sheets.

According to an aspect of the present invention, the stapled sheets and the unstapled sheets are handled in different ways.

More particularly, for example, only the stapled sets of sheets are selectively stacked on a stacker. Alternatively, the upper limit of the stackable number of sets of sheets of the stacker is made different depending on whether the sheets are stapled or not. According to these aspects of the present invention, the inconvenience that unstapled sets of sheets are mixed without clear division between sets, can be avoided. The limitation of the stackable number of sets will be effective to assure the staple stacking in the stapling mode, and in the non-stapling mode, the stacking capacity is increased.

In addition, by offsetting the unstapled sets of sheets, the sheet sets are effective divided.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described.

Figure 1:
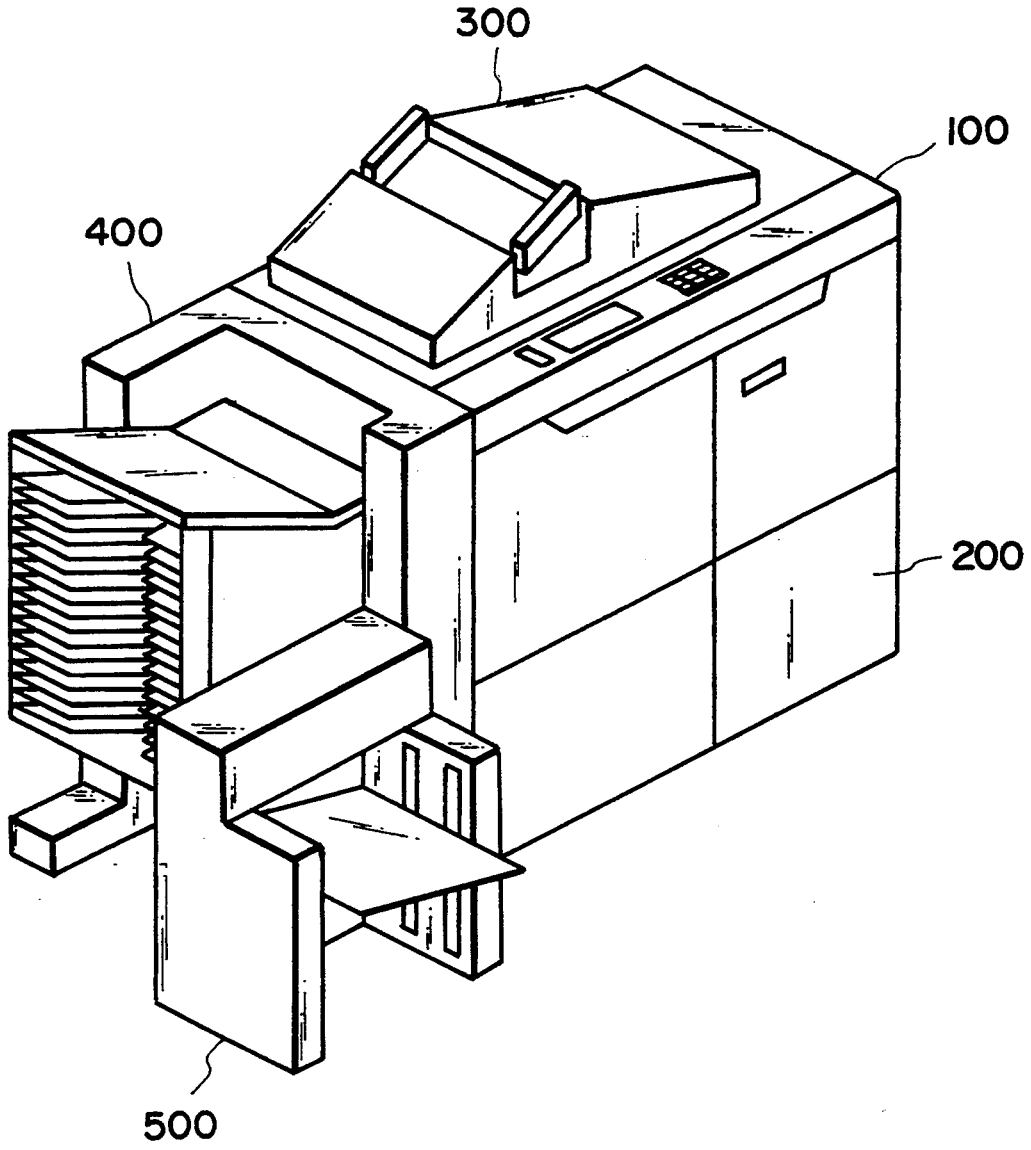
FIG. 1 is a perspective view of the entirety of the image forming apparatus according to an embodiment of the present invention.

FIG. 1 shows a perspective view of the entirety of the image forming apparatus according to an embodiment of the present invention.

Figure 2:
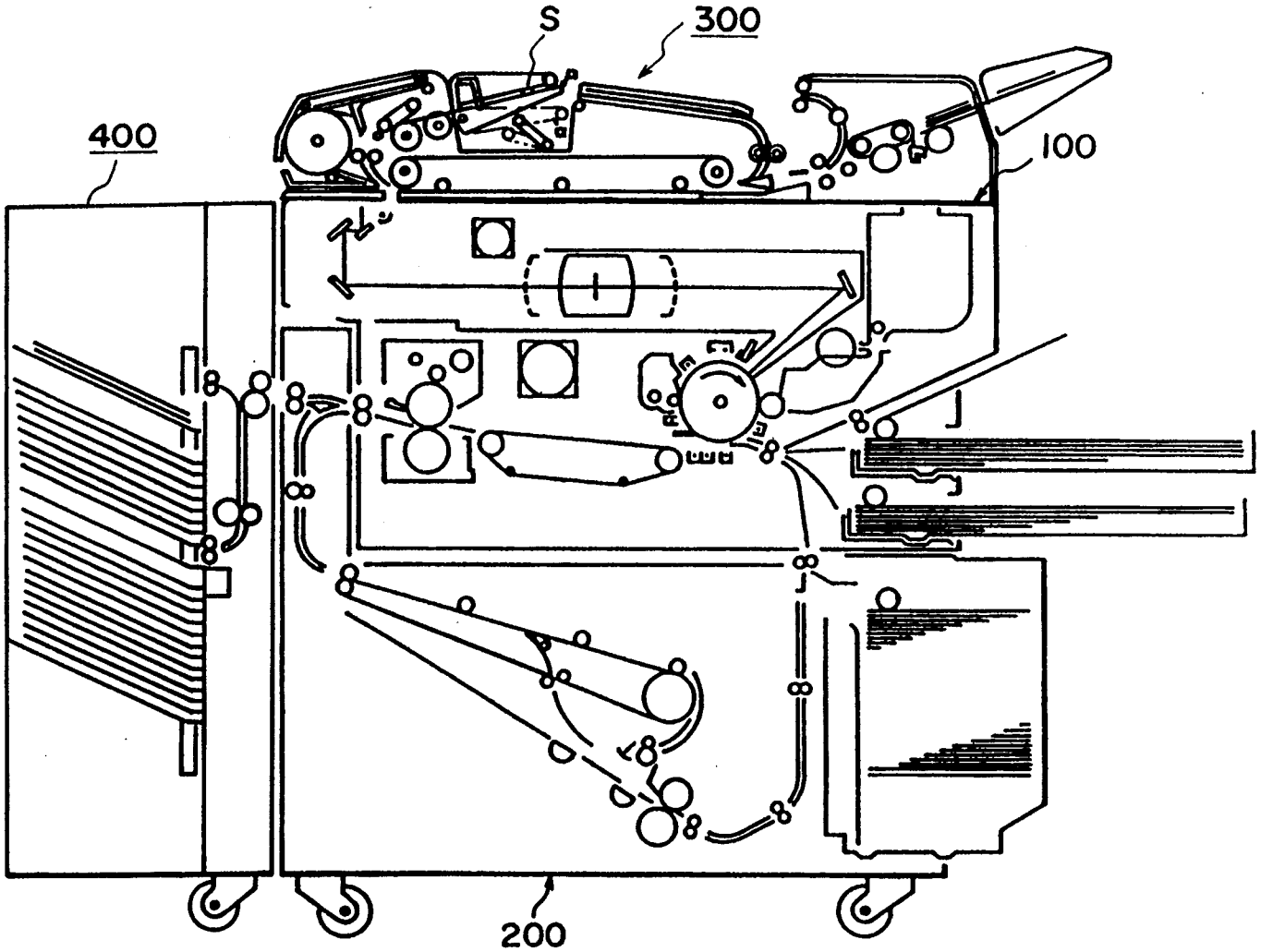
FIG. 2 is a longitudinal sectional view of the image forming apparatus.

FIG. 2 is a sectional view of thereof. The image forming apparatus comprises a main assembly 100, pedestal 200, circulating type automatic document feeder 300, a sheet post-processing apparatus 400 and a sheet set stacker 500.

Figure 3:
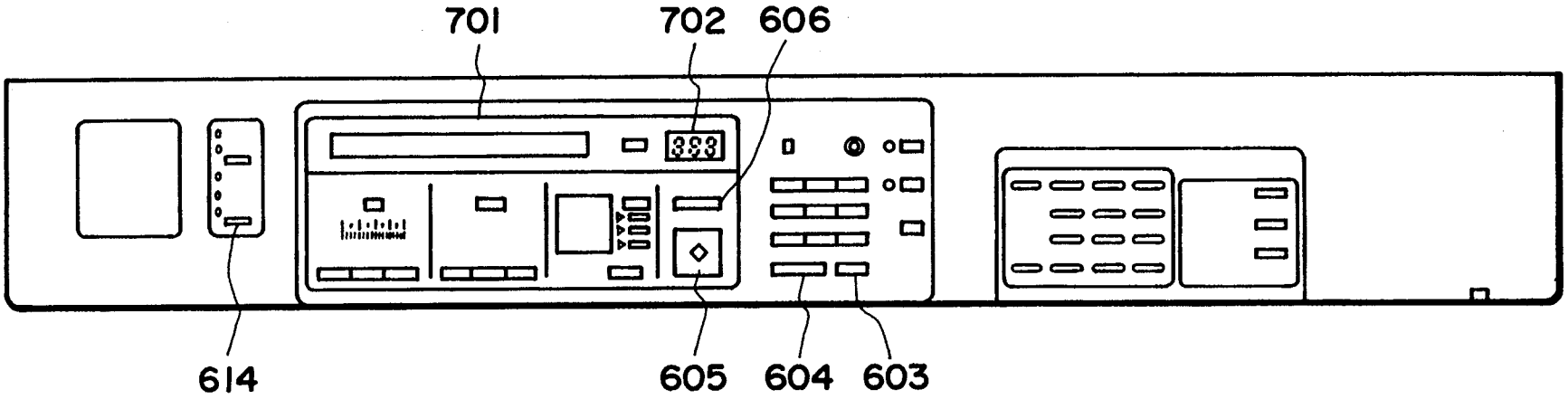
FIG. 3 is a top plan view of a key board of the image forming apparatus.

FIG. 3 shows an example of an operation panel of the main assembly 100. The operation panel comprises a group of keys 600 and a group of displays 700.

Figure 4:
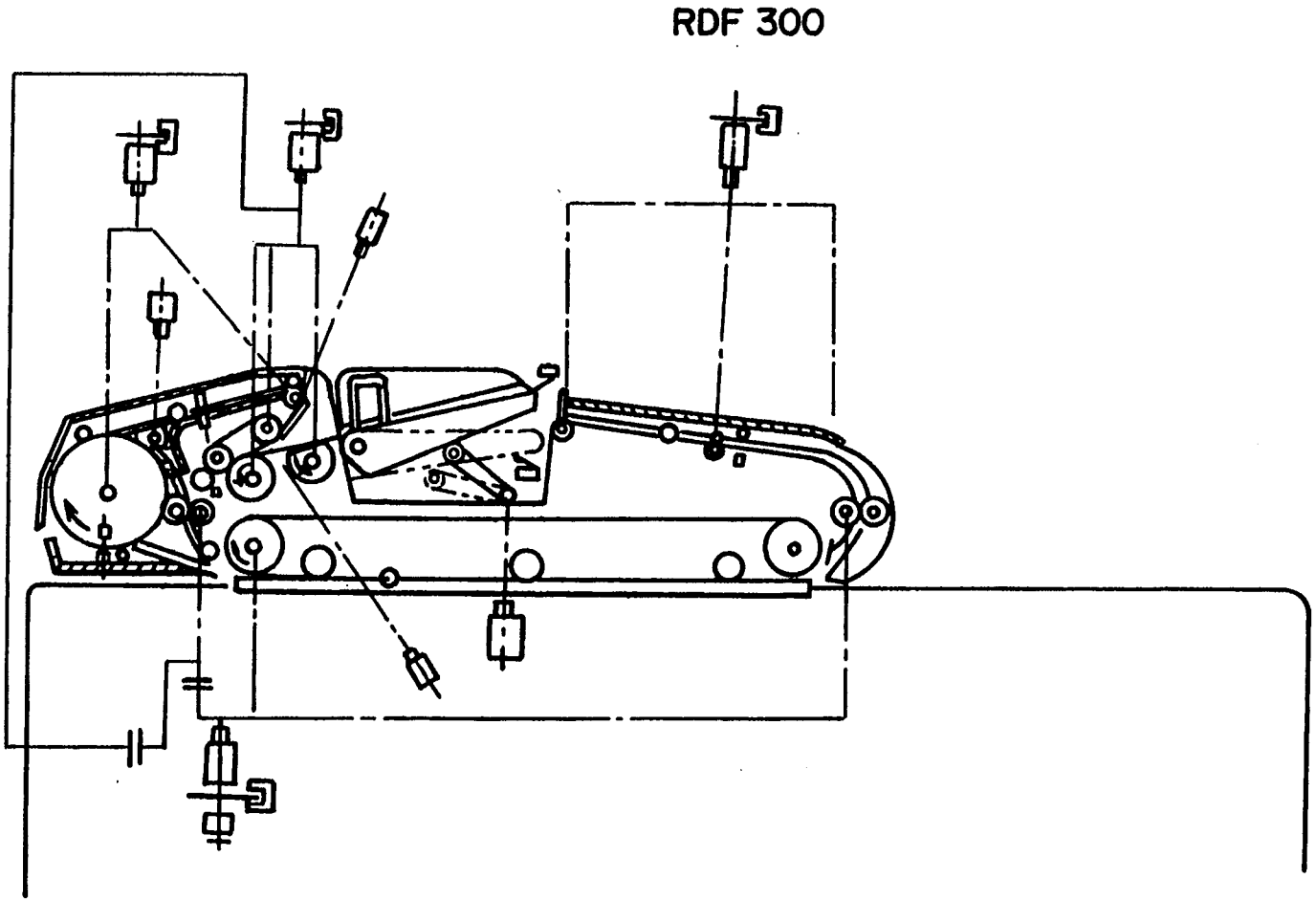
FIG. 4 is a longitudinal sectional view of a sorter used with the image forming apparatus.

FIG. 4 illustrates a RDF (circulation type Automatic Document Feeder); and

Sheet Post-processing 400

Figure 5:
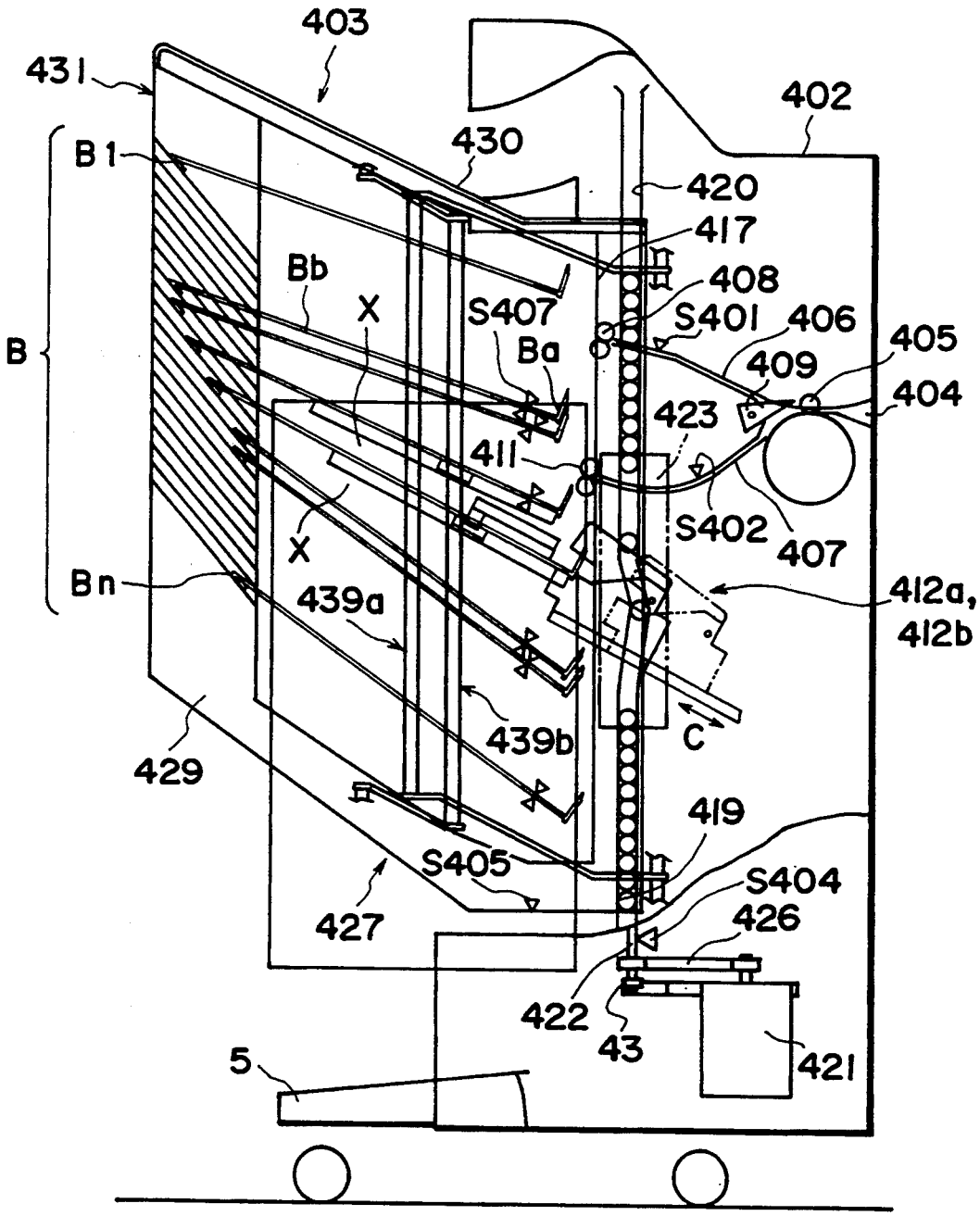
FIG. 5 is a longitudinal sectional view of a stacker used with the image forming apparatus.
Figure 6:
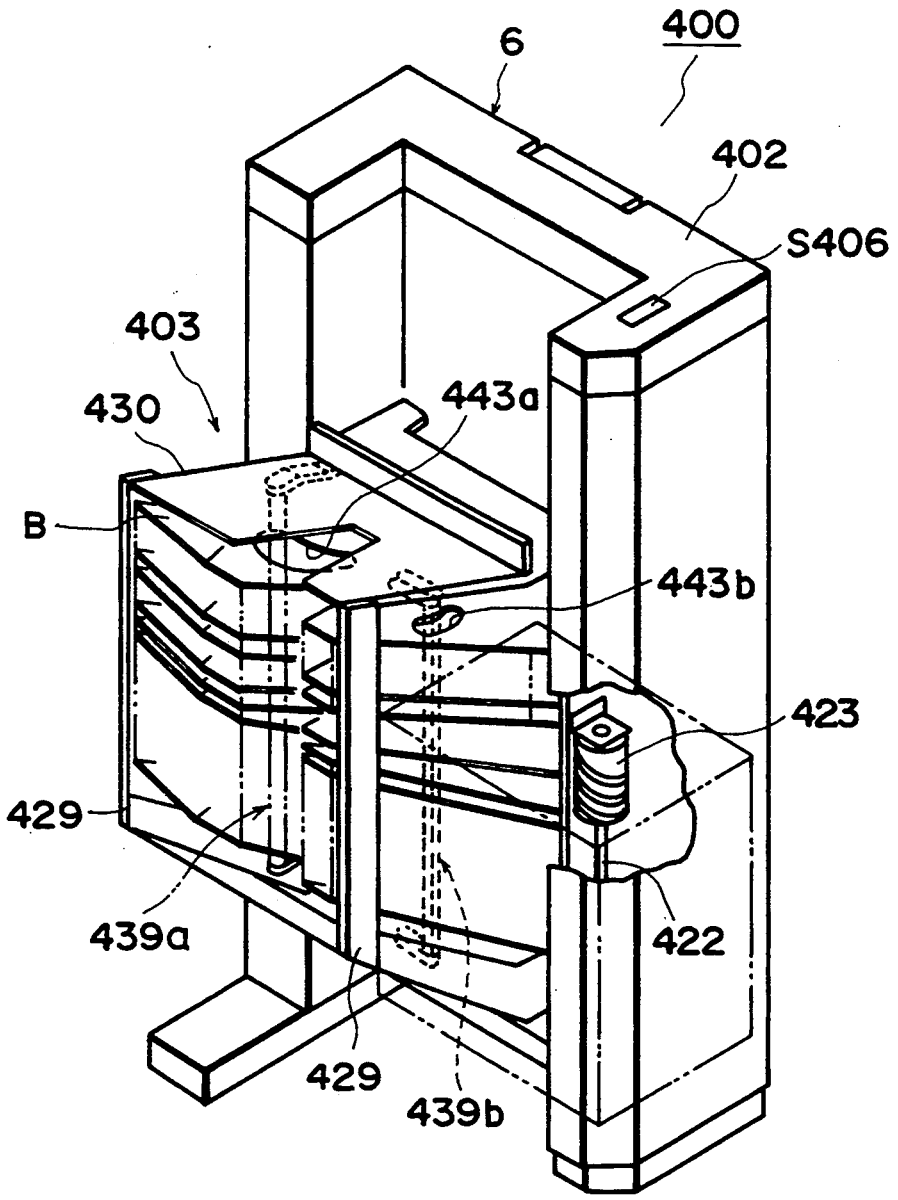
FIG. 6 is a perspective view of a stacker used with the image forming apparatus.
Figure 7:
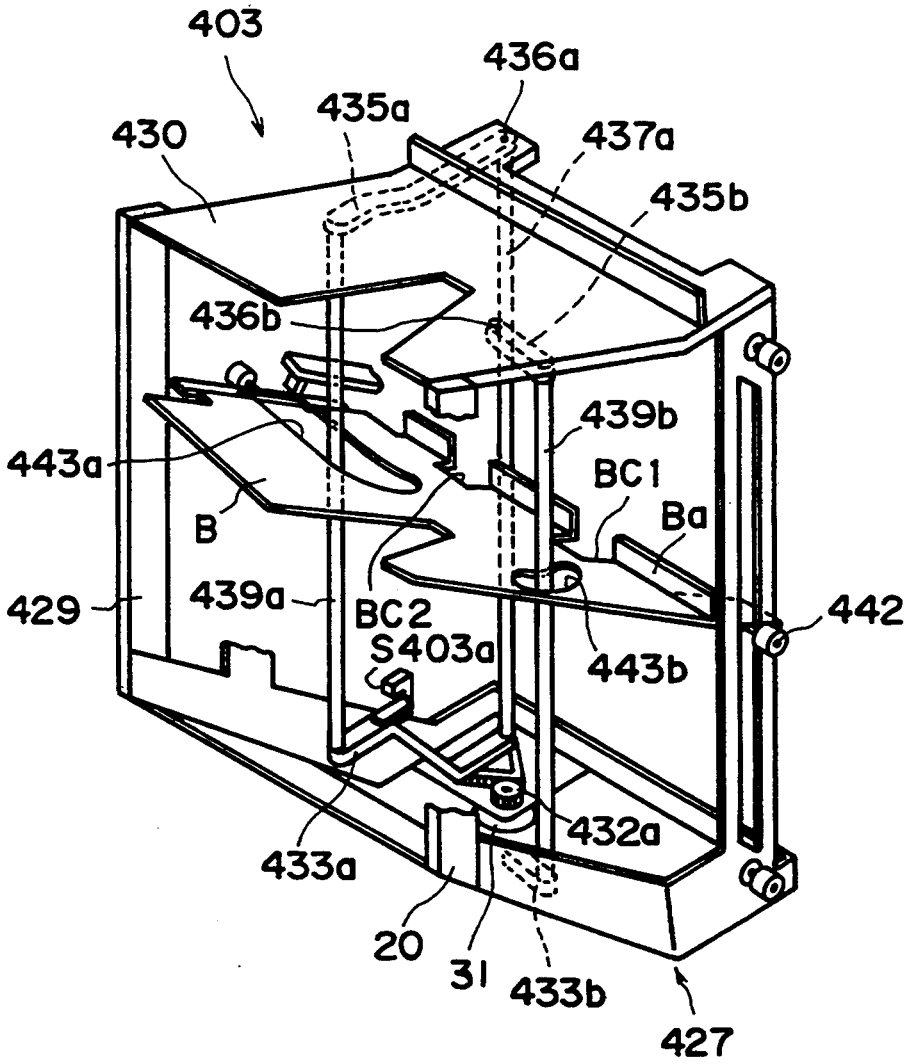
FIG. 7 is a perspective view of a bin unit used with the image forming apparatus.

Referring to FIGS. 5, 6 and 7, the sorter will be described. As shown in the Figures, the sorter 400, 401 comprises a main assembly 402 and a bin unit. The main assembly 402 is provided with receiving rollers 405 constituting a pair adjacent an inlet 404 thereof. Downstream of the receiving rollers 405, there is disposed a flapper 409 for switching the sheet feeding direction selectively to a path 406 or a path 407. One 406 of the paths extends substantially horizontally, and there is a pair of conveying rollers 410 downstream thereof. The other path 406 extends downwardly, and there is a pair of conveying rollers 411 downstream thereof. At a position adjacent to the rollers 411, a stapler 412 is disposed.

The receiving rollers 405 and the feeding rollers 410 and 411 are driven by feeding motor 413 (not shown). In the feeding path 406, there is disposed a non-sort path sensor S401 for detecting passage of the sheet, and in the feeding path 407, there is disposed a sort path sensor S402. Downstream of the rollers 410 and 411, there is a bin unit having a great number of bins. The bin unit 403 is supported for vertical movement. The weight of the bin unit 403 is balanced with the spring force of a spring 415 having an end connected with a hook 416 of the bin unit and another end fixed to the frame 402.

Above and below the base side of the bin unit, guiding rollers 417 and 419 are rotatably supported. The guiding rollers 417 and 419 guide the bin unit by rolling in the guiding grooves 420 extending vertically in the frame 402. A shift motor 421 is disposed in the main frame 402. A lead cam 423 and a sprocket 425 are fixed to a rotatable shaft 422 rotatably mounted on the main frame 402. A chain 426 is stretched between the sprocket 425 and the output shaft of the shift motor 421. By doing so, the rotation of the motor 421 is transmitted to the rotational shaft 422 through the chain 426.

The bin unit 403 comprises a bottom frame 427 having an inclined portion and a vertical portion, and a unit main assembly 431 including a pair of frames 429 vertically extended at front and rear sides at an end of the base frame 427 and a cover 430 supported by the frames 429. At the front side of the unit main assembly 431, there is a reference plate 455 for being abutted by the sheets S (FIG. 8) to align the sheets.

In the base rear side of the bottom frame 427, a bottom arm 433*a* rotatable by an aligning motor 432*a* is rotatably supported thereon (FIG. 7). An upper arm 435*a* is fixed to a shaft 436*a* rotatably supported on the cover 430 at a position facing the bottom arm 433*a* of the cover 430. A shaft 437*a* is extended between the rotational center of the upper arm 435*a* and the rotational center of the bottom arm 433*a*. An aligning rod 439*a* is extended between an end of the bottom arm 433*a* and an end of the top arm 435*a*. Therefore, the aligning rod 439*a* is rotated by the first aligning motor 31 to align the sheets S on the bin B to the front side.

Similarly to the rear base side of the bottom frame 247, a bottom arm 433*b* rotatable by a second aligning motor is rotatably mounted (FIG. 7). The top arm 435*b* is fixed to a shaft 436*b* rotatably supported on the top cover 430 at a position facing the bottom arm 433*b* of the cover 430. Between an end of the bottom arm 433*b* and an end of the top arm 435*b*, an aligning rod 43*b* is extended. The aligning rod 439*b* is rotated by a second aligning motor to align the sheets S on the bin B to the rear side.

The first and second aligning motors are in the form of a stepping motor, and therefore, the positions of the aligning rods 439*a* and 439*b* can be controlled correctly based on the number of pulses applied to the stepping motor. There is provided an aligning rod home position sensor for detecting positions of the aligning rods 439*a* and 439*b*. The positions of the aligning rod 439*a* and 439*b*, can be control by the aligning rod home position sensor and the number of pulses applied to the first and second aligning motors.

Figure 8:
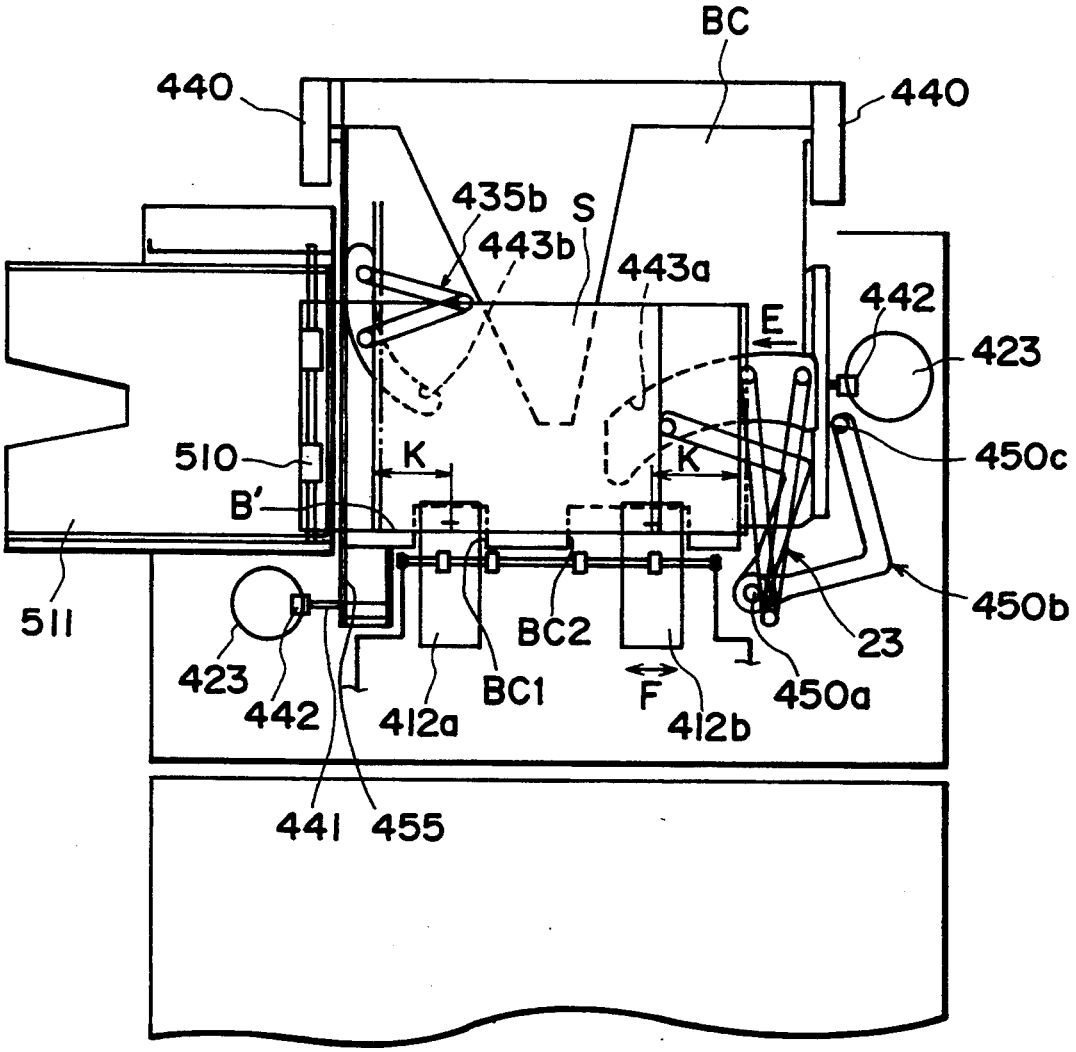
FIG. 8 is a top plan view of the bin unit.

The bin B is provided with an engaging plate 440 at each of the front and rear end, as shown in FIG. 8. By the engagement of the engaging plate 440 with a supporting plate (not shown) provided at an inside of the frame 420, the front part of the bin B is supplied. To the free side end of the bin B, a supporting shaft 441 is fixed at each of the front and rear sides. To the supporting shaft 441, a trunnion 442 is rotatably supported.

The bin B is provided with an elongated slot 443*a* having a sufficiently larger width than the width of the aligning rod 439*a* and having a length longer than the rotational distance of the aligning rod 439*a* at a position predetermined distance away from the shaft 437*a*, and is also provided with an elongated slot 443*b* having a width sufficiently larger than the width of the aligning rod and having a length longer than the rotational distance of the aligning rod 439*b* at a position a predetermined distance away from the shaft 436*b*.

The base end portion Ba of the bin B extends perpendicularly to the surface of the sheet accommodating surface Bb. The bin B is inclined at a predetermined angle with the free side end being upward. By this inclination, the sheet P slides on the sheet accommodating surface Bb to abut the base side B, so that it is aligned in the sheet feeding direction.

The bin B is also provided with a cut-away portions B1 and B2 to permit entrance of staplers 412*a* and 412*b* without interference with the staplers 412*a* and 412*b*.

The aligning rod 439*a* is penetrated through the elongated holes 443*a* of the bins B1 and B2 and so on. The aligning rod 439*a* moves in the elongated slot 443*a* to align the sheet P on the bin B to the front side.

Similarly, the aligning rod 439*b* is penetrated through the elongated slots 443*b* of the bins B, and the aligning rod 439*b* moves in the slots 443*b* to align the sheet P on the bin B to the rear side.

The lead cam 423 is provided with helical groove 423*a* having a width slightly larger than a diameter of a trunnion 442, and the groove receive the trunnion 442.

By rotation of the lead cam 423, the trunnion 442 moves up and down along the groove 423*a*. One rotation of the lead cam 423 is detected by a lead cam sensor S404 disposed adjacent to the lead cam 423. The position of the bin unit 402 is detected by a bin home position sensor S405.

The presence of the sheet S on the sort bin B is detected by a sheet sensor S407 on the sort tray (sheet post-process selecting means).

Adjacent the lower discharging rollers 441, there is two electric staplers 412*a* and 412*b* for stapling the sheets S accommodated on the bin B. The staplers are movable by driving means to a position across the sheet S feeding direction. Normally, it is at the retracted position to avoid the interference with the vertical movement of the bin B. When the set of sheets S on the bin B is to be stapled, it moves to the solid line position to effect the stapling of the sheets S. At this time, the electric staplers 412*a* and 412*b* are independently movable. After the completion of the stapling operation, the electric stapler is returned to the retracted position by an unshown driving means.

The electric staplers 412*a* and 412*b* effect the stapling operation by rotation of a motor. When the sheets S on the plurality of bins are to be stapled, the bin unit 403 is moved to phase the next set sheets to the stapler, after completion of the previous stapling. Since there are two staplers 412*a* and 413*b*, the operator can select operation of only one or both of two of them. The selection of the staplers 412*a* and 412*b* will be described hereinafter. A manual stapler key S406 effects a stapling operation when the manual stapling key S406 depressed after completion of the sorting operation.

An L-shaped arm 450*b* is supported for rotation about a vertical shaft 450*a* mounted on the bin unit 403 at a rear side of the sorter 400. A downwardly facing pushing rod 450*c* is fixed to an end of the arm 450*b* to constitute a pushing member 450. The pushing member is driven by an unshown driving means and functions to push a sheet on a predetermined bin out to the front.

Stacker 500

Figure 9:
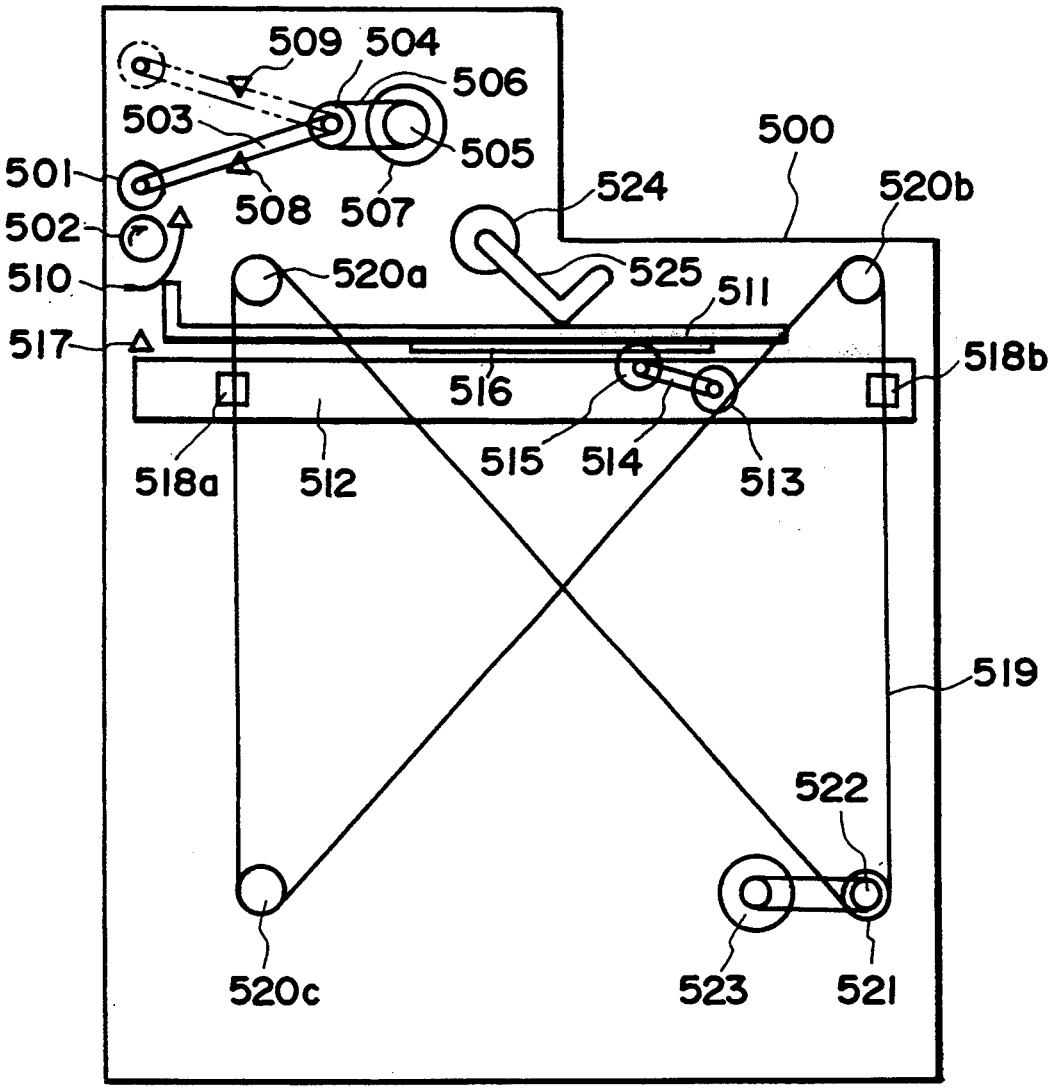
FIG. 9 is a front view of a sheet stacker used with the image forming apparatus.

Referring to FIG. 9, a sheet set stacking device (stacker) 500 will be described. The sheet set pushed out from the sheet post-processing apparatus (sorter) 400, is conveyed by a feeding rollers 501 and 502. The feeding rollers 501 and 502 are supported by the swinging arm 503 in rolling contact, and is swingable up and down by an arm swinging motor 507 through the pulleys 504 and 505 and timing belt 506. The position of the swingable arm 503 shown by solid lines is the conveying position effective to convey the sheet set. The position is detected by a sheet conveying sensor 508. The broken line position is a receiving position for receiving the sheet set, and the receiving position is detected by a position sensor 509. The sheet feeding roller 502 is driven by a sheet feeding motor to feed the sheet. The sheet set feeding motor is provided with an encoder, so that the distance of movement can be measured. The sensor 501 is a sheet set detecting sensor for detecting a sheet set conveyed by the sheet set conveying roller. Designated by a reference numeral 511 is a set stacking tray which is supported on a tray support 512. A tray moving motor 513 functions to the sheet set stacking tray 511 by way of a timing belt 514, pulley-pinion gear 515 and a rack 516. The tray moving motor 515 is provided with an unshown encoder, so that the movement distance thereof can be measured. Designated by a reference numeral 517 is a tray home position sensor to detect the home position of the sheet set stacking tray 511. The sheet set stacking tray position is detected on the basis of an output of the tray home position sensor 517 and an output of the encoder of the tray moving motor 513. The tray support 512 is fixed to the wire 519 by fixing means 518*a* and 518*b*. The wire 519 is trained around the pulley 520*a*, 520*b*, 520*c* and the driving pulley 521. A driving shaft 522 is driven by a tray elevating motor 523 to move the tray support 512 up and down. The driving shaft is connected with a driving pulley on an unshown back surface. At the back surface, there is also provided a tray elevating mechanism using wire. The tray support 512 is supported at four points. A sheet surface detecting sensor 524 is in the form of a potentiometer for producing an analog output indicative of the height of the sheet surface supplied from an arm sensor 525. The tray elevating motor 423 controls the height level of the tray support 512 in accordance with an output of the sheet surface detecting sensor 524. The stacker 500 may be built in the sorter, or may be juxtaposed outside the sorter. In any case, the sheet post-processing device includes the sorter and the stacker.

Figure 10:
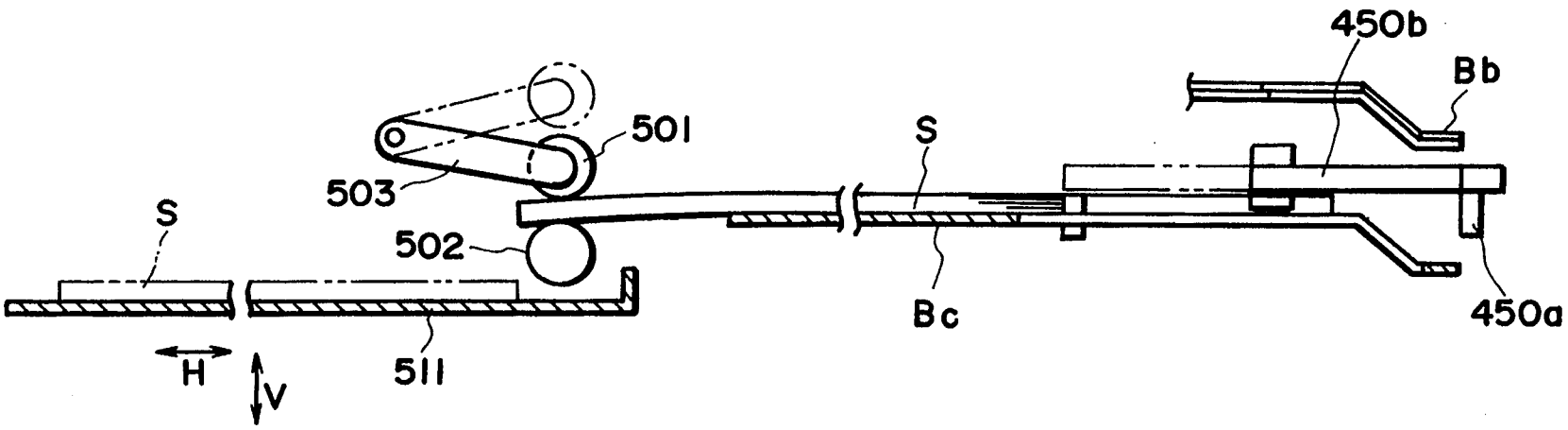
FIG. 10 is a side view illustrating operation of the sheet stacker.

Referring to FIGS. 9 and 10, the operation of the sheet set stacker 500 will be described. The detector 510 detects insertion of the sheet sets S. The arm swinging motor 507 starts to rotate to lower the upper swingable arm 503, so that the sheet set S is gripped between the upper conveying roller 501 and the lower conveying roller 502. When the proper pressure is applied between the upper conveying roller 501 and the lower conveying roller 502, the arm swinging motor 507 stops. Then, the sheet set conveying motor is actuated, so that the upper conveying motor 501 and the lower conveying roller 502 are rotated at the same speed to feed the sheet set S. When the detector 510 detects the trailing edge of the sheet set S, the sheet set conveying motor is stopped. Subsequently, the arm swinging motor 507 is actuated to release the pressure between the upper conveying roller 510 and the lower conveying roller 502. The trailing end portion of the sheet set being conveyed is in contact with the lower conveying roller 502 with the leading end portion in contact with the sheet set stacking tray 511. With this state, the tray moving motor 513 is actuated to move the set stacking tray 511 in the sheet conveying direction. It is stopped after the completion of the sheet set discharge. By doing so, it is avoided that the sheet set slides on the already stacked sheet set. Therefore, the sheet sets are not deviated. In addition, by deviating beforehand the start position of the tray 511 relative to the home position, it is possible to switch the receipt position of the sheet set for each of the jobs (offset).

By driving the tray elevating motor 523 on the basis of the input from the sheet surface detecting sensor 524, the height level of the tray support 512 is controlled.

Key Groups 600

Referring to FIG. 3, there is shown a all reset key 606 which is actuated when a standard mode is to be selected. A copy start key 605 is to be depressed when the copying operation is to be started. A clear/stop key 604 functions as a clear key during stand-by period, and functions as a stop key during the copying operation period. The clear key is depressed when the set copy number is to be cleared. Also it is depressed when an asterisk (*) mode is to be cleared. The stop key is depressed when a continuous copying operation is to be interrupted. The copying operation stops after completion of the copying cycle operation at the time of the stop key being depressed.

Ten keys 603 are actuated when the copy number is to be set. Also, it is used to set the asterisk mode (*). A sheet discharge mode selector key 614 (stapling mode, sorting mode, grouping mode) is operable to select or clear the stapling mode or sorting mode when the image forming apparatus is provided with a stapler capable of stapling the discharged sheets. When it is provided with a sorting tray (sorter), the selector key 614 is capable of selecting or clearing the sorting mode or the grouping mode.

Designated by a reference numeral 640 is a stapling mode selector key to permit selection between one position stapling mode and two position stapling mode.

A stacker selector key 642 permits selection between use and non-use of the stacker.

In FIG. 3, a message display 701 is in the form of LCD (liquid crystal) type display, and is effective to display information relative to copying operation. One element thereof is constituted by 5×7 dots, and 40 characters message can be displayed. It can display the copy magnification selected by predetermined magnification keys 608 and 609, one-to-one magnification 610, zoom keys 617 and 613. The display 701 is of non-transparent type liquid crystal, and two color back light is used. Usually, a green back light is turned on, but in abnormal state or copy disabled state, the orange color backlight is turned A copy number display 701 displays the copy number or self-diagonosis code is displayed. A display 705 displays what cassette is being used among the upper cassette 151, an intermediate cassette 153 and the bottom deck 201.

Main Assembly Control System 800

Figure 11:
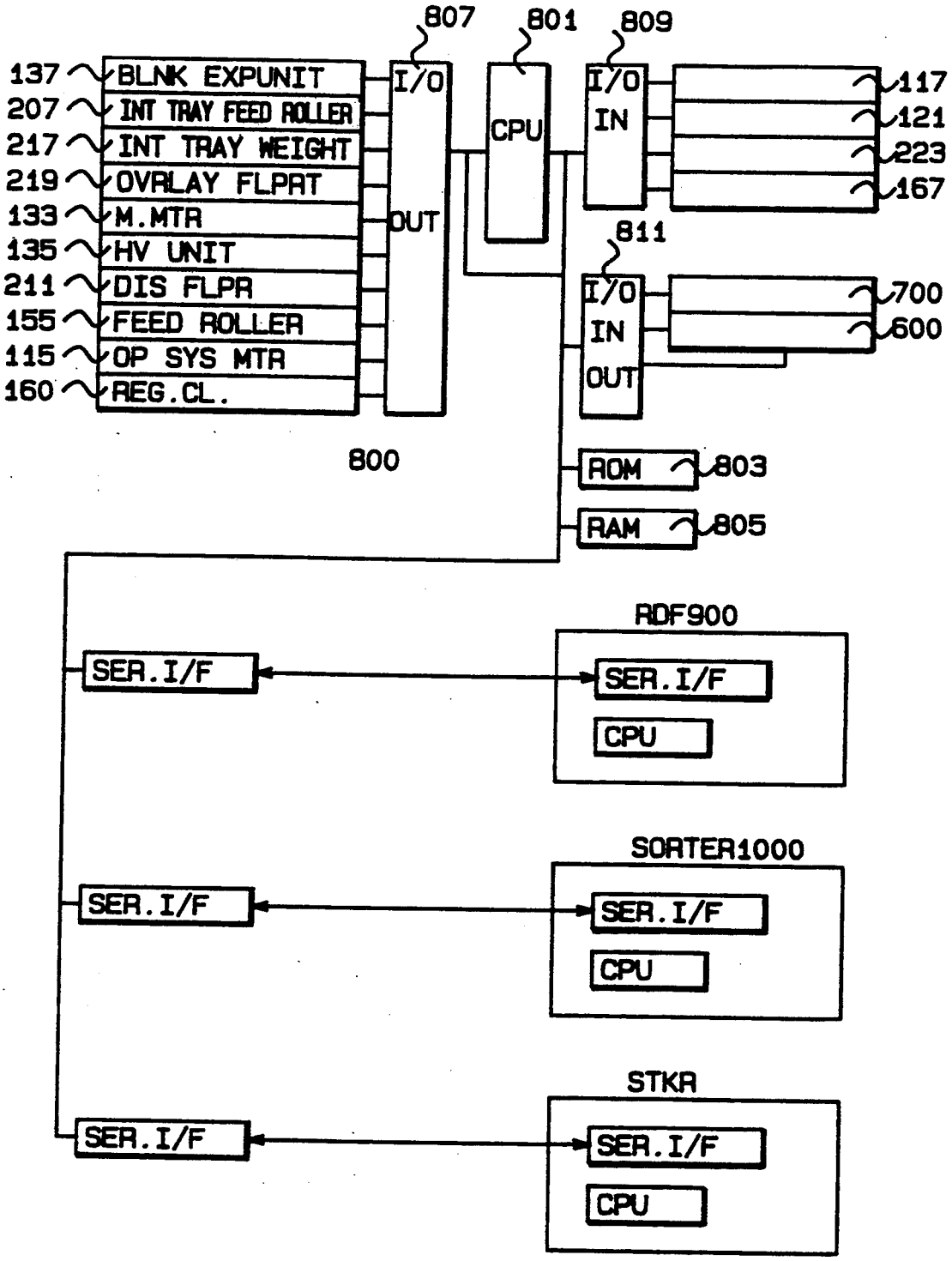
FIG. 11 is a block diagram of a system of the image forming apparatus.
Figure 28:
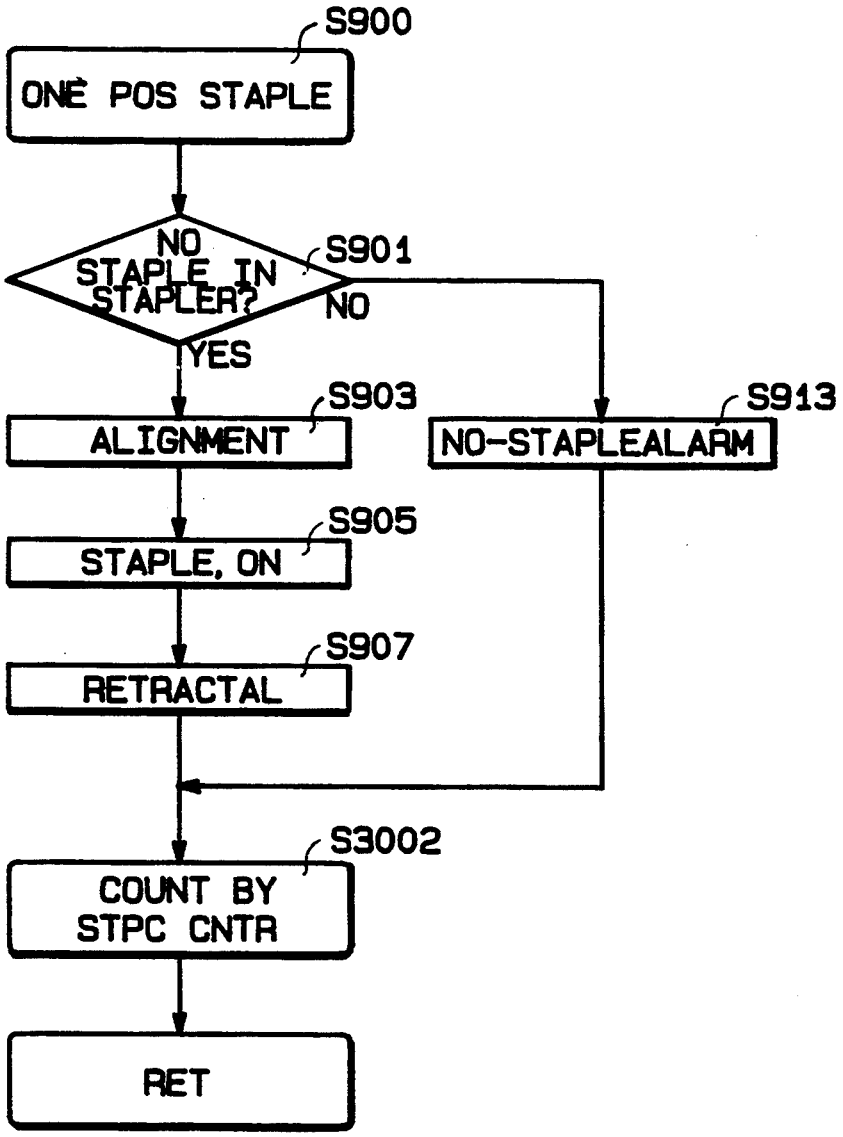
FIG. 28 is a flow chart of one position stapling operations.

FIG. 11 shows a circuit diagram of a control system 800 according to an embodiment of the present invention. In FIG. 11, reference numeral 801 designates a central processing unit (CPU), which is a microcomputer V50 available from Nippon Denki Kabushiki Kaisha, Japan. A read only memory (ROM) 803 stores the control process (control program) shown in FIG. 28 et seqq. The CPU 801 controls various devices connected through bus line, in accordance with the control process. Designated by a reference numeral 805 is a random access memory (RAM) which is a main memory for the input data or working memory area or the like.

Designated by reference numerals 807, 809 and 811 are an interface (I/O) for producing control signal from the CPU 801 to the load such as a main motor 133 or the like, an interface for transmitting the input signal such as that from the image front sensor 121 or the like to the CPU 801, and an interface for input and output control between the keys 600 and the displays 700, respectively. These interfaces 807, 809 and 811 may be an input and output circuit port uPD 8255 available from Nippon Denki Kabushiki Kaisha, Japan.

Through the bus line a known communication IC (uPD 8251, for example) is connected, and the communication IC is further connected with a communication IC for the RDF, stacker and sorter, so that the control data required for the mutual control are communicated between the main assembly of the copying machine and the automatic document feeder, stacker and sorter.

The data transmitted to the document feeder from the main assembly of the copying machine include sheet supply signal for supplying the original on the automatic document feeder, the sheet discharge signal for discharging the original from the platen glass 101 and sheet feeding and discharging mode signal for feeding and discharging control for the original including a reserved original. The data transmitted from the copying machine to the sorter include image formation mode, sorting mode, sheet size and timing signal or the like.

RDF (Automatic Document Feeder) Control System 900

Figure 12:
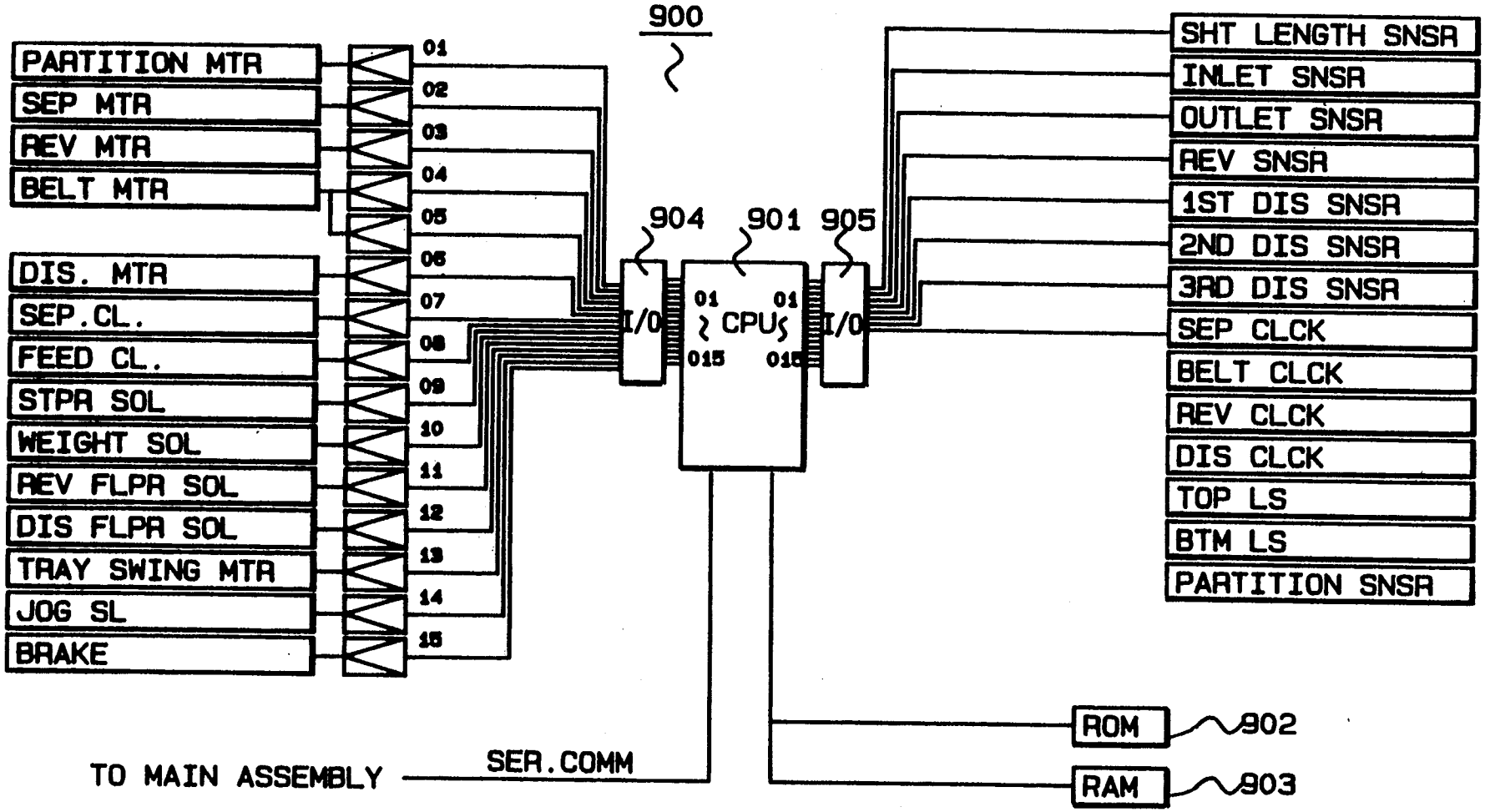
FIG. 12 is a block diagram of a control system for an automatic document feeder.

FIG. 12 is a block diagram of a control circuit for the recirculation type automatic document feeder. The main component of the control circuit is a one chip microcomputer (CPU) containing a ROM and a RAM or the like. To the input port of the microcomputer 901, various signals from sensors are supplied. To the output port 1 of the microcomputer 901, various loads are connected through the drivers. The control datas are communicated through a communication IC 903 with the main assembly of the copying machine. The data transmitted from the automatic document feeder to the copying machine includes sheet feed completion signal indicative of the completion of the sheet supply onto the platen glass, or the like.

Sorter Control Device 1000

Figure 13:
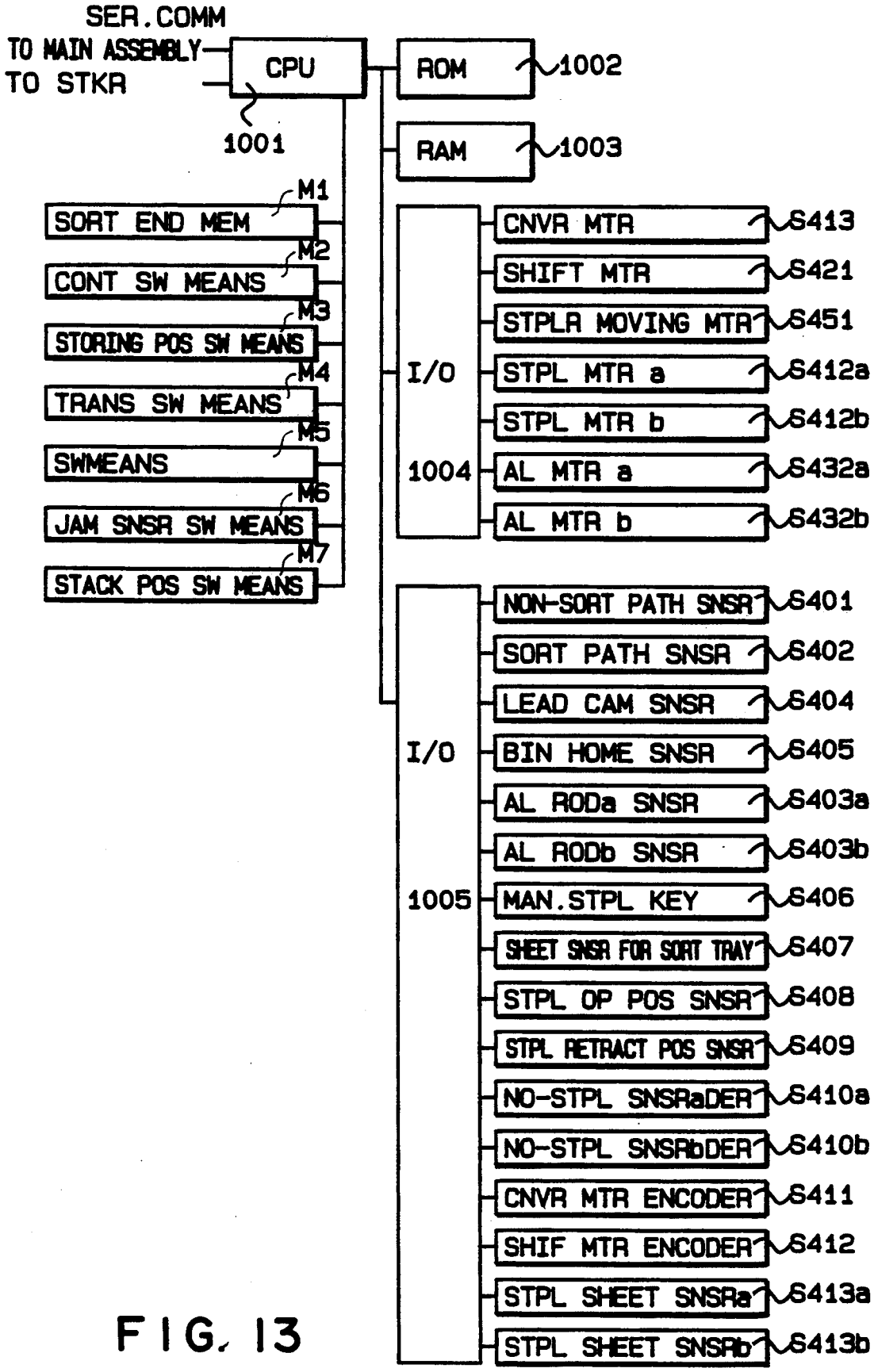
FIG. 13 is a block diagram of a control system for the sorter.

FIG. 13 is a block diagram of the circuit structure of the control device 1000 for the sheet post-processing apparatus (sorter) of this embodiment. It comprises a central processing unit (CPU) 1001, read only memory (ROM) 1002, a random access memory (RAM) 1003, an output port 1004, an input port 1005 or the like. The read only memory 1002 stores control program, and the random access memory 1003 stores the input data or working data. The output port 1004 is connected with various motors such as shift motor 421 or the like and the solenoid driving means. The input port 1005 is connected with various sensors and switches such as non-sorting path sensor S401, and sensors S402–S406. The CPU 1001 controls the various parts connected through the bus line accordance with the control program stored in the read only memory 1002. The CPU 1001 is provided with a serious interface function, and the communication is effected between the main assembly of the copying machine and the CPU in serial manner, so that various parts are controlled in accordance with the signals from the main assembly of the copying machine, and supplies outputs to the stacker.

Stacker Control Device 1100

Figure 14:
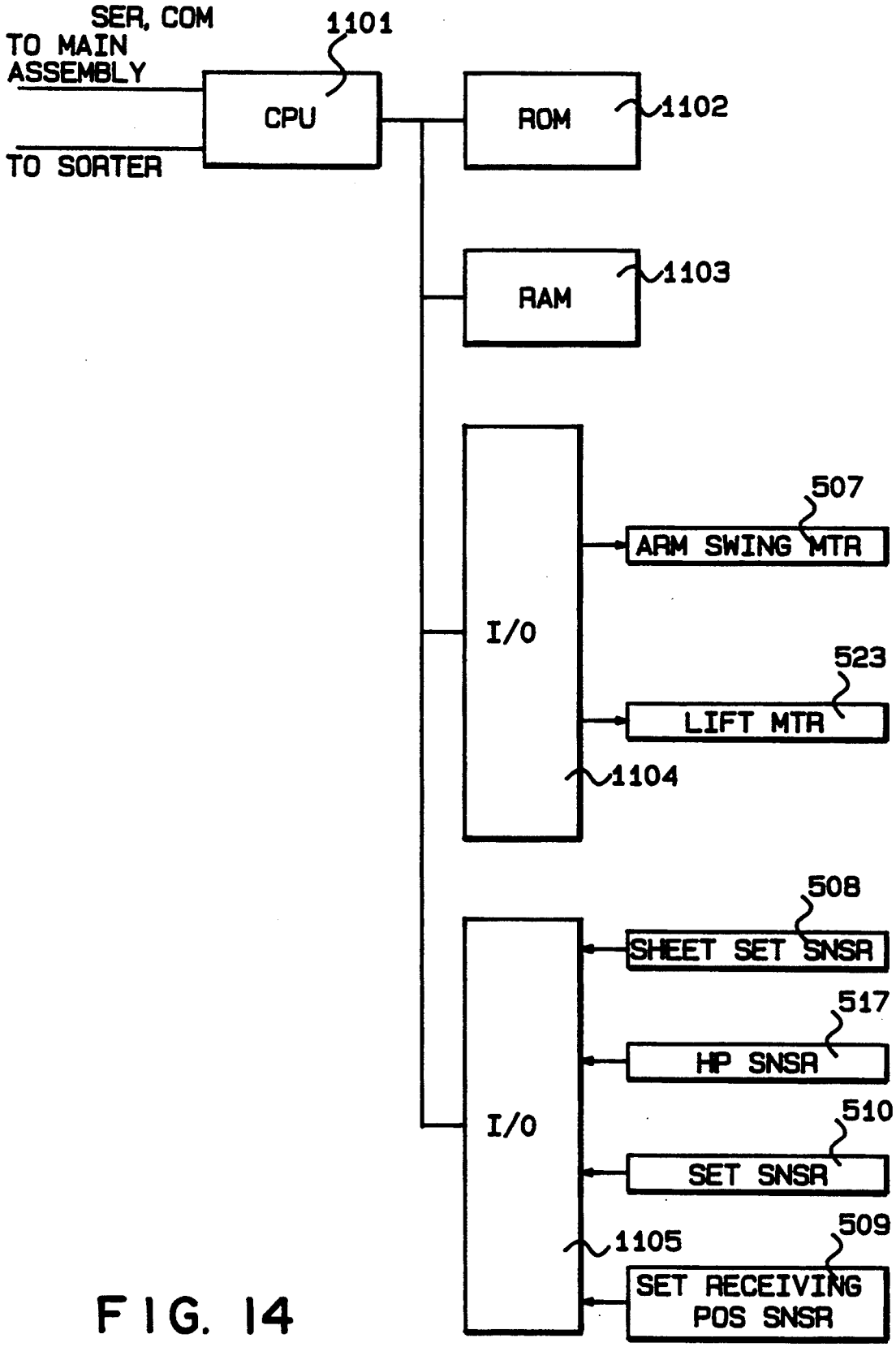
FIG. 14 is a block diagram of a control system for the stacker.

FIG. 14 is a block diagram of a circuit of a control device 1100 for the stacker according to this embodiment. It comprises a central processing unit (CPU) 1101, a read only memory (ROM) 1102, a random access memory (RAM) 1103, an output port 1104, an input port 1105 or the like, which constitute a control device 1100. A control program is stored in the read only memory 1102, and the input data or working data are stored in a random access memory 1103. The output port 1104 is connected with various motors such as arm swinging motor 507 or the like. The input port 1105 is connected with various sensors such as sheet set conveying position sensor 508 or the like. In accordance with the control program stored in the read only memory 1102, the CPU 1101 controls the various parts through the bus line. The CPU 1101 is provided with an serial interface function, and effects the serial communication with the CPU of the sorter to control various parts in accordance with the signal from the sorter.

The flow of the control in this embodiment will be described using the flow charts of FIGS. 15–25.

Figure 15:
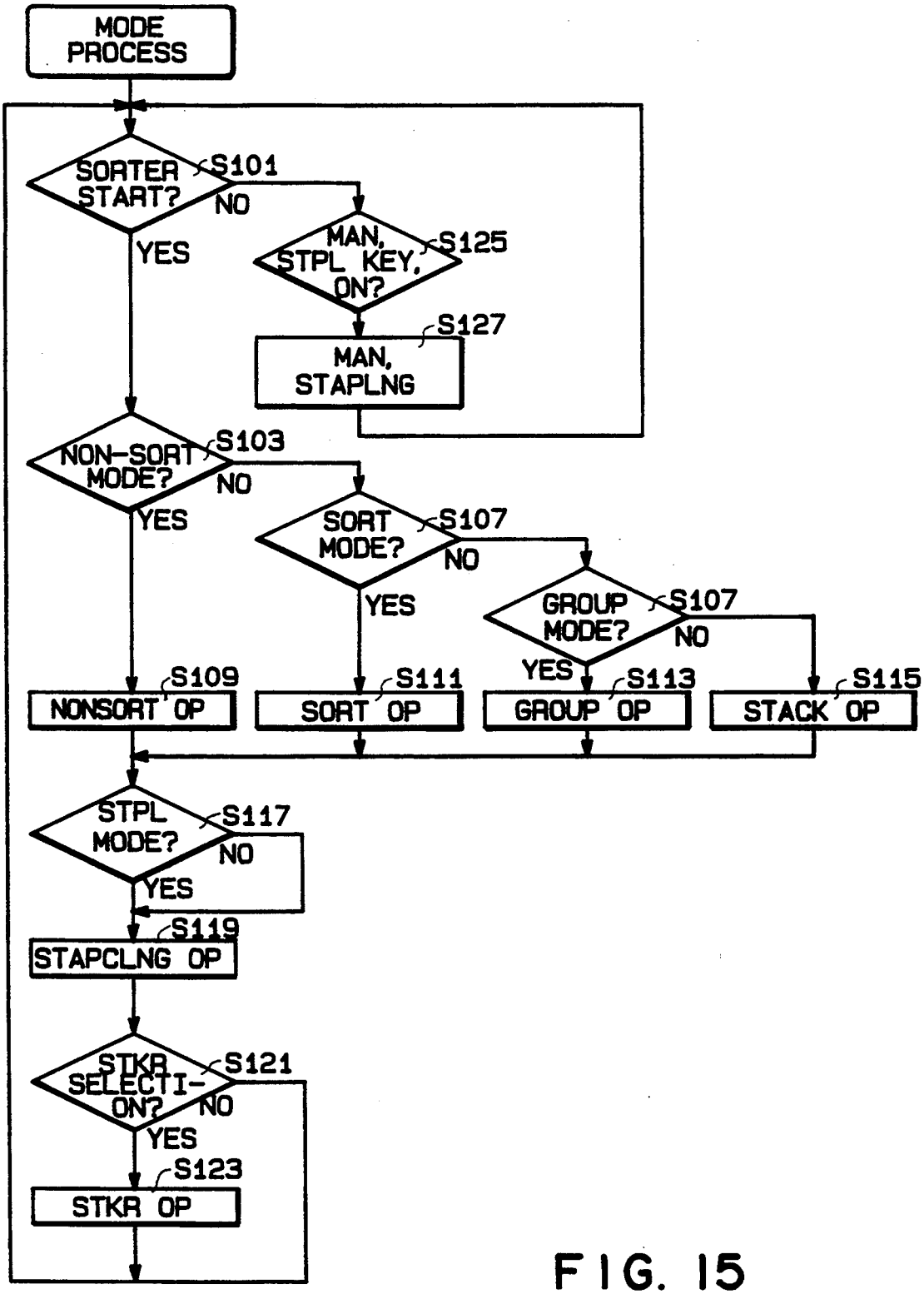
FIG. 15 is a flow chart of the operations in the mode control.

In FIG. 15, the description will be made first with respect to the mode processing which is the basic process of this embodiment. At step 101, the description will be made as to whether or not a sorter starting signal is produced or not (start of the sheet discharge from the main assembly of the copying machine). If so, the operation proceeds to step 103. If not, the state of the manual stapling key is discriminated at step 125. If it is on, the manual stapling operation (step 127) which will be described hereinafter is carried out. If it is off, the processing returns to step 101.

In steps 103–108, the mode is discriminated relating to the accommodation of the sheets discharged from the copying machine. Then, the respective process operations which will be described hereinafter, are carried out. More particularly, in the case of the non-sorting mode, the non-sorting process which will be described hereinafter is carried out (steps 103 and 109). In the case of the sorting mode, the sorting process which will be described hereinafter (steps 105 and 111), is carried out. In the case of the grouping mode, the grouping process (steps 107 and 113) which will be described hereinafter, is carried out. In the other cases, the stacking process which will be described hereinafter (step 115) is carried out. After the above process operation is completed, the stapling process which will be described hereinafter (step 119) is carried out in the case of the stapling mode. Thereafter, if the stacker using mode is selected (step 121), the stacking operations which will be described hereinafter (step 123), is carried out. Then, the operation returns to step 101.

Figure 16:
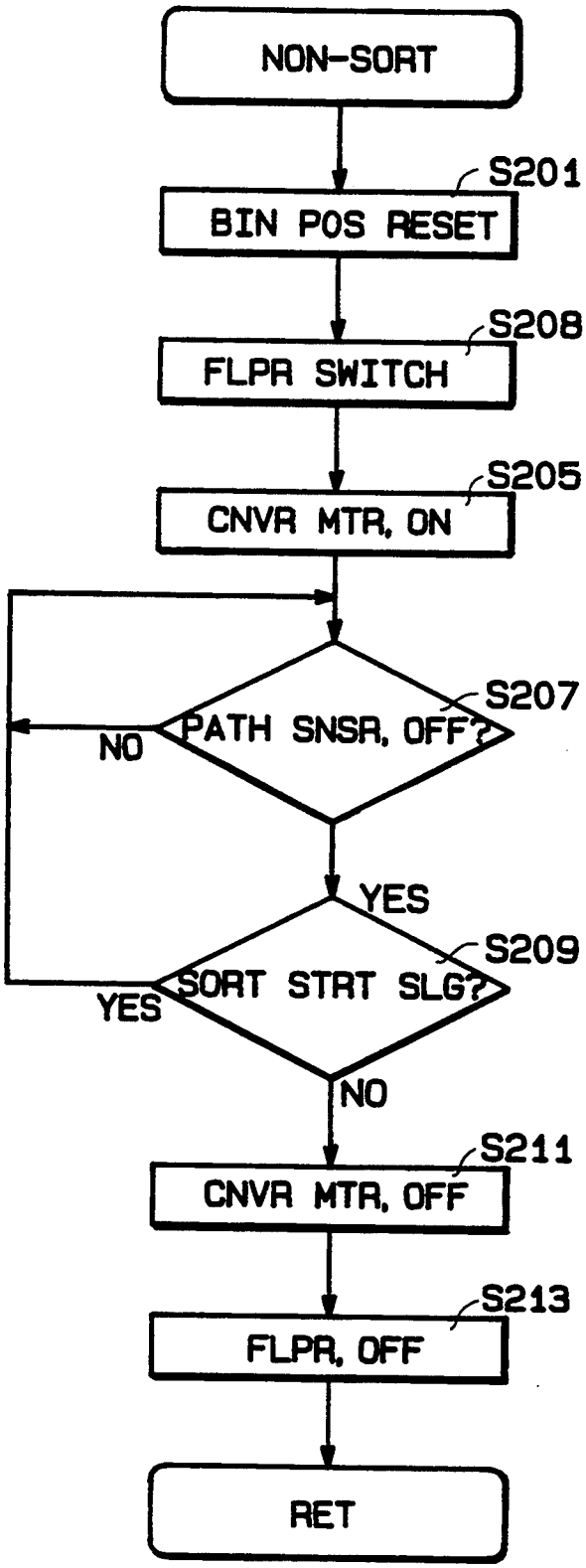
FIG. 16 is a flow chart of operations in a non-sorting mode.

Referring to FIG. 16, the non-sorting mode operation will be described. In order to accommodate the sheet on the topmost bin, the bin initializing operation is carried out in which the bin unit is lowered to the non-sorting home position (step 201). In order to select the conveying path 406 as the sheet conveying path in the sorter, the flapper 409 is switched (step 203). The flapper 409 is switched by a solenoid (not shown). When the solenoid is not energized, the path 407 is selected, and when it is energized, the path 406 is selected. After the step 203, the conveying motor is energized at step 205, and the on or off of the path sensor is checked at step 207. In addition, the presence or absence of the sorter starting signal is checked at step 209. Only when the path sensor is off, and the sorter starting signal is off at steps 207 and 209, the operation proceeds to step 211. At step S211, the conveying motor is stopped, and at step 213, the flag is deactuated, by which the non-sorting process is completed.

Figure 17A:
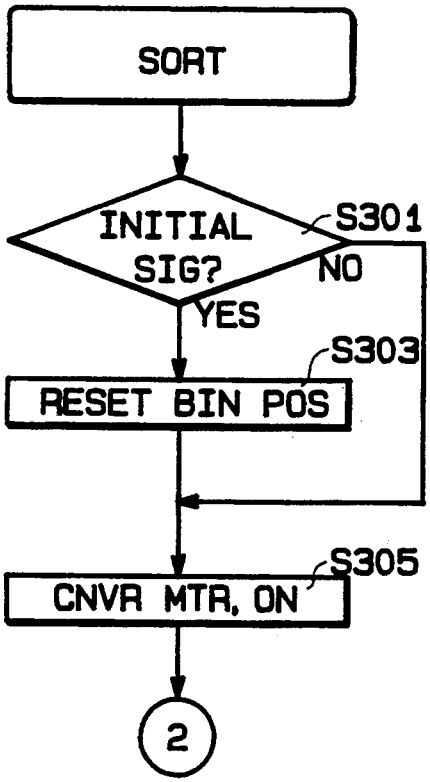
FIG. 17 is a flow chart of operations in the sorting mode.
Figure 17:
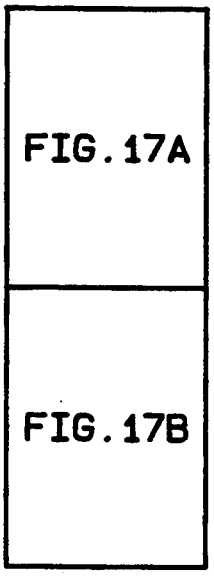
Figure 17B:
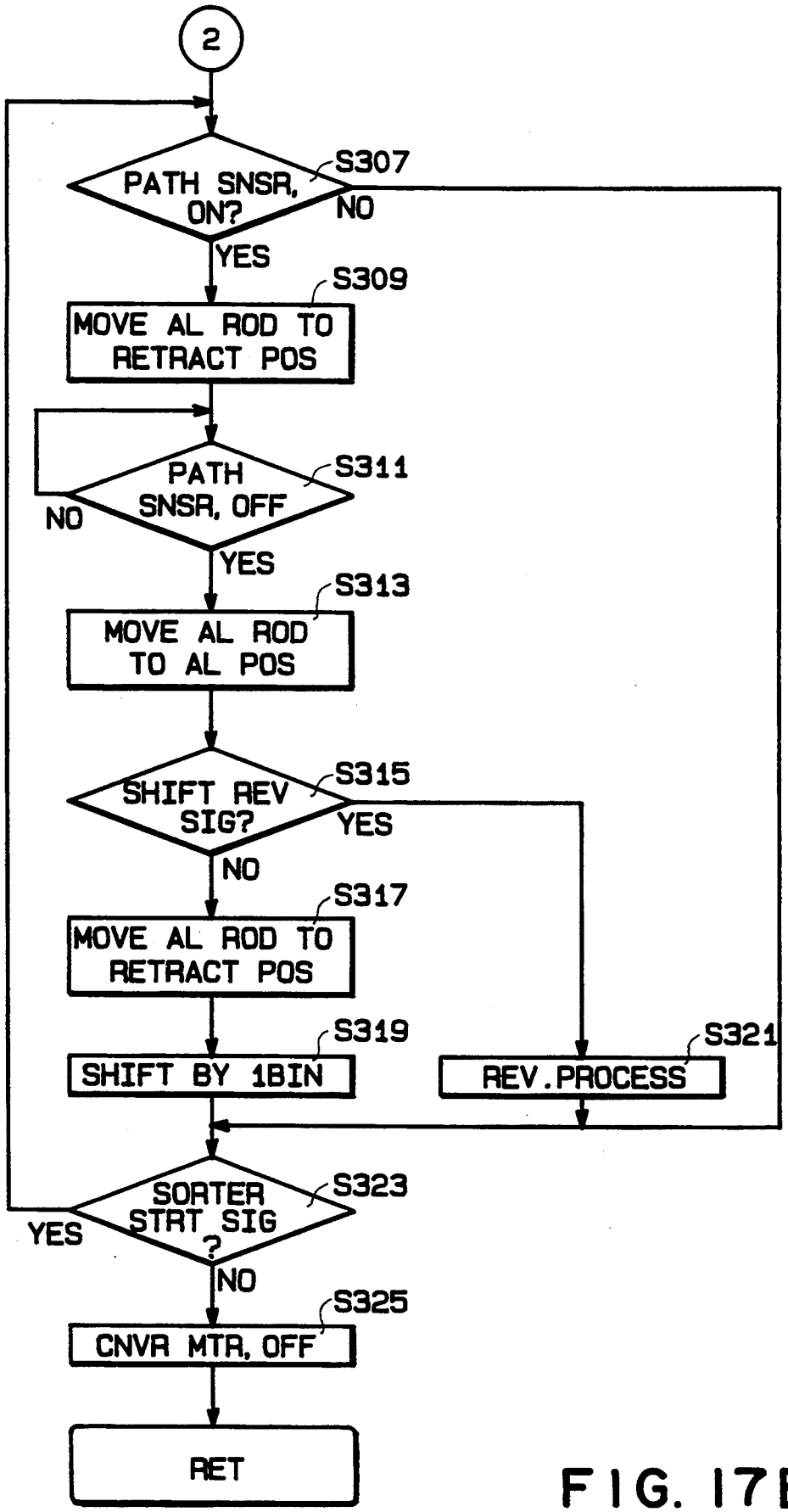

Referring to FIG. 17, the sorting mode operation will be described. First, the presence or absence of the bin initial signal for receiving the sheet from the topmost bin, is checked at step 310. If the there is no bin initial signal, the operation proceeds to step 305 or to step 303. At step 303, as the bin initialization, the bin unit is lowered to the non-sorting home position. At step 305, the conveying motor is actuated, and subsequently, the state of the path sensor is checked at step 307. If the state of the path sensor is not on, at step 307, the operation proceeds to step 323. If it is on, the operation proceeds to step 309, and for the purpose of effecting aligning operation to the discharged sheet, the aligning member is placed at the retracted position. Thereafter, when the off-state of the path sensor is detected at step 311, the sheets are aligned ate step 313. At step 315, the bin shifting operation at step 319 and the reversing operation at step 321 are carried out depending on the presence or absence of the shift reversing signal at step 315. The reversing process means the process for reversing the subsequent bin shifting direction, and no bin shifting operation is carried out. At step 323, when the sorter start signal is on, the operation returns to step 307. On the other hand, if the sorter start signal is on, the conveying motor is stopped, and the sorting operation is terminated at step 325.

Figure 18:
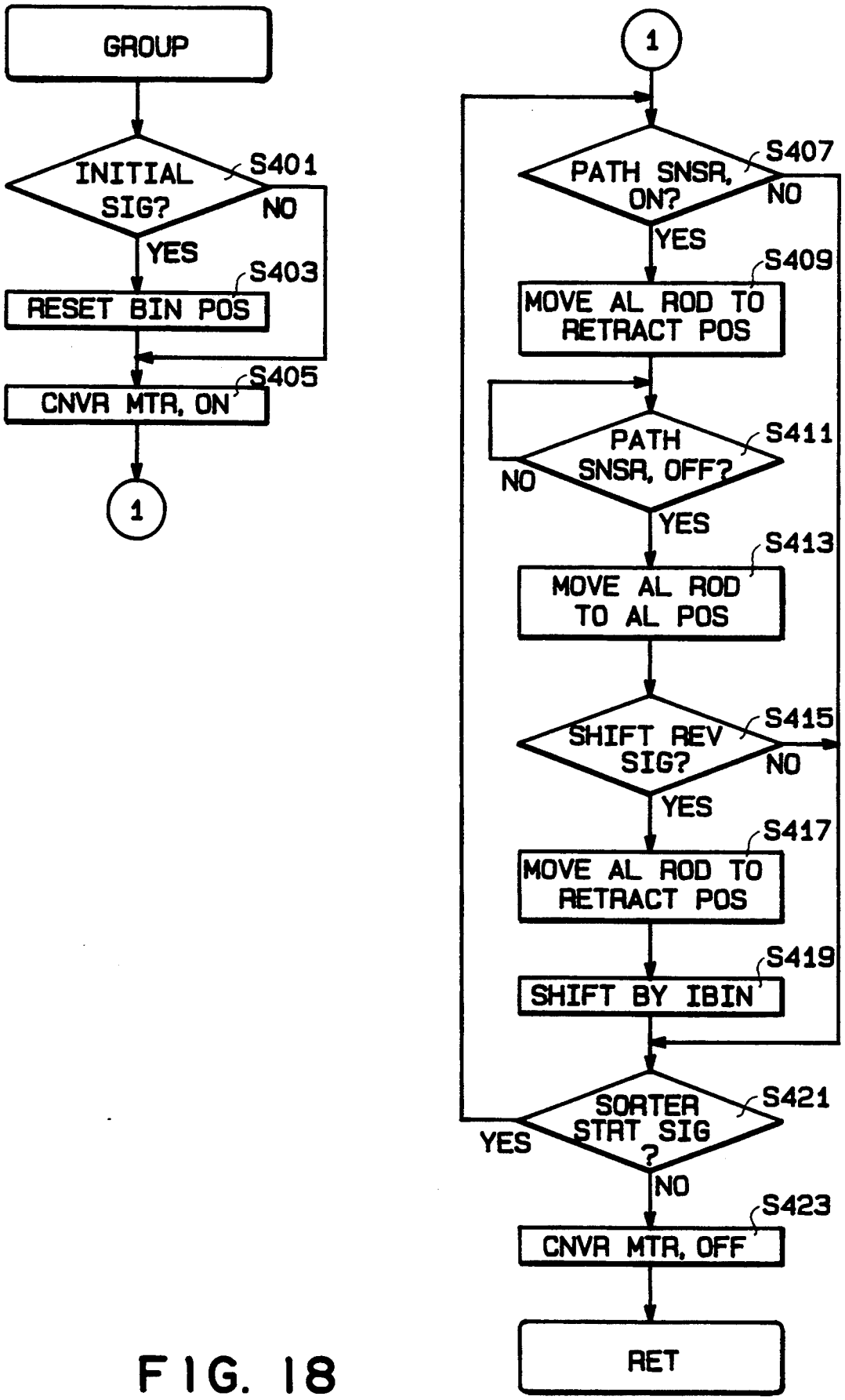
FIG. 18 is a flow chart of operations in a grouping mode.

Referring to FIG. 18, the grouping mode operation will be described. First, in order to accommodate the sheet from the topmost bin, the discrimination is made as to whether or not the bin initial signal is produced at step 401. If not, the operation proceeds to step 405 or step 403. At step 403, a the initialization of the bin, the bin unit is lowered to the non-sorting home position. At step 405, the conveying motor is actuated, and then, the state of the path sensor is checked at step 407. If the state of the path sensor is not on at step 407, the operation proceeds to step 421. If it is on, the aligning means is retracted for the purpose of subsequent sheet aligning operation at step 409. Thereafter, when the off state of the path sensor is detected at step 411, the aligning operation for the sheet is carried out at step 413. At step 415, depending on the presence or absence of the bin shift signal next operation is carried out more particularly if yes, the aligning means is retracted at step 417, and the bin unit is shifted by one stage at step 414. If not, the operation proceeds to step 421. If the sorter start signal is on at step 421, the operation returns to step 407. If the sorter start signal is off, the conveying motor is stopped, and the sorting operation is completed at step 423.

Figure 19:
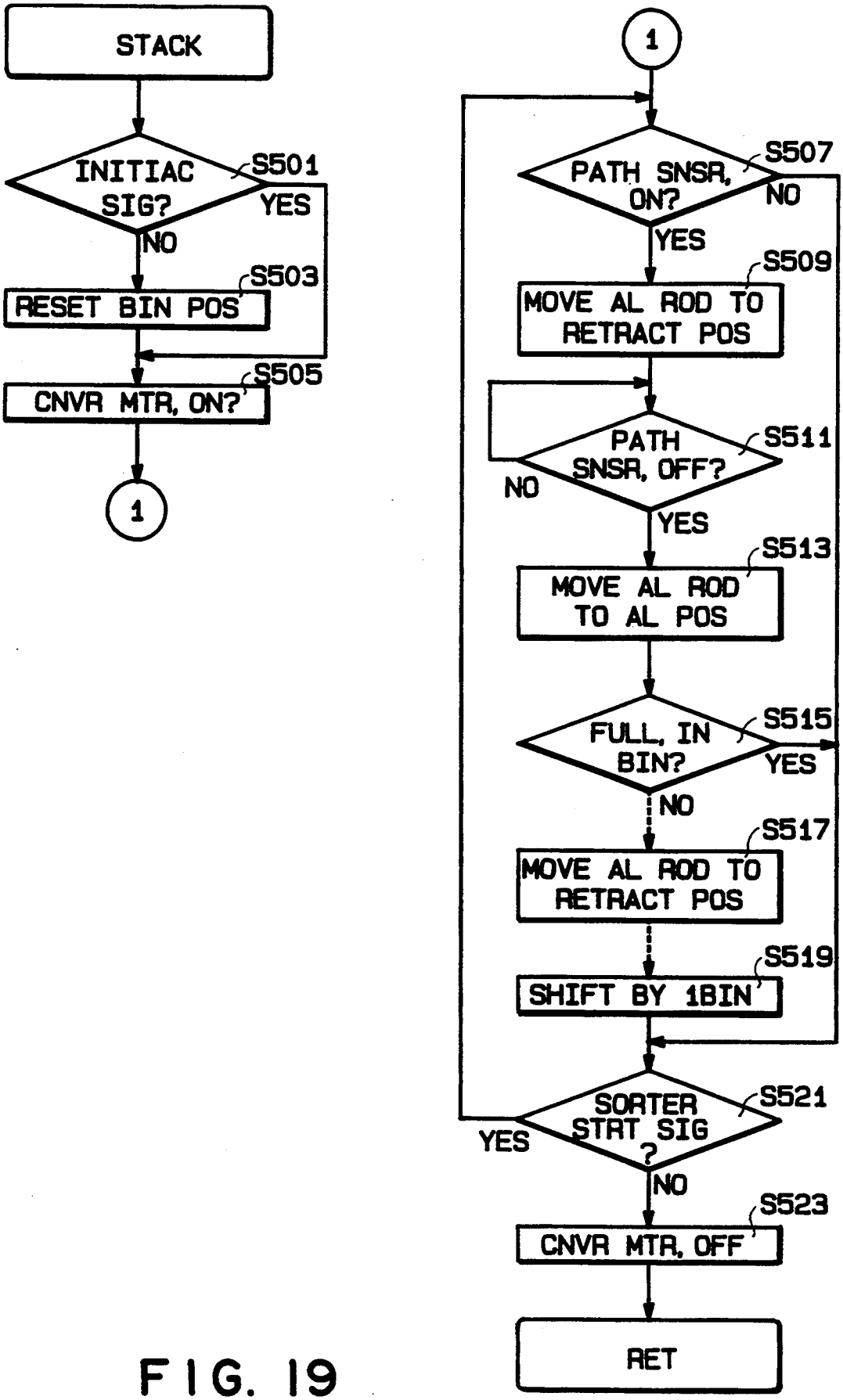
FIG. 19 is a flow chart of stacking operations.

Referring to FIG. 19, the stacking mode operation will be described. First, in order to accommodate the sheet by the topmost bin, the presence or absence of the bin initial signal is checked at step 501. If there is no bin initial signal, the operation proceeds to step 505. If so, the operation proceeds to step 503. At step 503, for the purpose of initializing the bin, the bin unit is lowered to the non sort home position. At step 505, the conveying motor is actuated, and then, the discrimination is made as to the state of the path sensor at step 507. The state of the path sensor at step 507 is not on, the operation proceeds to step 521. If it is on, the aligning rod is retracted for the purpose of permitting the subsequent aligning operation for the discharged sheets at step 509. Thereafter when the off state of the path sensor is detected thereafter at step 511, the sheet aligning operation is carried out at step 513. When the number of the sheets accommodated in the bin does not reach the upper limit at step 515, the operation proceeds to step 521. If it reaches the upper limit, the aligning member is retracted at step 517, and the bin is shifted by one stage at step 519. At step 521, if the sorter start signal is in on state, the operation returns to step 507, and if the sorter start signal is in off state, the conveying motor is stopped, the operation is completed at step 523.

Figure 20:
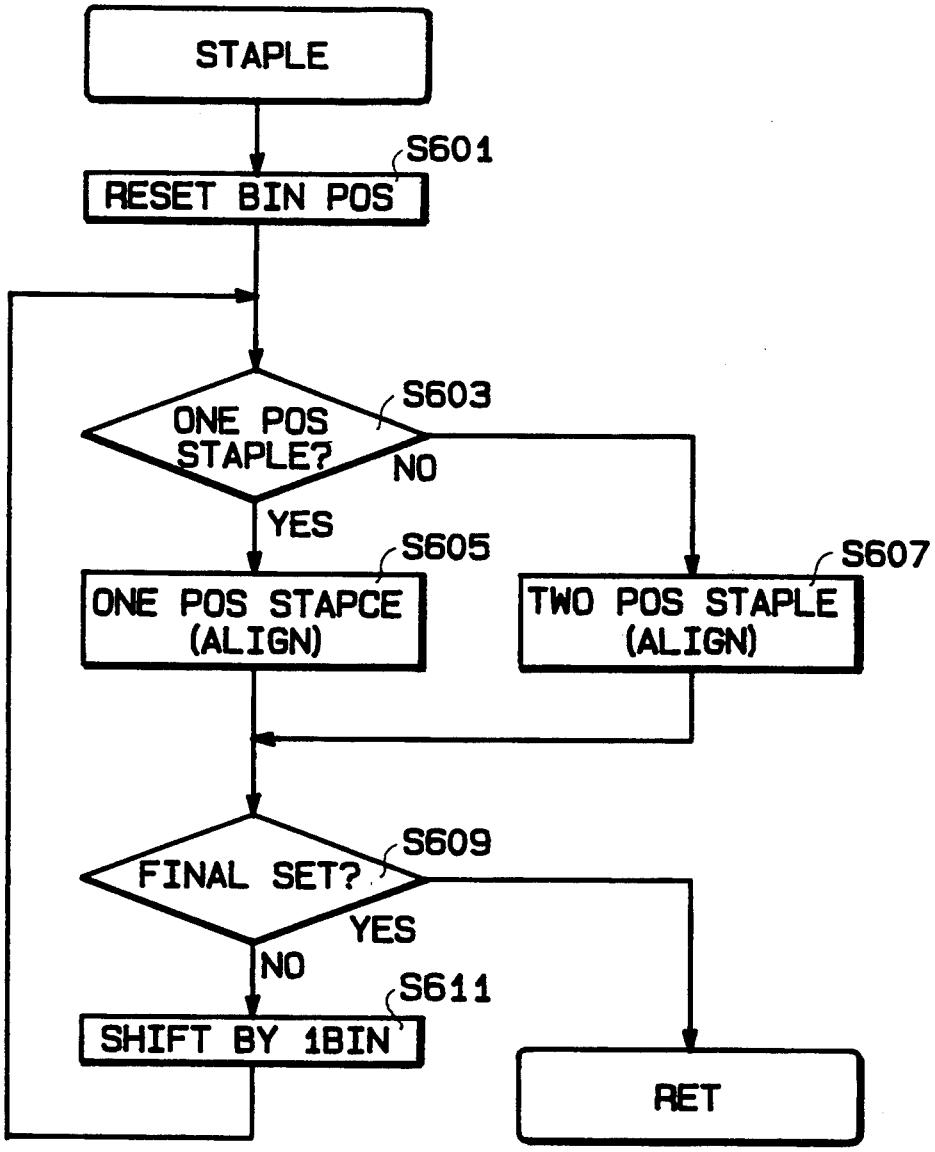
FIG. 20 is a flow chart of stapling operations.
Figure 21:
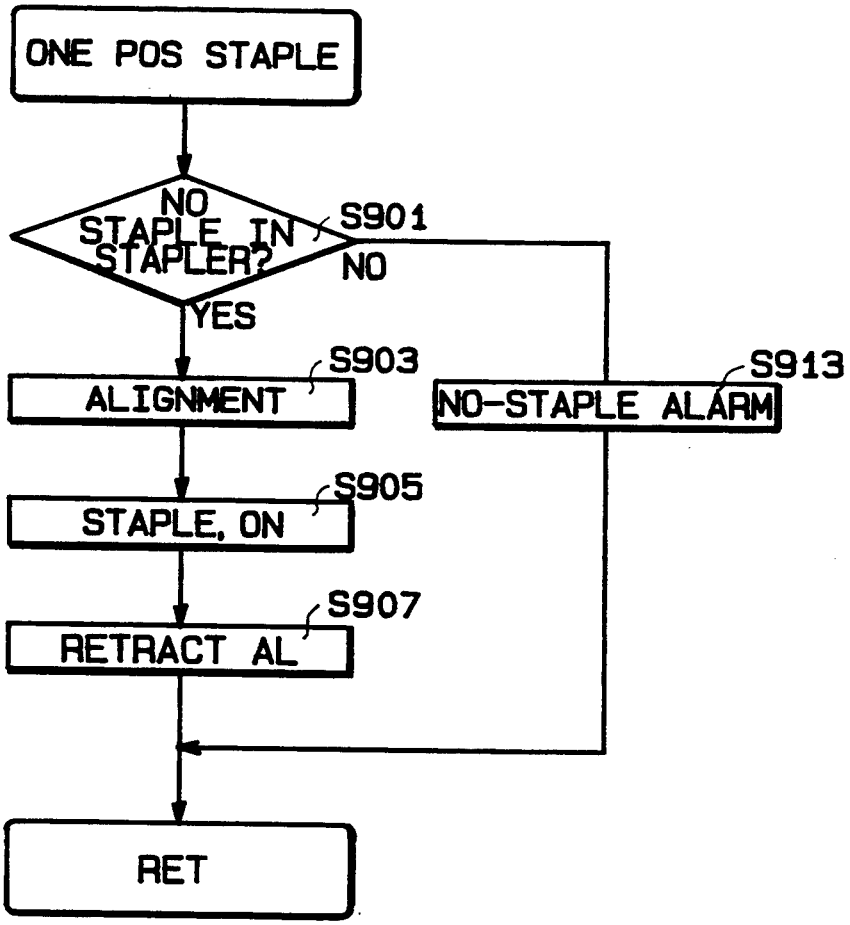
FIG. 21 is a flow chart of operations in one position stapling mode.

Referring to FIG. 20, the stapling process operation will be described. FIG. 21 is a flow chart of the stapling process operations. At step 601, the bin position is initialized for the purpose of a series of stapling operations. The initial bin position is the topmost or bottommost bin among the bins being used, that is closest to the current bin. After the completion of the movement, the shifting direction is set to downward and upward depending on whether the initialized position is the upper or lower, respectively. The discrimination will be made as to whether the selected mode is one position stapling or two position stapling at step 603. The stapling mode is discriminated from the stapling mode data transmitted from the main assembly through the serial communication described hereinbefore. If the one position stapling is discriminated at step 603, the operation proceeds to step 605 to execute the one position stapling. If the two position stapling is discriminated at step 603, the operation proceeds to step 607 to execute the two position stapling operation. The one position stapling process at step 05 and the two position stapling process at step 607, will be described in detail hereinafter referring to FIGS. 21 and 22. When the stapling operation is completed at step 605 or step 607, the operation proceeds to step 609. Then the discrimination will be made as to the stapled sheet set is the final set in the series of stapling operation or not. If it is the last set, the stapling operation is completed. If not, the bin unit is shifted by one stage, and the operation returns to step 603, and the operation is continued.

Figure 23:
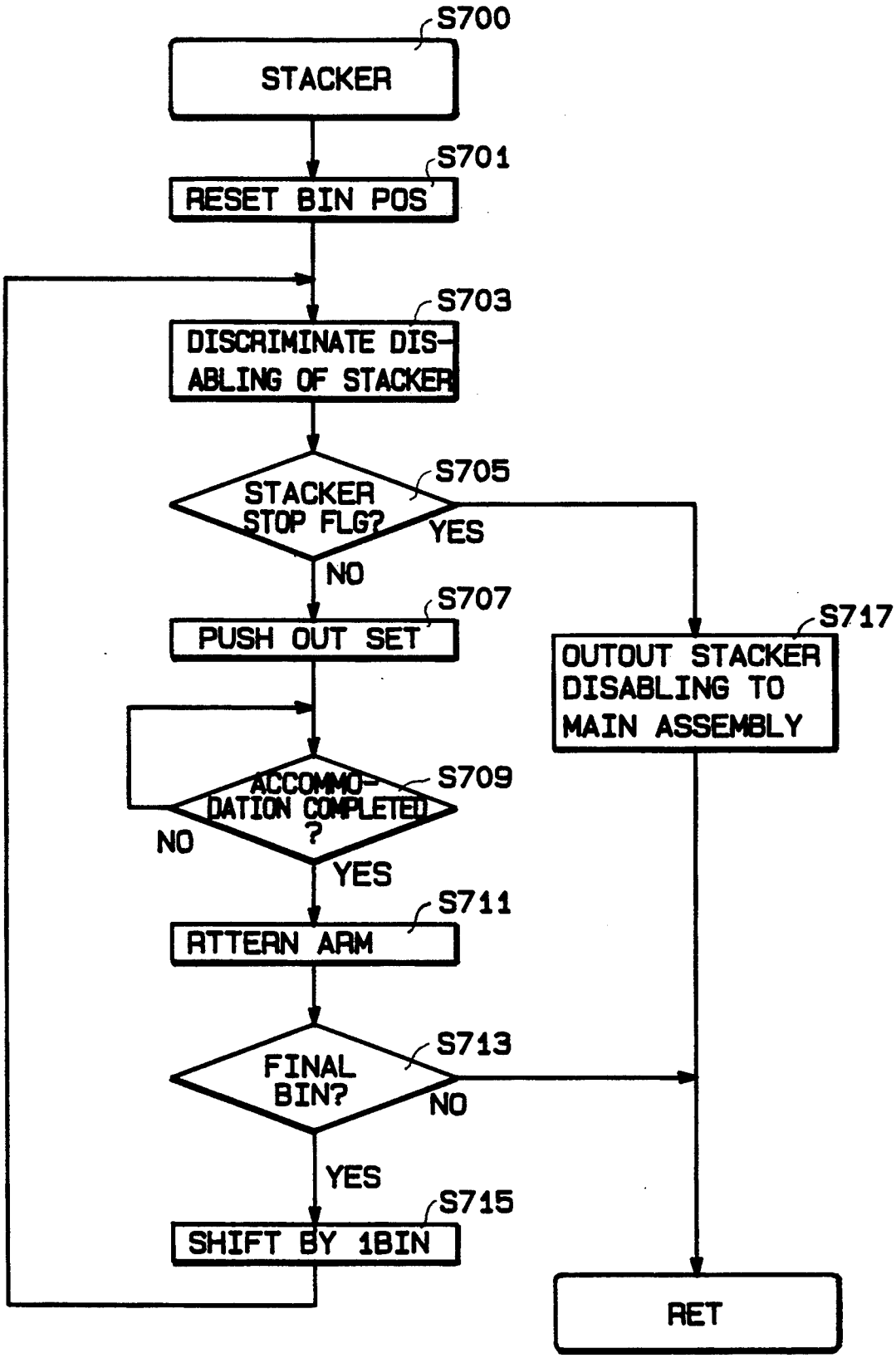
FIG. 23 is a flow chart of stacking operations.

FIG. 23 is a flow chart of a series of stacking operations. In the stacking operation, the bin position is initialized for the purpose of effecting a series of stacking operations, at step 701. The initialized bin is the topmost or bottommost bin that is closest to the current bin. After the termination of the movement, the bin shifting direction is set to downward or upward depending on whether the initial bin is an upper bin or lower bin, respectively. Subsequently, the discrimination is made as to whether or not the stacker is disabled at step 703. At step 705, the discrimination is made on the basis of the stacker disablement flag set at the step 703. If the stacker disablement flag is reset, the operation proceeds to step 707, in which the sheet set is pushed out by the arm 450*b*. Here, the stacker effects the stacking operation. After the completion, the stack accommodation completion signal is supplied through the serial communication described hereinbefore. The sorter is waiting for this signal at step 709. When the stacking operation is completed, the sheet pushing arm 450*b* is returned at step 711. Then, the operation proceeds to step 712, where the discrimination is made as to the stacked set of sheets are the last set. If so, the stacking operation is completed. If it is not at step 713, the operation proceeds to step 715, by which the bin unit is shifted by one stage and returns to step 703, and the operation is continued. If the stacker disablement flag is set at step 705, and the stacking operation is prohibited, the operation proceeds to step 717, and the stack prohibiting alarm is produced to the main assembly of the copying machine, and the operation is completed.

Figure 24:
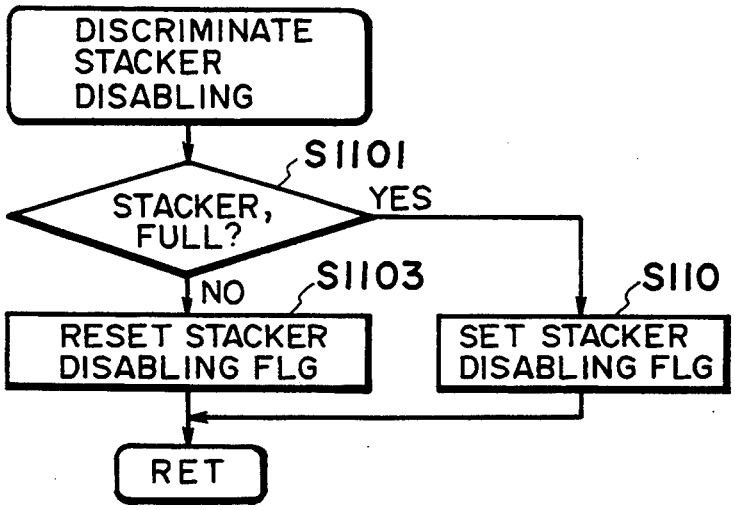
FIG. 24 is a flow chart of stacker disabling operations.

FIG. 24 is a flow chart of stacker disablement discrimination. First, at step 1101, the discrimination is made as to whether or not the stacker is full or not. If so, any more stacking operation is impossible, and therefore, the operation proceeds to step 1103, where the stacker disablement (incapability of stacking operation) flag is set, and the operation is completed. If the stacker is not full as a result of discrimination at step 1101, the further stacking is possible, and therefore, the stacker preventing flag is reset, and the operation is completed.

Figure 25:
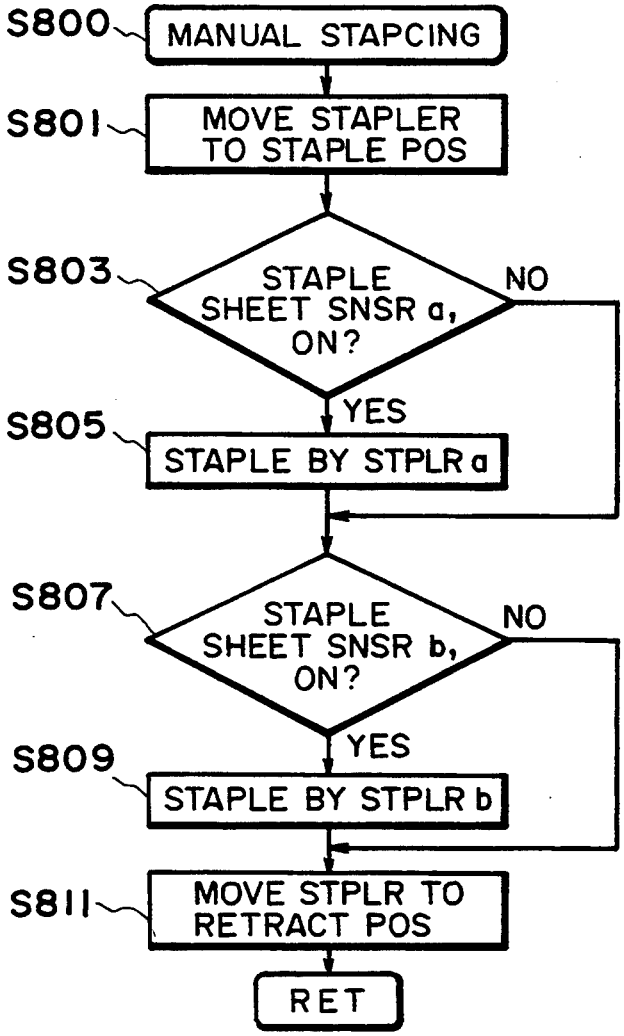
FIG. 25 is a flow chart of manual stapling operations.

Using FIG. 25, the description will be made as to the manual stapling operation. In the manual stapling, the operator inserts the set of sheets to the stapler, and the stapling operation is carried out for one bin. First, at step 801, the stapler is moved to the stapling position. After the completion of the movement, the discrimination is made as to whether or not the sheets are at the position a of the stapler by a staple sheet sensor a at step 803. If so, the operation proceeds to step 805, and the sheets are stapled by the stapler a. If the results of discrimination at step 803 is indicative of the absence of the sheet, the operation proceeds to step 807 after the sheets are stapled by the stapler a at step 805. At step 807, the discrimination will be made as to whether or not there is a sheet at a stapler b by a staple sheet sensor b. If so, the programs proceeds to step 809, where the sheets are stapled by the stapler b. At step 807, if there is no sheet at the stapler b, or if the stapling operation is completed at step 809, the operation proceeds to step 817, and the stapler is moved to the retracted position, and the operation is completed.

Figure 26:
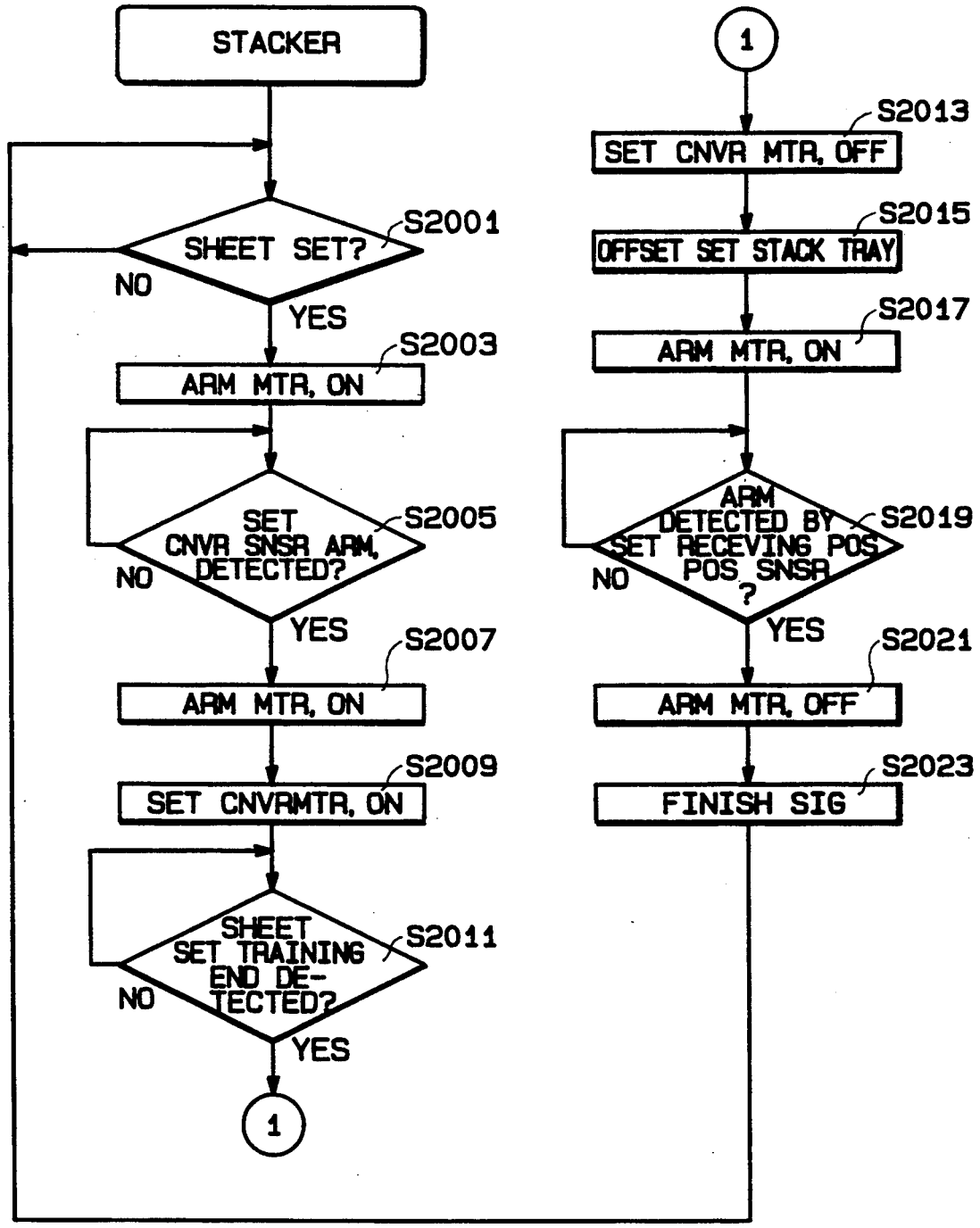
FIG. 26 is a flow chart of stacking operations.

Referring to FIG. 26, the stacking operation will be described. First, at step 2001, when the sheet set detecting sensor detects a set of sheets, the operation proceeds to step 2003, where the arm swinging motor is actuated. When the sheet conveying sensor detect the arm, the arm swinging motor is stopped (steps 2005 and 2007). Subsequently, the sheet conveying motor is actuated at step 2009, and the sheet set is conveyed until the sheet set detecting sensor detects the trailing edge of the sheet set. When the sheet set detecting sensor detects the trailing end of the sheet set, the sheet conveying motor is stopped (step 2011 and step 2013), thus completing the stacking of the sheet set on the set stacking tray. To discriminate the received set of sheets from the next set of sheet, the sheet set is offset at step 2015. To permit the next sheet set reception, the arm swinging motor is actuated, and when the set receiving position sensor detects the arm, the arm swinging motor is deactuated (steps 2017, 2019 and 2021). Here, a stacker accommodation completion signal indicative of the completion of the accommodation of the set of sheets is produced to the sorter at step 2023, and the operation returns to step 2001.

FIG. 21 is a flow chart of one position stapling operation of the above-described stapling operations. First, at step 901, the discrimination is made as to whether or not the stapler contains staples. In the one position stapling mode, the stapler 412*a* is used, and therefore, the discrimination is made using the detecting sensor S410*a*. If it contains the staples, the operation proceeds to step 903. To prevent the deviation of the sheet, the set of sheets is confined by the aligning rod. Then, the operation proceeds to step 905, where the stapling operation is carried out. At step 907, the aligning rod is retracted, and the one position stapling operation is completed. If the result of discrimination at step 901 is indicative of no staple, the operation proceeds to step 913, where the no-staple alarm is produced to the main assembly, and the operation is completed. Since the operation is completed without stapling operation in the case of absence of the staple, it is possible to switch the mode to the non-stapling mode.

Figure 22:
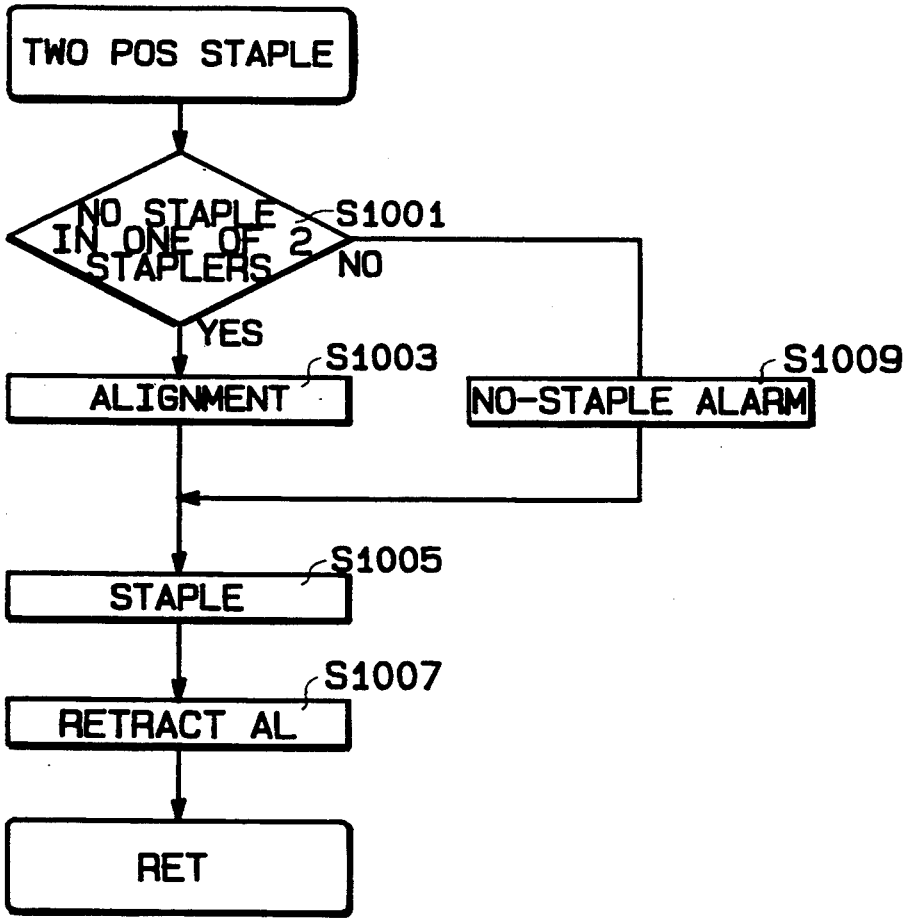
FIG. 22 is a flow chart of two-position stapling operations.

FIG. 22 is a flow chart of the two position stapling operation. At step 1001, the discrimination is made as to whether or not the stapler contains the staple or not. In the two position stapling mode, the staplers 412*a* and 412*b* are used, the absence of the staple is discriminated if at least one of the staplers is in the staple absent state. If there is the staple, the program proceeds to step 1003, and the set of sheets is confined by the aligning rod to prevent deviation of the sheets. At step 1005, the stapling operation is carried out. The staplers 412*a* and 412*b* are simultaneously actuated. However, the actuations of the stapling motors 432*a* and 432*b* may be slightly deviated in time to prevent overlapping of the peak currents. After the completion of the stapling operation, step 1007 is executed to retract the aligning rod, and the two position stapling operation is completed. If the result of discrimination at step 1001 is indicative of the absence of the staple, the operation proceeds to step 1009, and the staple absence alarm is produced to the main assembly, and the operation is completed.

The basic structure and operation of the sheet post-processing apparatus to which the present invention is applied, have been described. Referring to FIGS. 20–30, a feature of the present invention will be described in detail.

Figure 27:
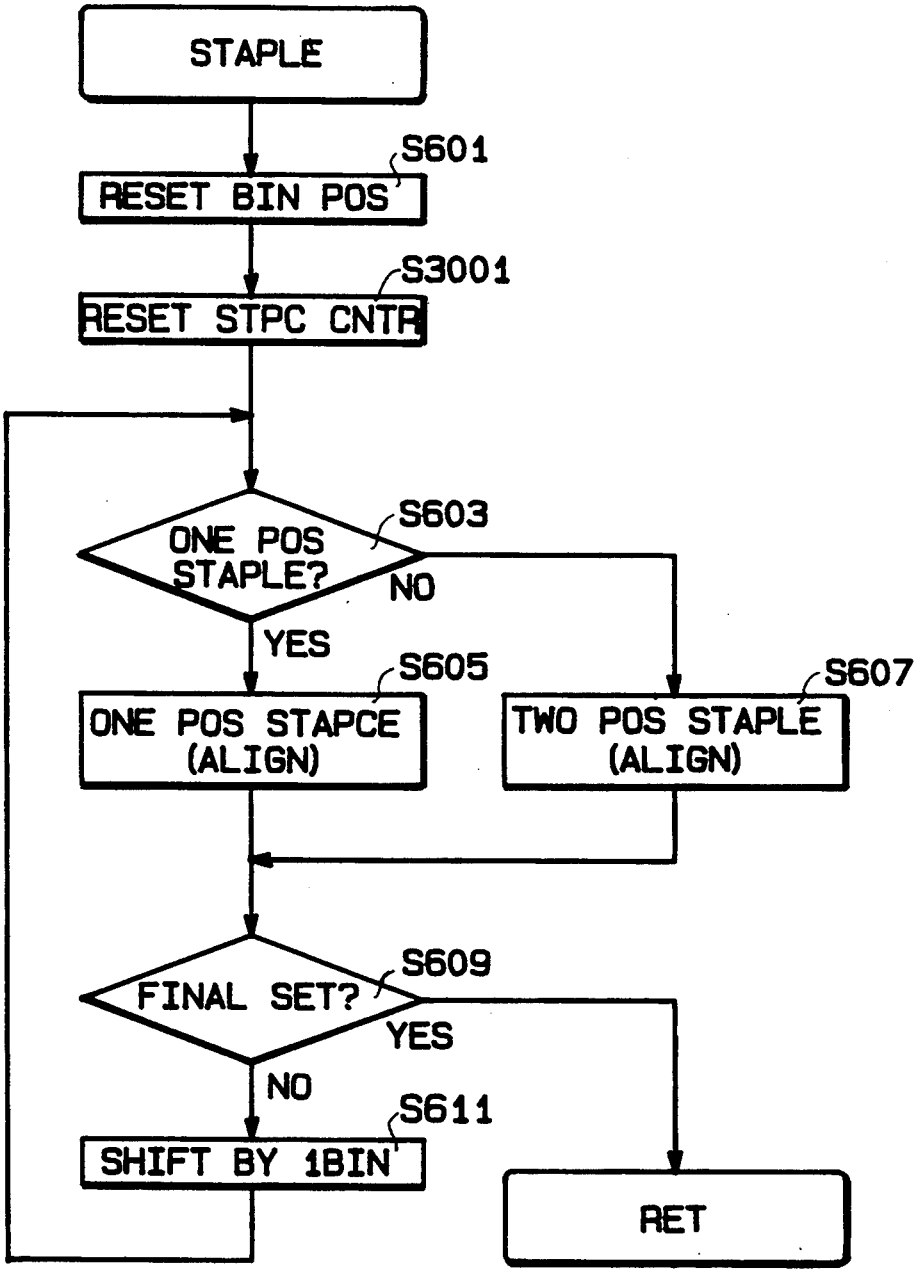
FIG. 27 is a flow chart of stapling operations according to an embodiment of the present invention.

Referring to FIG. 27, the stapling processing operation includes a step 3001. At step 3001, a staple counter is reset to count the number of sheet sets stapled by the sheet set post-processing apparatus. Referring to FIG. 27, the one position stapling process includes a step 3002. At step 3002, the number of the sets of sheets with which the stapling operations are carried out without absence of staple.

Figure 29A:
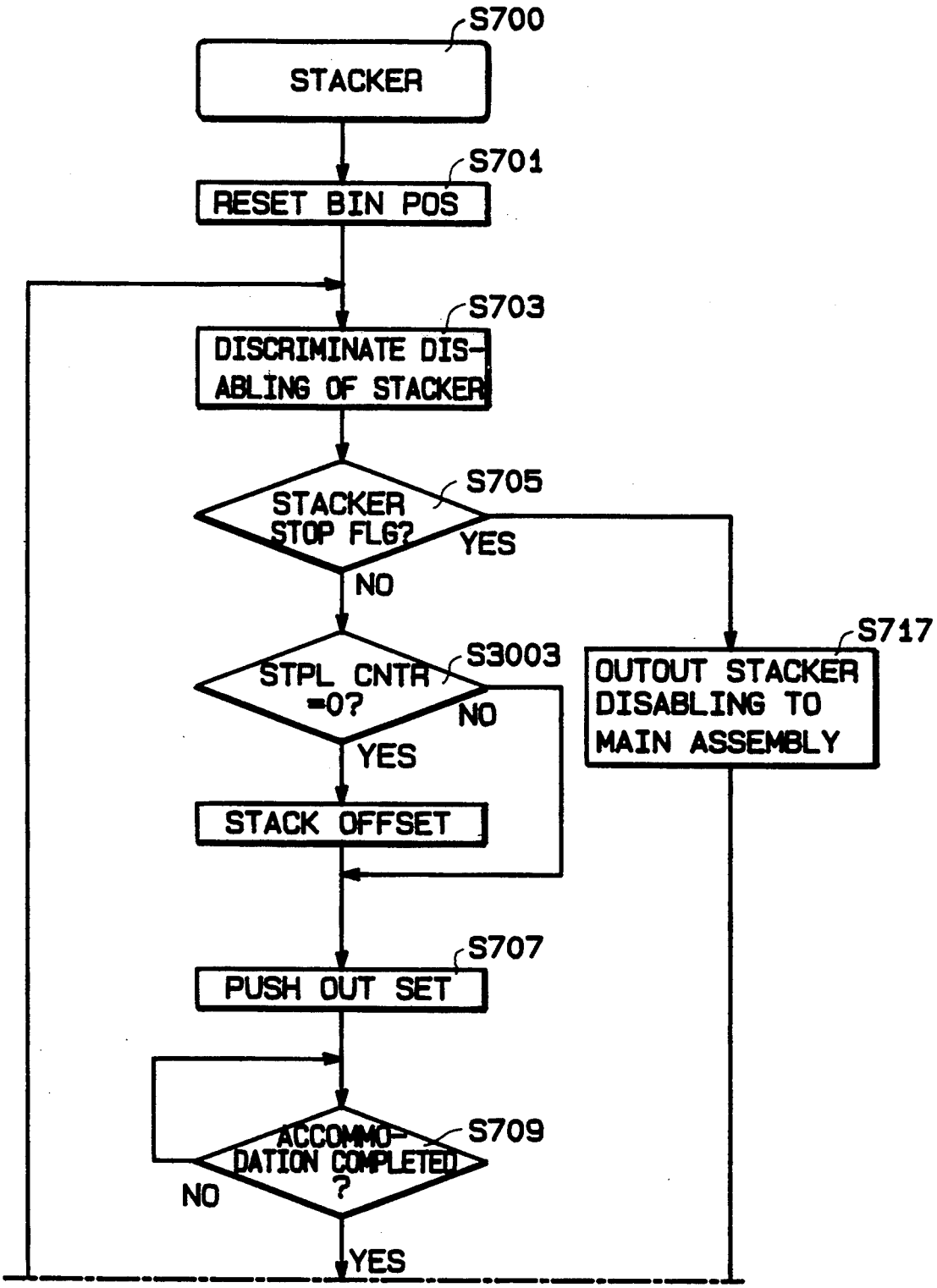
FIG. 29 is a flow chart of stacking operations according to a first example.
Figure 29B:
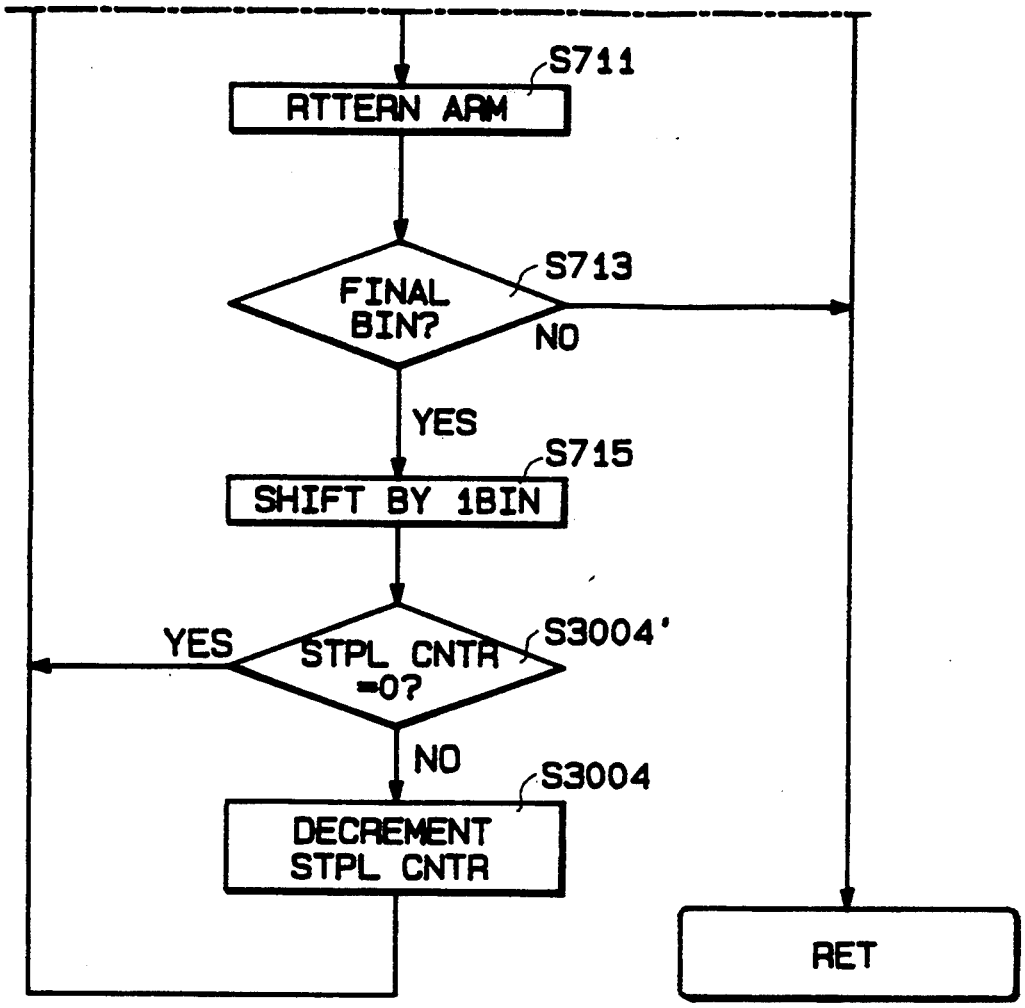
Figure 29:
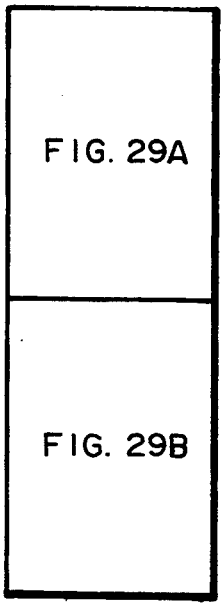

In a first example of the feature, in the stacking operation of FIG. 29, the staple counter counts the number of sets of sheets transferred to the stacker at step 3004' and step 3004. Using the counter, after the stapled sheet set is transferred, the sheet set is offset on the stacker, by which the stapled sets and non-stapled sets are easily discriminated.

Figure 30A:
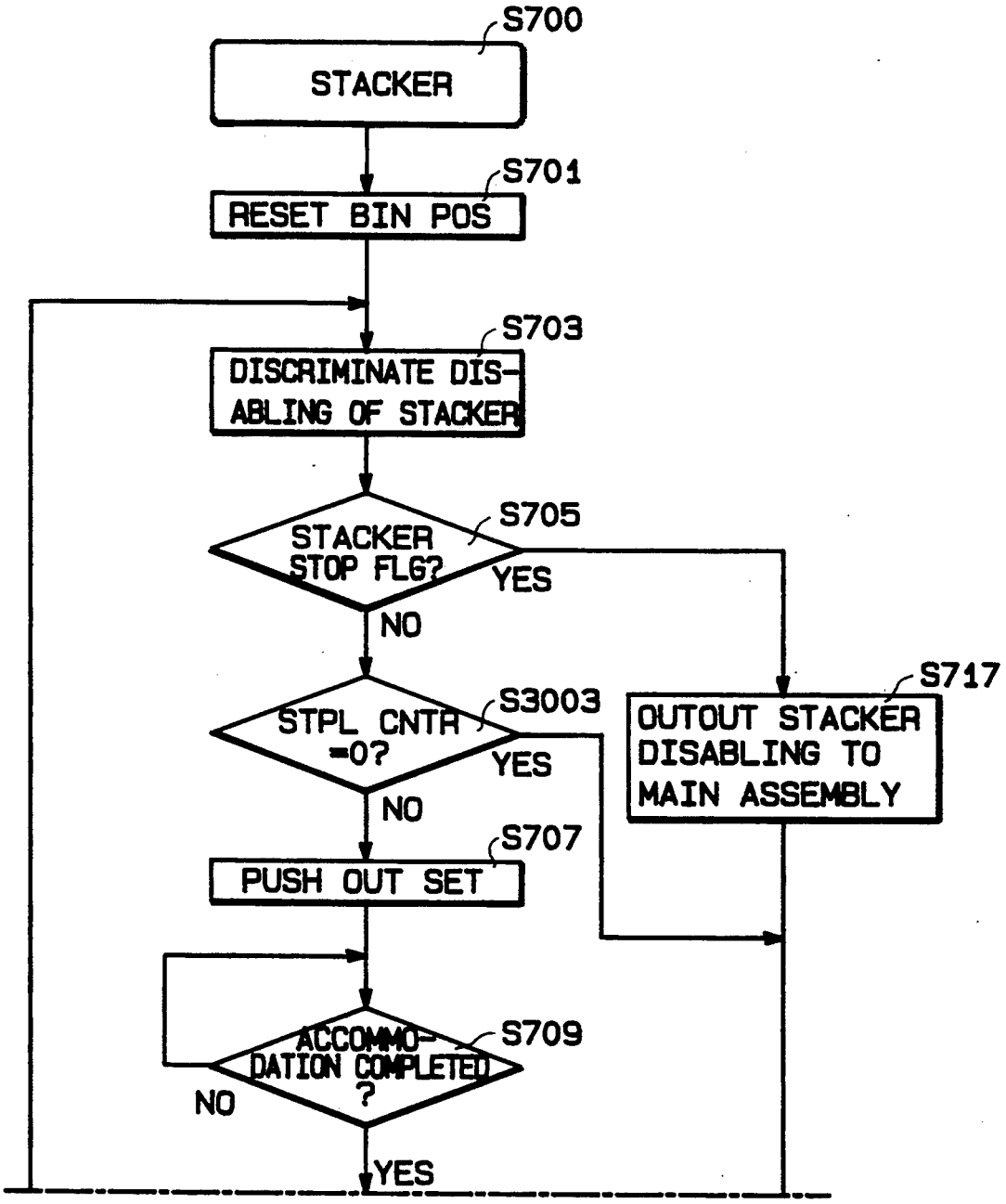
FIG. 30 is a flow chart of stacking operations according to a second example.
Figure 30B:
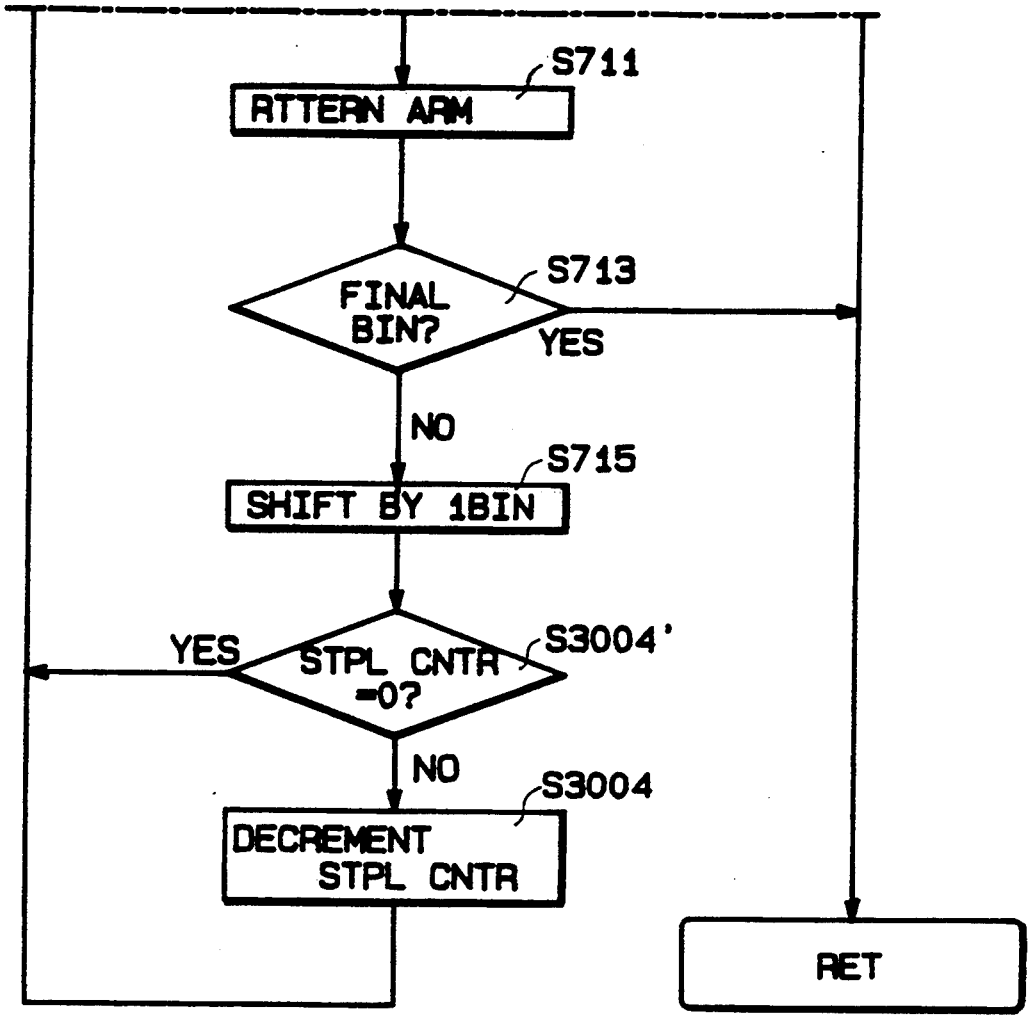
Figure 30:
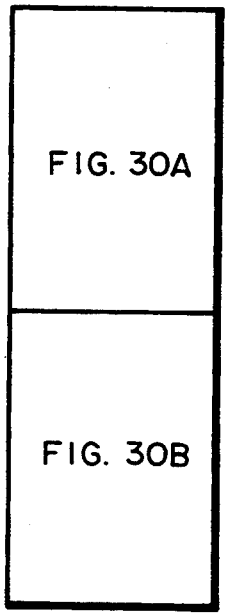

As a second example of the feature, as shown in FIG. 30, when the non-stapled set of sheets is going to be stacked at step 3003, the transfer operation to the stacker may be stopped, by which only the stacked sets of sheet can be stacked.

Figure 31:
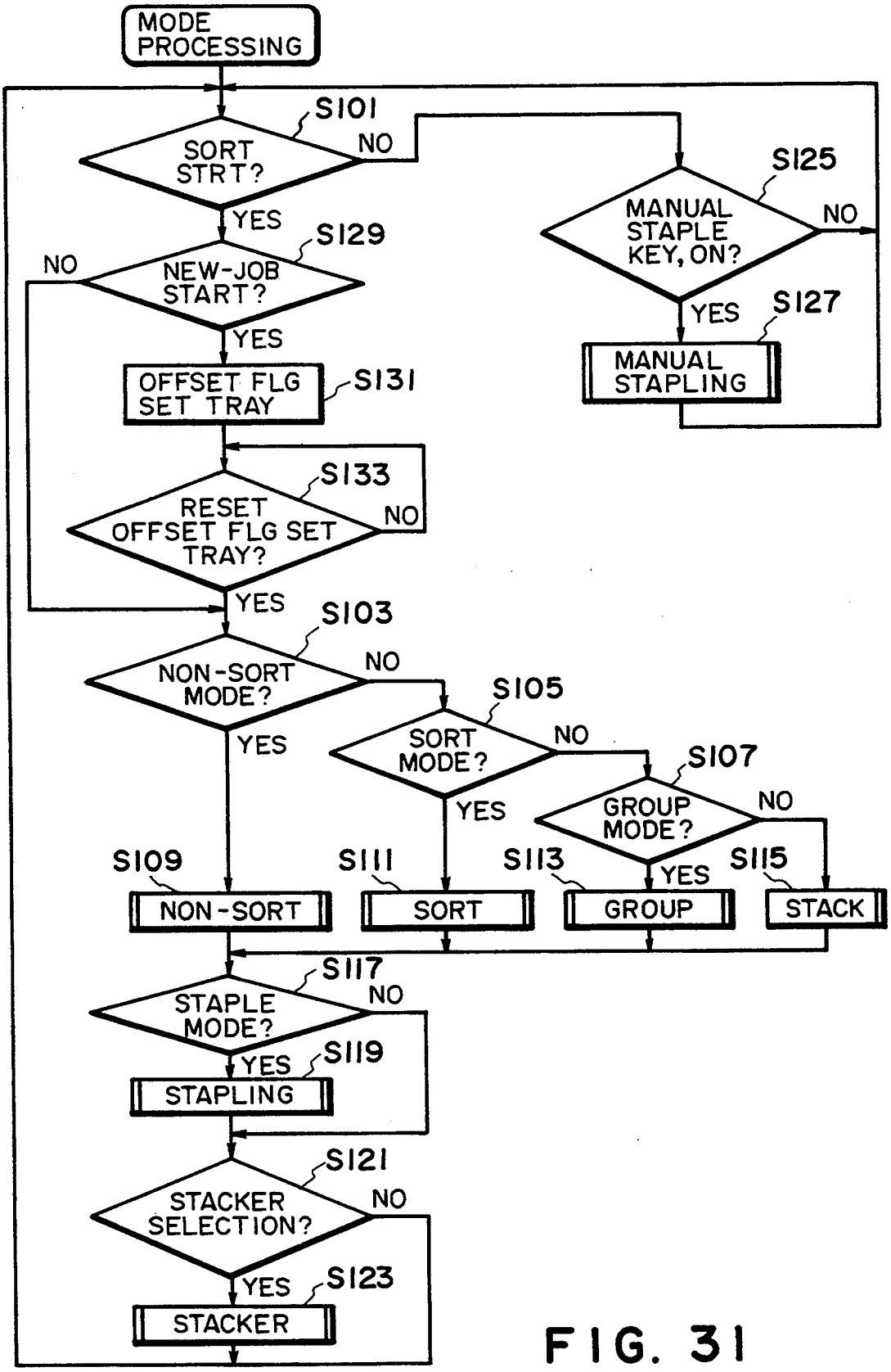
FIG. 31 is a flow chart of operations in an offset mode.
Figure 32:
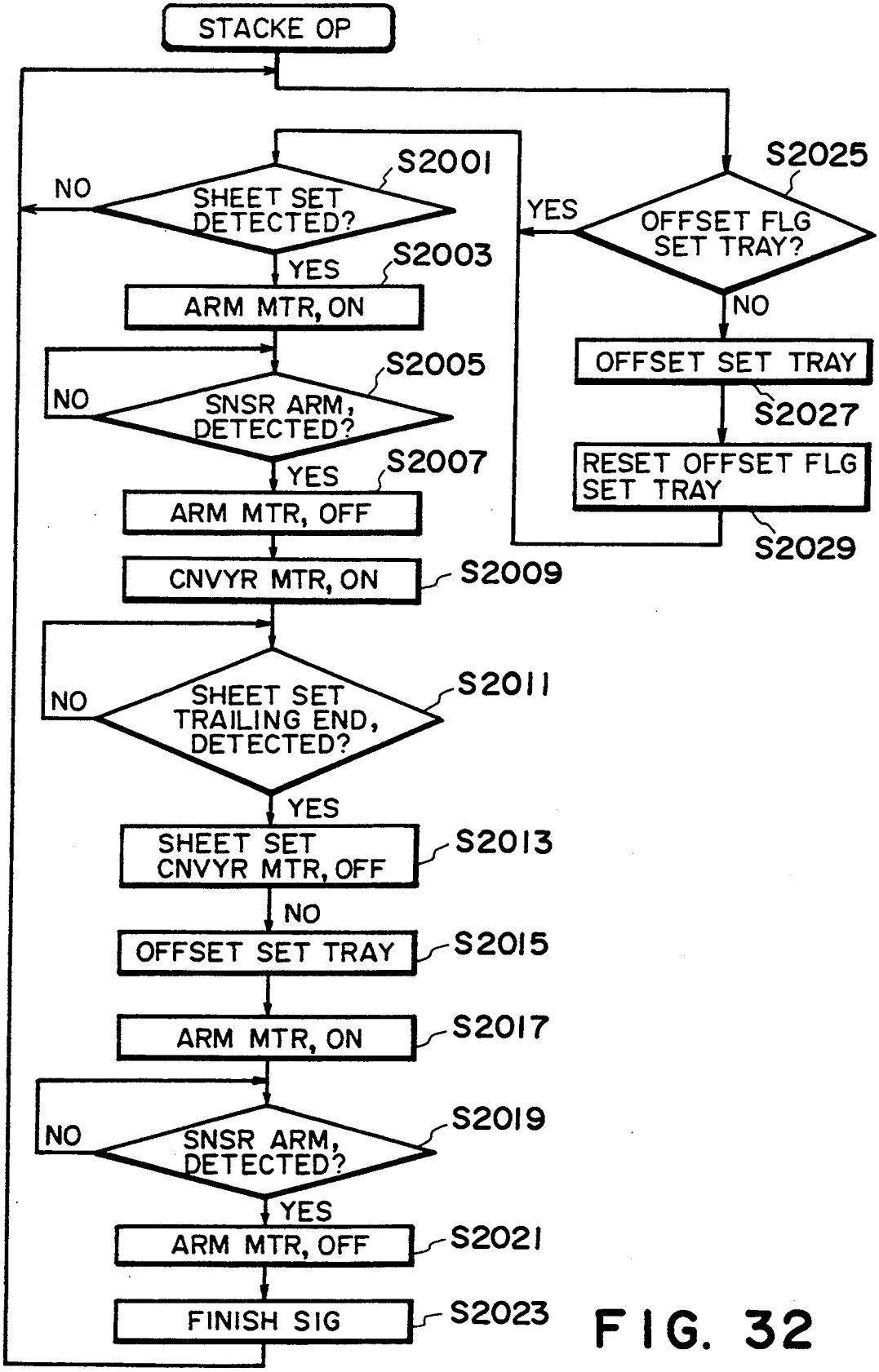
FIG. 32 is a flow chart of stacking operations.

Referring to FIGS. 31 and 32, the offset for each job will be described.

At first in FIG. 31, the description will be made as to the entire mode processing. At step 101, the discrimination is made as to the presence or absence of the sort start signal indicative of the start of the sheet discharge from the main assembly of the copying machine. If it is present, the operation proceeds to step 129. In the absence of the sorter start signal at step 101, the selection of manual stapling operation is checked at step 125. If it is on, the manual stapling operation is carried out at step 127. If it is off, the operation returns to step 101.

As step 129, the discrimination is made as to whether or not a new job is started. If not, the operation proceeds to step 103. If the new job is started, the sheet set stacking tray offset flag is set, and after the offset operation is completed on the sheet set stack tray (step 113, the operation of step 103 is executed). By the offsetting operation on the sheet set stacking tray, the sheet set is sorted for each job on the stacker.

At steps 103–107, discriminations relating to the sheet accommodation for the sheets discharged from the copying machine is carried out, and the respective process operations are carried out. More particularly, in the case of the non-sorting mode, the non-sorting mode operation is carried out at steps 103 and 109. In the case of sorting mode, the sorting operation is carried out at steps 105 and 111. In the grouping mode, the grouping operations (step 107 and step 113) are carried out. In the other case, the stacking operation is carried out. After the respective operations, the stapling operation (step 119) is executed in the case of the stapling mode selected. Thereafter, if the stacker using mode is selected (step 121), the stacking operation (step 123) is carried out, and the operation returns to step 101.

Referring to FIG. 32, the stacking operation will be described in detail. At first, it is discriminated whether or not the sheet set stacking tray offset flag is set or not, at step 2025. If it is not, the operation proceeds to step 2001. If it is set, the sheet set stacking tray offset operation is carried out, and the sheet stack stacking tray offset flag is reset. Then, the operation proceeds to step 2001. At step 2001, if the sheet set detecting sensor detects the sheet set, the operation proceeds to step 2003, where the arm swinging motor is actuated. When the sheet set conveying sensor detects the arm, the arm swinging motor is stopped (step 2005 and step 2007). Subsequently, the sheet set conveying motor is actuated at step 2009, and the sheet set is conveyed until the sheet set detecting sensor detects the trailing edge of the sheet set. When the sheet set detecting sensor detects the trailing end of the sheet set, the sheet set conveying motor is stopped (step 2011 and step 2013). Thus, the stacking of the sheet sets on the tray is completed, and the sheet set stacking tray is offset to provide distinction from the subsequent sheet set (step 2015). Then, an arm swinging motor is actuated to permit accommodating operation for the next sheet set. When the sheet set receiving position sensor detects the arm, the arm swinging motor is deenergized (steps 2017, 2019 and 2021). Here, a stacker accommodation completion signal indicative of the completion of the sheet set accommodating operation on the sorter, is produced at step 2023, and then, the operation is returned to step 2001.

Figure 33:
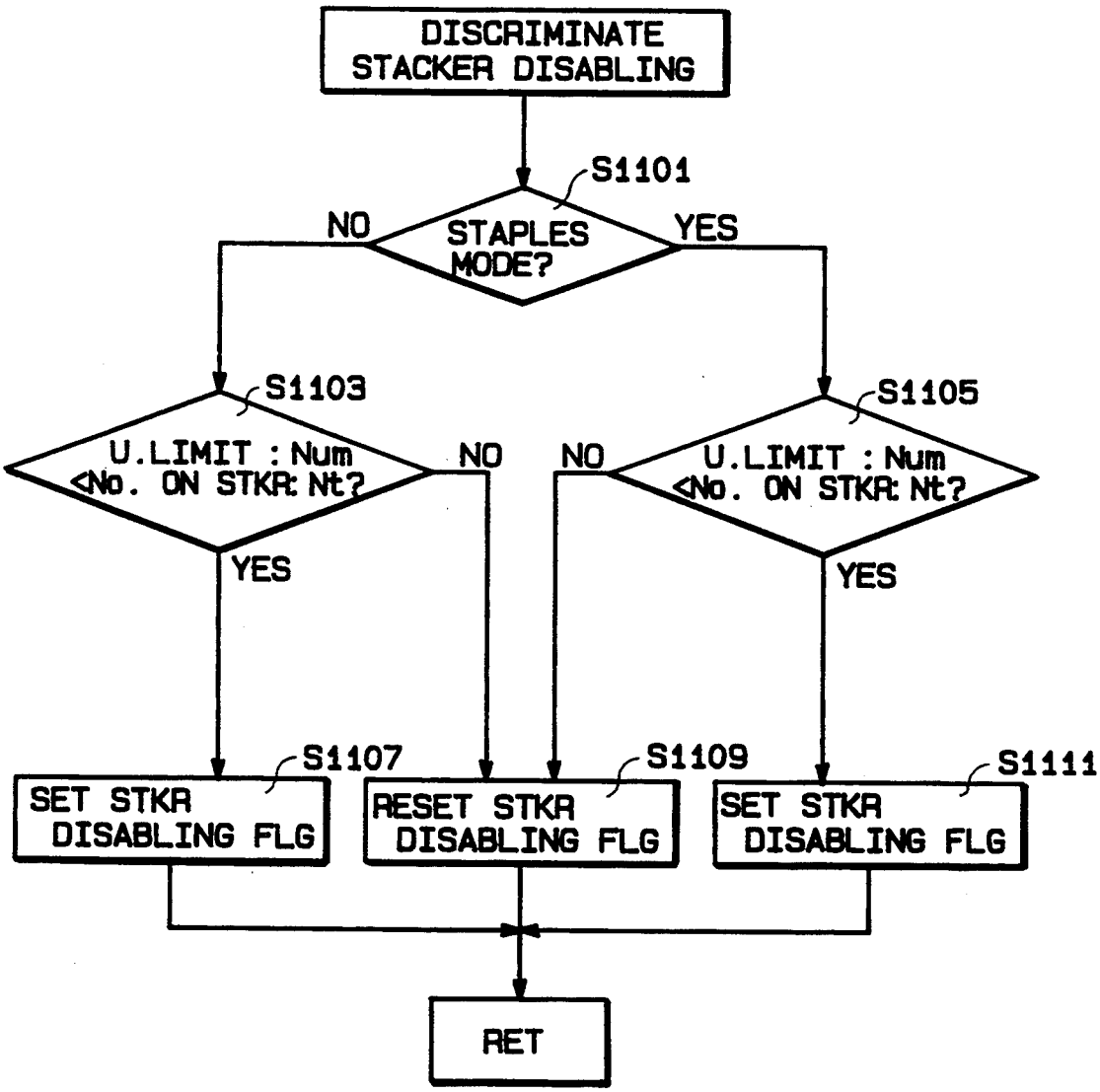
FIG. 33 is a flow chart of stacker disabling operations according to a third example.
Figure 34:
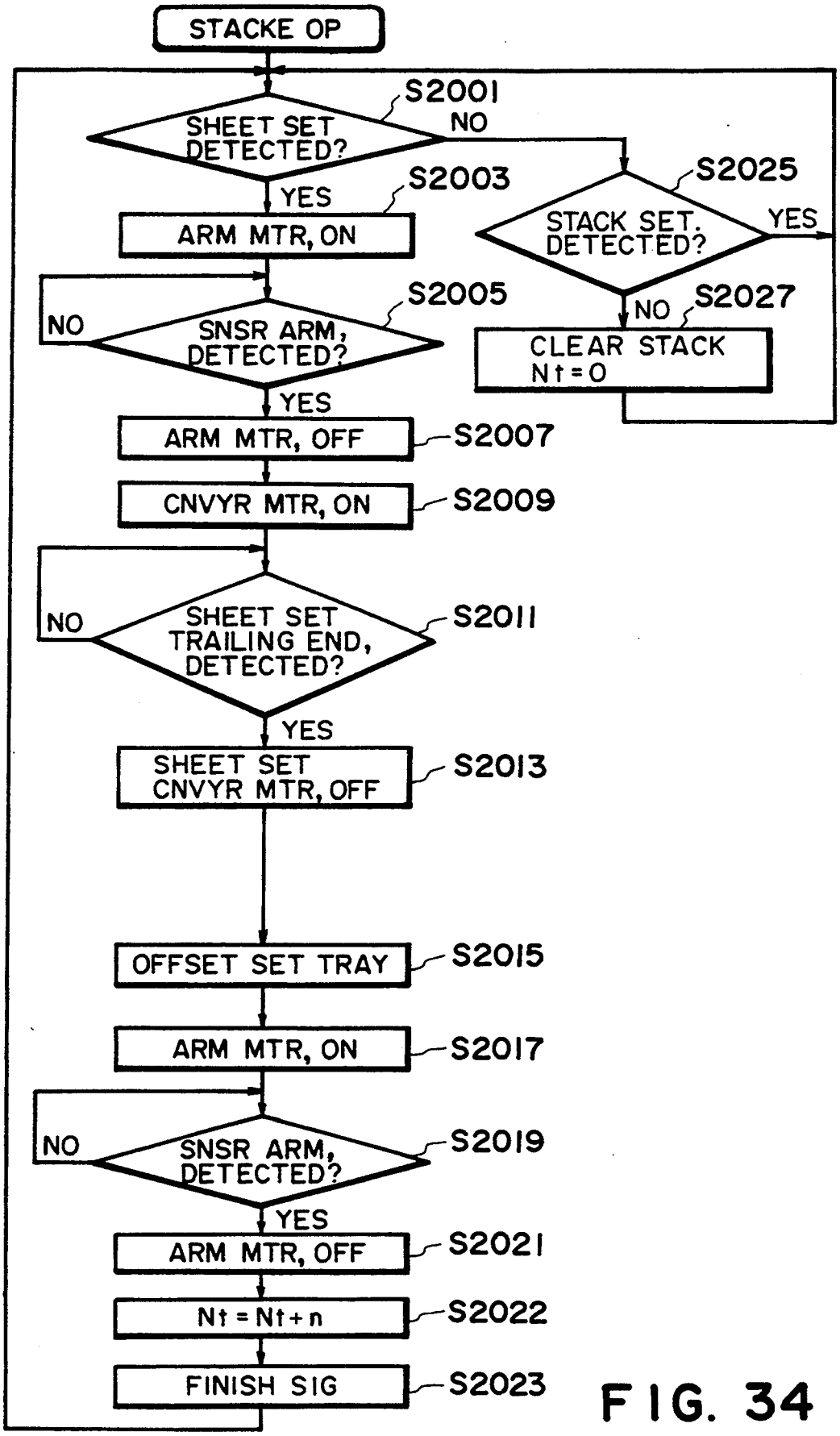
FIG. 34 is a flow chart of stacking operations.
Figure 35:
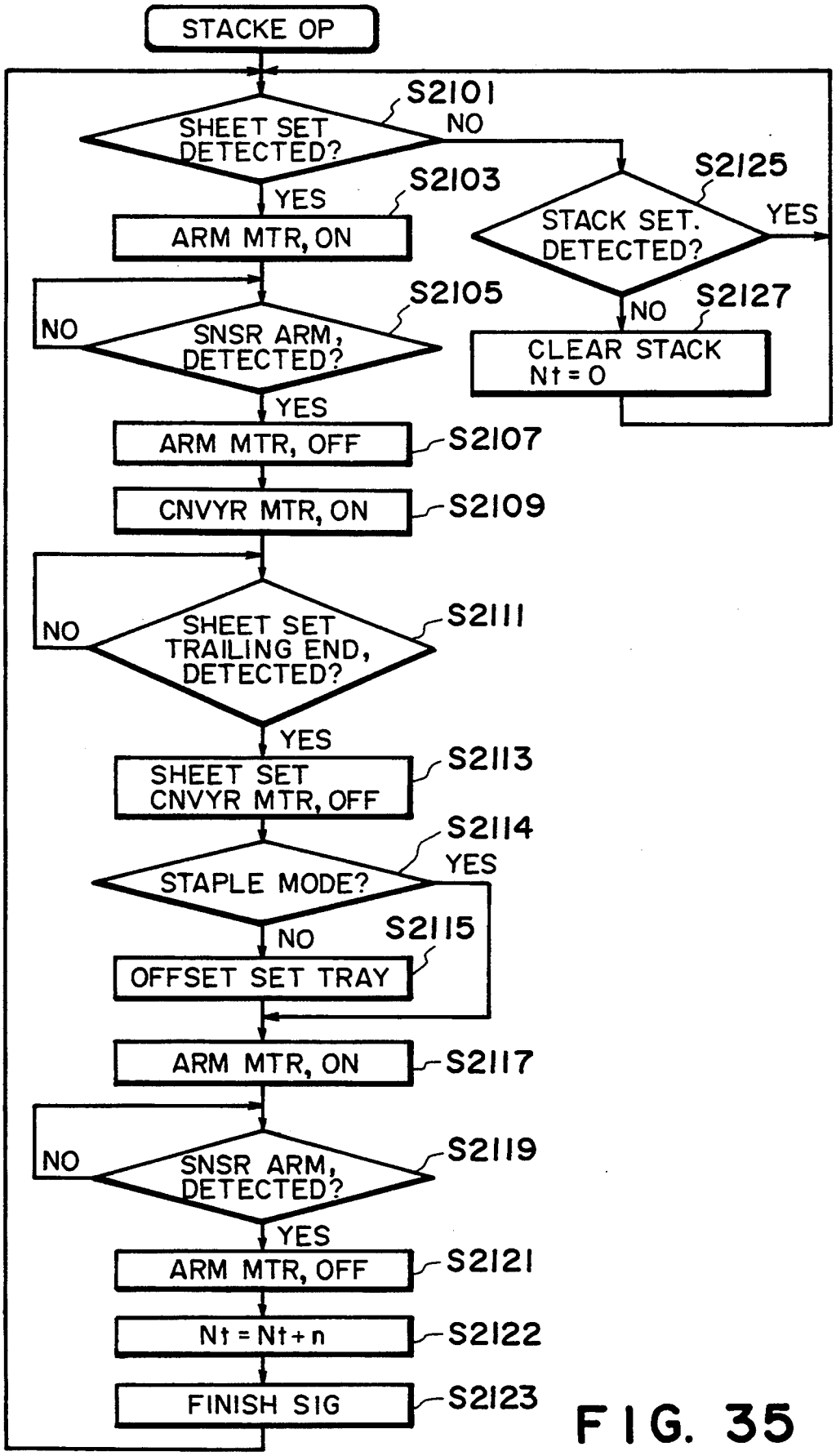
FIG. 35 is a flow chart of stacking operations.

Referring to FIGS. 33, 34 and 35, the description will be made as to the third and fourth examples of the present invention.

In these examples, the operations are similar to those shown in the flow charts of FIGS. 31, and FIGS. 15–24, and therefore, the detailed description thereof is omitted. The manual stapling operation is the same.

Referring to FIG. 34, the general description will be made as to the stacking operation. First, at step 2001, when the sheet set detecting sensor detects the sheet set, the operation proceeds to step 2003. If it is not detected at step 2001, then the presence or absence of the sheet set on the stacker is checked at step 2025. If it detects, the operation proceeds to step 2001. If not, that is, if the sheet sets on the stacker are removed, for example, the stack accommodation number of cleared at step 2027 ($Nt=0$). At step 2003, the arm swinging motor is actuated, and when the sheet set conveying sensor detects the arm, the arm swinging motor is stopped (steps 2005 and 2007). Subsequently, the sheet set conveying motor is actuated at step 2009, and the sheet set conveying operation is carried out until the sheet set detecting sensor detects the trailing end of the sheet set. When the sheet detecting sensor detects the trailing end of the sheet set, the sheet set conveying motor is stopped (steps 2011 and 2013), so that the stacking of the sheet set on the sheet set stacking tray is completed. To provide discrimination or division for the subsequent sheet set, the sheet set stacking tray is offset (step 2015). To permit the subsequent sheet set accommodation, the arm swinging motor is actuated. When the sheet set receiving position sensor detects the arm, the arm swinging motor is deactuated (steps 2017, 2019 and 2021). Here, as the number stacked on the stacker, the newly accommodated number is added at step 2022 ($Nt=Nt+n$). The stacker accommodation completion signal indicative of the completion of the sheet set accommodation operation is produced to the sorter at step 2023. Then, the operation returns to step 2001.

Third example will be described. FIG. 33 is a flow chart of stacker disablement discrimination. First, at step 1101, the discrimination is made as to whether or not the stapling mode is selected. If not, the operation proceeds to step 1103. If so, the operation proceeds to step 1105. At steps 1103 and 1105, the discrimination is made as to whether or not the stacker is full. In other words, at step 1103, the comparison is made between the upper limit of the stackable number (Nun in the non-stapling mode and the stacked number Nt). In the step 1105, the comparison is made between the upper limit Nus of the stacker in the stapling mode with the stacked number Nt. If the stack full state is detected, the stack is no longer able to stack additional sheet, and therefore, the operation proceeds to steps 1107 and 1111. Thus, the stacker disablement (incapability of further stacking) flag is set, and the operation is completed. If the stacker is not full as discriminated at step 1103 or 1105, a further stacking operation is possible, and therefore, the stacking disablement flag is reset, and the operation is completed (step 1109). In this manner, the upper limit of the stackable number is changed depending on the stapling mode or non-stapling mode selected. Therefore, the accommodation operation is possible to the possible limits.

The number of sheets stacked on the stacker is counted by counting the number of sheets in each of the sets, and totaling them. Therefore, when the stapled sheet sets are stacked, the number of sheets accommodatable on the stacker is smaller by the bulkiness added by the staples.

In the example of FIG. 33, the accommodatable number is switched depending on whether the stapling mode is selected or not. It is also possible that the control for the accommodating method in the sheet set accommodating device. By the switching, the accommodated state can be changed as desired. The description will be made in detail in this respect. Referring to FIG. 35, the description will be made as to the stacking operation. As contrasted to the stacking operation in FIG. 34, the discrimination is made as to whether or not the accommodated sheet set is the one stapled or not at step 2114. If not yet stapled, the operation proceeds to step 2115, and the sheet stacking tray is offset to provide discrimination from the subsequent sheet set (step 2115). If it is the one stapled (step 2114), the operation proceeds to step 2117.

A fourth example will be described. In addition to the structure of FIGS. 34 and 35 embodiment, it is possible to switch the control method in the sheet set accommodating device depending on whether the stapling mode is selected or not. More particularly, a jam timer for the transfer of the sheet set from the sheet post-processing apparatus to the sheet accommodating apparatus, can be switched. In the case of the non-stapled sheet set, the alignment of the sheets is incomplete as compared with the stapled sheet, and therefore, the time required for the transfer is longer than the stapled sheet. Therefore, when the same jam timer period is selected, the jam detection will be delayed, or the jam detection may become erroneous. In view of this, the jam timer for the detection of the jam during the transfer from the sheet post-processing apparatus to the sheet accommodating apparatus, is switched, by which the above inconvenience can be avoided, thus accomplishing proper sheet set processing.

Figure 36:
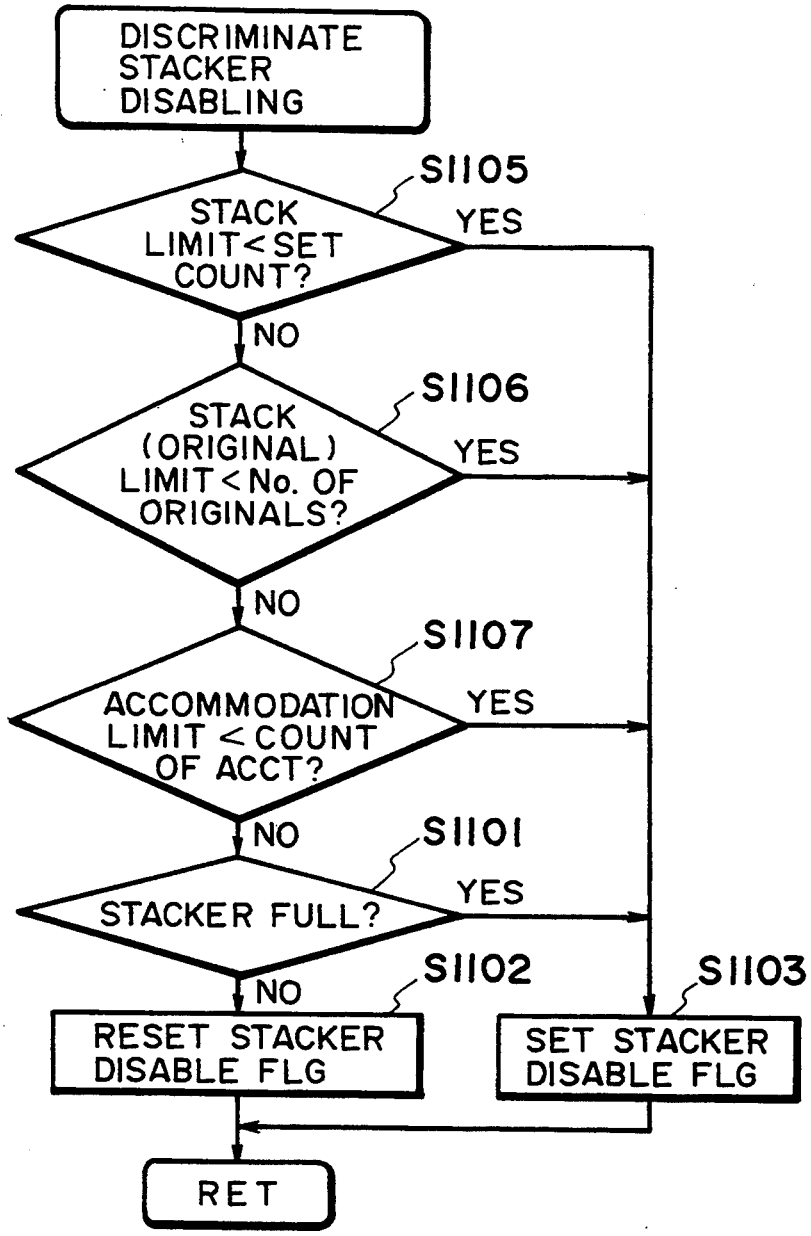
FIG. 36 is a flow chart of stapling operations according to a first example of another control system.
Figure 37:
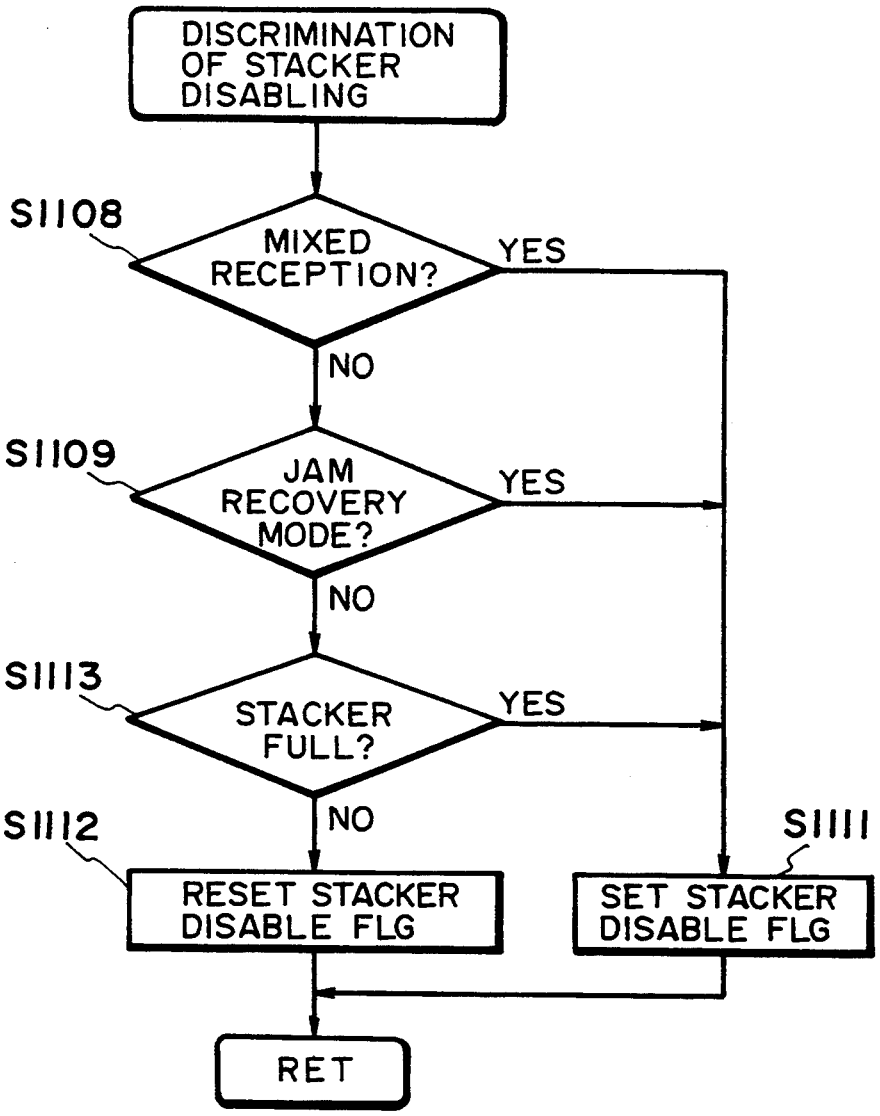
FIG. 37 is a flow chart of one position stapling operations according to a second example.
Figure 38:
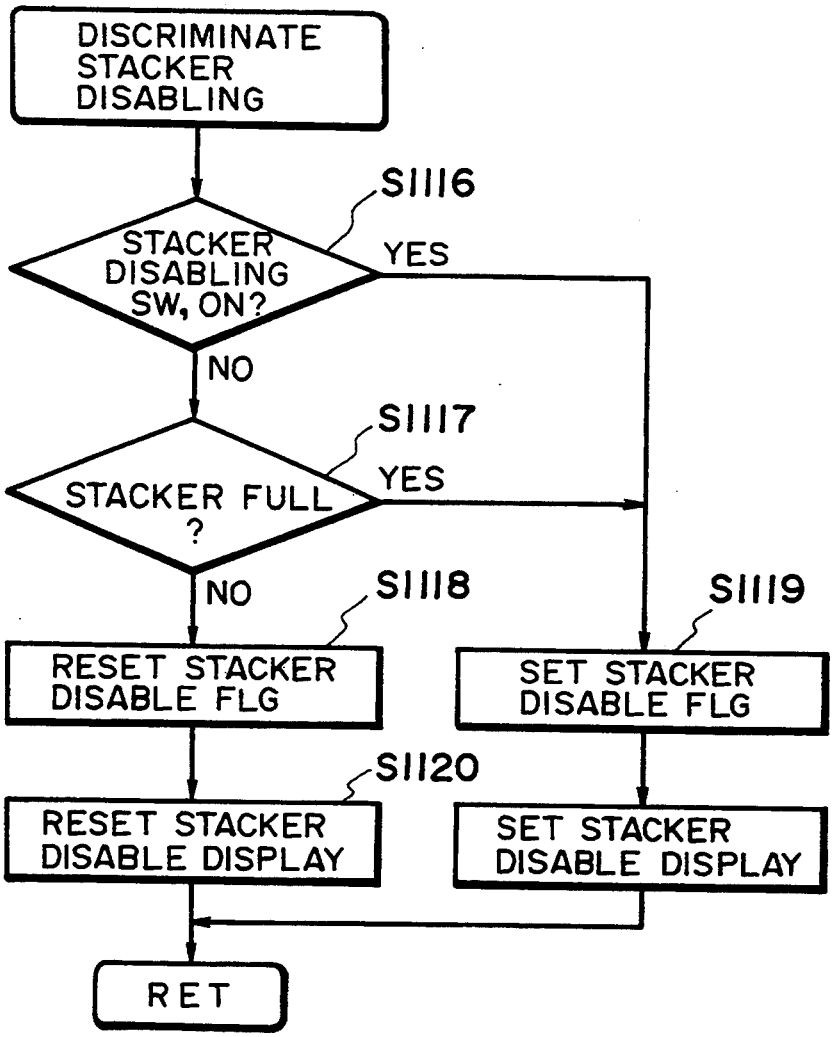
FIG. 38 is a flow chart of stacking operations.

Referring to FIGS. 36, 37 and 38, first and second examples of the other control systems for the sheet post-processing apparatus, according to the present invention.

Referring to FIG. 36, the flow chart of the stacker disablement discrimination will be described. First, at step 1105, the comparison is made between a stackable limit and a stacked number. If the stacked number is larger than the limit, the stacker disablement is detected, and the operation proceeds to step 1103. If not, the operation proceeds to step 1106. Then, a stack limit original number and the job original number is compared. If the number of originals is larger than the stack limit original number, the stacker disablement is discriminated, and the step 1103 is executed. If not, the operation proceeds to step 1107, where the stack limit accommodatable number and the count of the accommodated number is compared. If the count is larger than the limit, the stacker disablement is discriminated, and the operation proceeds to step 1103. If not, the discrimination is made as to whether or not the stacker is full at step 1101. If the stacker is full, any further stacking is not possible, and therefore, the operation proceeds to step 1103, and the stacker disablement flag is set. Thus, the operation is completed. If the stacker is not full as a result of the discrimination at step 1101, the sheets can be stacked further, and therefore, the stacker disablement flag is reset. The operation is then completed.

The second example will be described referring to FIG. 37 (the flow chart of stacker disablement discrimination). First, at step 1108, the discrimination is made as to whether or not the apparatus is operated in the mixture stack mode or not. In the case of the mixture stacking mode, the stacker disablement is discriminated, and the operation proceeds to step 1111. If not, the operation proceeds to step 1109, where the discrimination is made as to whether it is jam recovery mode or not. If it is the jam recovery mode, the stacker disablement is discriminated, and the operation proceeds to step 1111. If it is not the jam recovery mode, the operation proceeds to step 113 where the discrimination is made whether the stacker is full or not. If it is full, a further stacking is not possible, and therefore, the operation proceeds to step 1111, where the stacker prohibition flag is set, and the operation is completed. If the stacker is not full as a result of the discrimination at step 1113, the subsequent stacking is possible, and therefore, the stacker disablement flag is reset. Then, the operation is completed.

Referring to FIG. 38 which is a flow chart of the stacker disablement discrimination, another example will be described. At step 1116, when the stacker disablement is set by a stacker disablement switch which can be manually operable to set use or non-use of the stacker, the stacker disablement is discriminated, and the operation proceeds to step 1119. If the stacker disablement is not set, a step 1117 is executed, where the discrimination is made as to whether or not the stacker is full or not. If it is full, a further stacking is not possible, and therefore, the operation proceeds to step 1119, where the stacker disablement flag is set. Then, the stacker disablement is displayed, and the operation is completed. If the stacker is not full as a result of the discrimination of step 1118, the subsequent stacking is possible, and therefore, the stacker disablement flag is reset, and the stacker disablement display is cleared. Then, the operation is completed.

Figure 39:
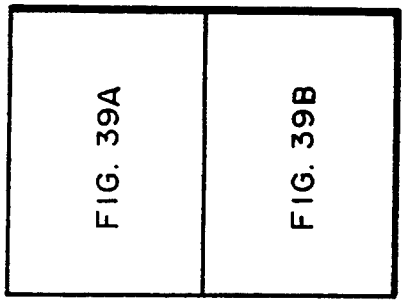
FIG. 39 is a flow chart of disabling operations according to a third example.
Figure 39A:
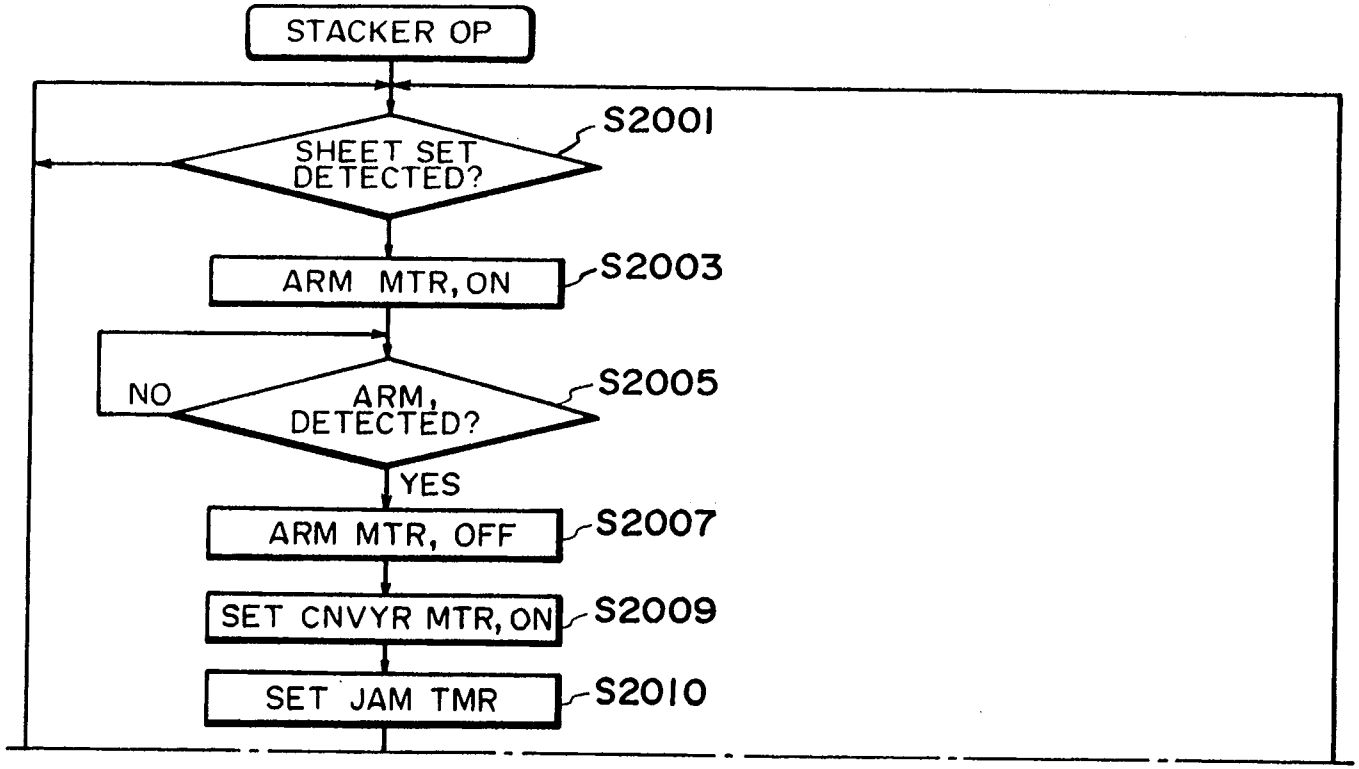
Figure 39B:
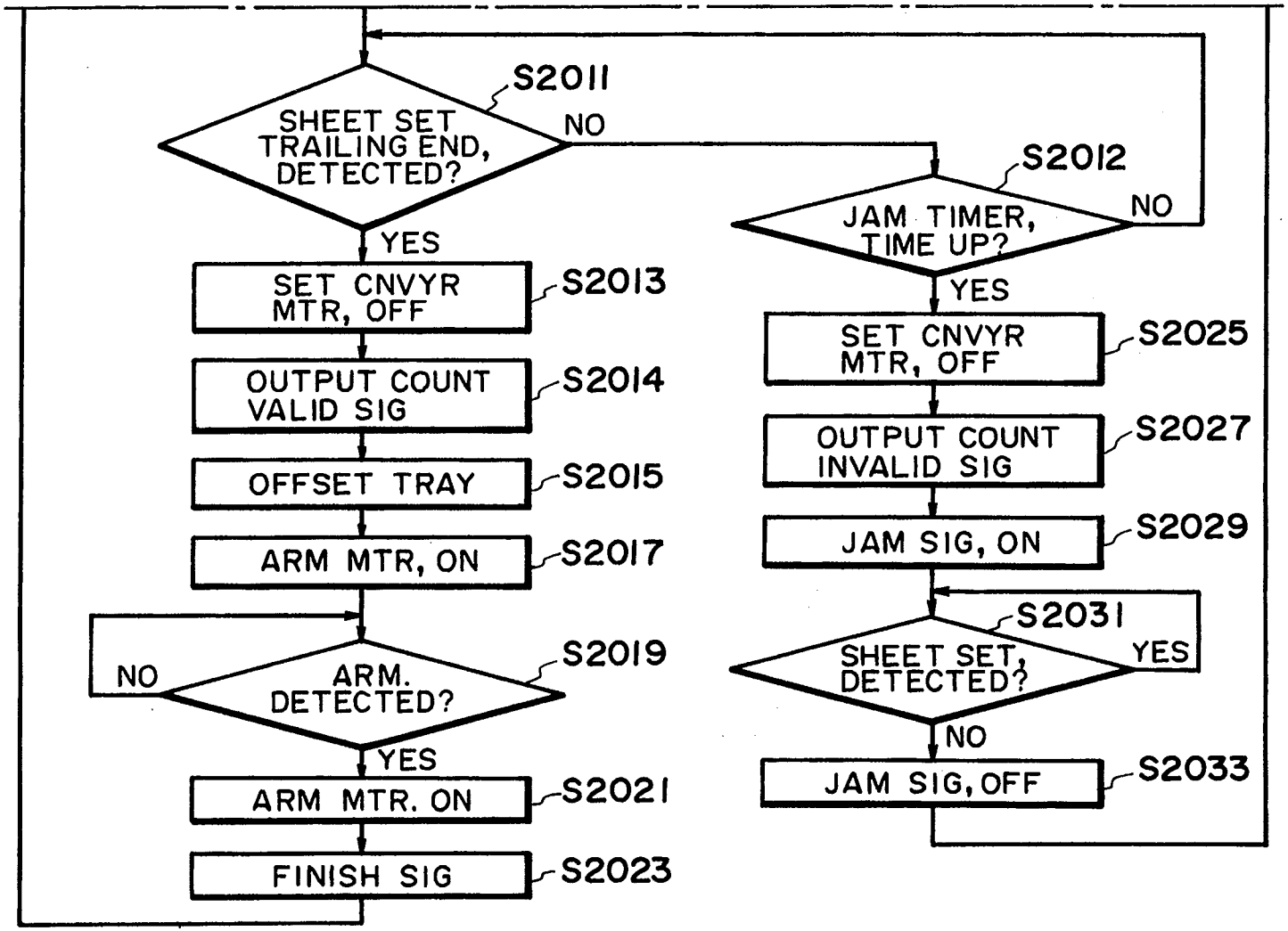

A third example of another control will be described. Referring to FIG. 39, the stacking operation will be described. When the sheet set detecting sensor detects the sheet set at step 2001, the operation proceeds to step 2003, where the arm swinging motor is actuated. When the sheet set conveying sensor detects the arm, the arm swinging motor is stopped (steps 2005 and 2007). Subsequently, the sheet set conveying motor is actuated at step S2009, and the jam detecting timer for detecting the jam is set at step S2010, so that the sheet set is conveyed. The sheet set detecting sensor waits for the trailing edge of the sheet set (step S2011). Before the trailing end of the sheet set is detected, the discrimination is made as to whether or not the jam timer is counted up (S2012). If the trailing edge of the sheet set is detected before the timer counts up, the sheet set conveying motor is stopped at step S2013. Since the sheet set is stacked in good order on the stacker, the count valid signal is produced at step S2014. In order to provide discrimination from the subsequent sheet set, the sheet set stacking tray is offset at step S2015. An arm swinging motor is actuated to permit the subsequent sheet set accommodation. When the sheet set receiving position sensor detects the arm, the arm swinging motor is energized (steps S2017, S2019 and S2021). Here, a stacker accommodation completion signal indicative of the completion of the accommodation of the sheet set, is produced to the sorter at step S2023, and the operation returns to step 2001. If at step 2012, the timer counts up before the trailing end of the sheet set is detected, the occurrence of the jam is discriminated, and the operation proceeds to step 2025, where the sheet set conveying motor is deactuated. At step 2027, a count invalidating signal is produced, and subsequently, the jam signal is produced to the sorter at step 2029 to wait for the jam clearance at step 2031.

When the jam is cleared, the jam signal produced to the sorter is invalidated at step 2033. Thereafter, the operation returns to step 2001.

The image forming apparatus counts the number of discharged sheets. The addition to the total counter is controlled depending on the count valid signal or the count invalidating signal. By doing so, the counting as the entirety of the image forming system becomes possible.

Figure 40:
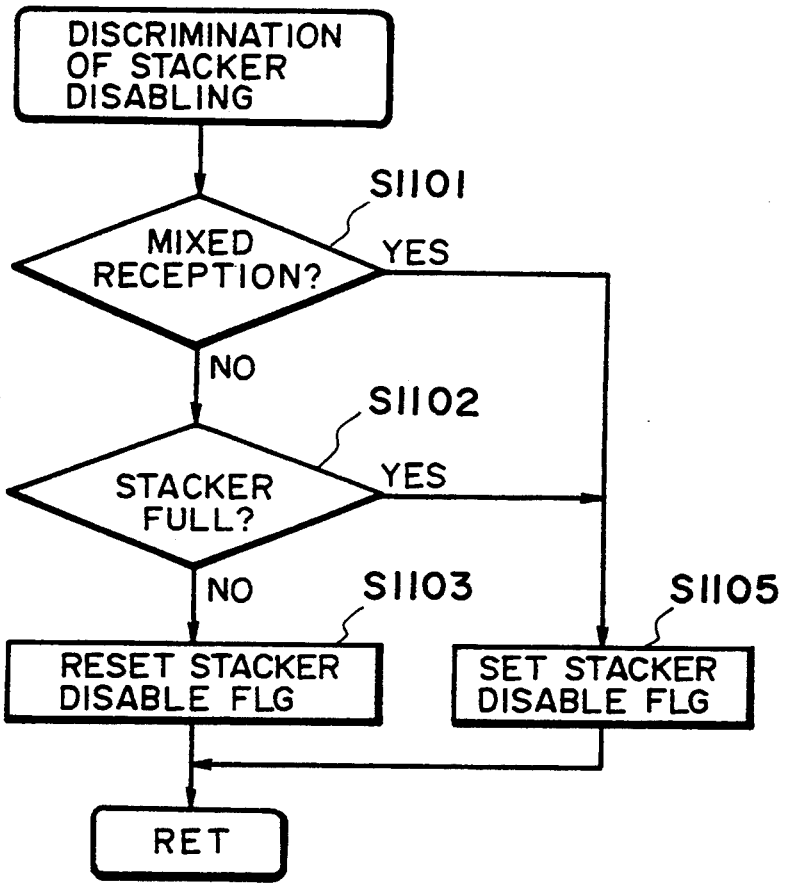
FIG. 40 is a flow chart of disabling operations according to a fourth example.
Figure 41:
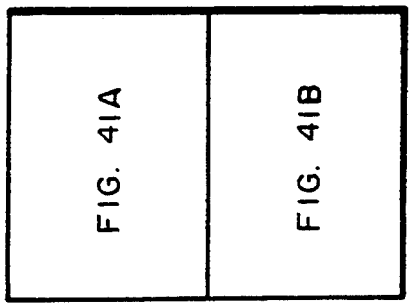
FIG. 41 is a flow chart of stacking operations.
Figure 41A:
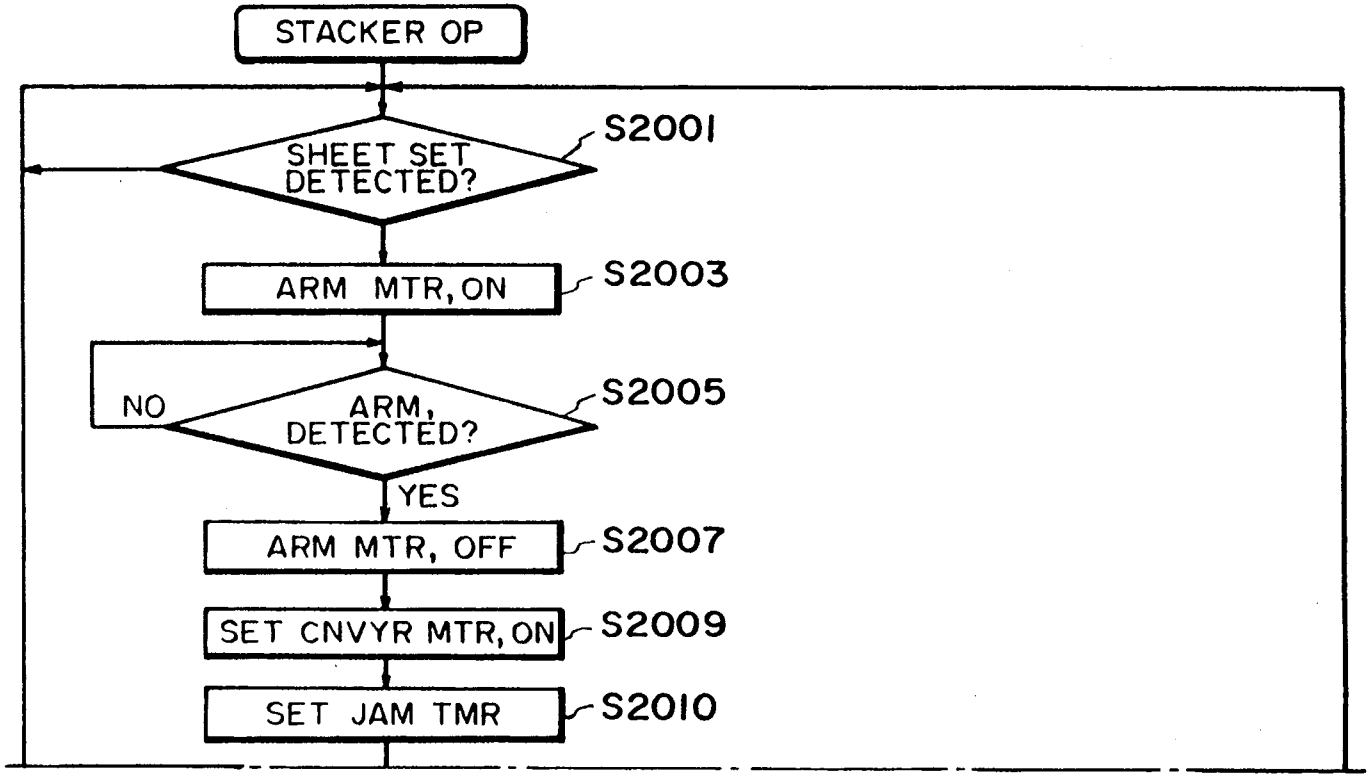
Figure 41B:
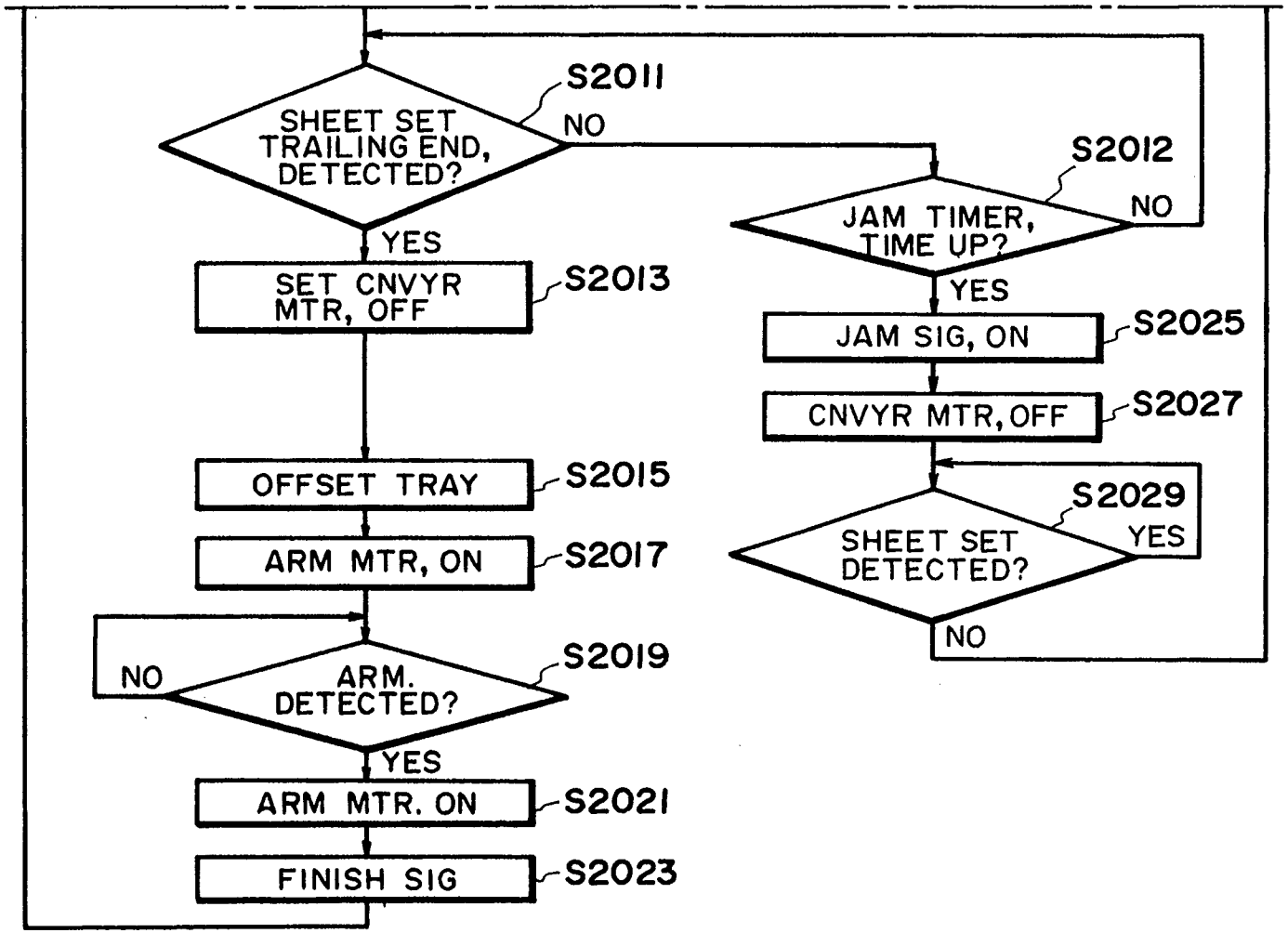

Referring to FIGS. 40–41, the description will be made as to fourth example of another control.

FIG. 40 is a flow chart of the stacker disablement discrimination. First, at step 1101, the discrimination is made as to whether or not the stacker is full. If it is full, a further stacking is not possible, and the operation proceeds to step 1105, where the stacker disablement flag is set, and the operation is completed. If the result of discrimination at step 1101 indicates the non-full state of the stacker, the operation proceeds to step 1102, where the discrimination is made as to whether or not a jam signal is produced. If so, the subsequent stacking operation is disabled by step 1105, where the stacker disablement flag is set. Only if no jam signal is discriminated at step 1102, the stack disablement (prohibition) flag is reset, to permit operation. Then, the stacker disablement discrimination process is completed.

Referring to FIG. 41, the stacking operation will be described. First, at step 2001, when the sheet set detecting sensor detects the sheet set, the operation proceeds to step 2003, where the arm swinging motor is energized, and when the sheet set conveying sensor detects the arm, the arm swinging motor is stopped (step S2005 and step S2007). Subsequently, the sheet set conveying motor is actuated at step S2009, and the jam detecting timer for detecting jam is set at step S2010. Thus, the sheet set is conveyed. Then, the sheet set detecting sensor waits the trailing end of the sheet set at step S2011. The discrimination is made at step S2012 whether the jam detection timer counts up before the detection of the trailing edge of the sheet set. If the trailing edge of the sheet set is detected before the timer counts up, the sheet conveying motor is stopped at step S2013. The stacking operation of the sheet set onto the stacking tray is terminated, and the sheet set stacking tray is offset to provide a discrimination to the following sheet set at step S2015. To permit the accommodating operation for the next sheet, the arm swinging motor is actuated. When the sheet set receiving position sensor detects the arm, the arm swinging motor is deactuated (steps S2017, S2019 and S2021). Here, stacker accommodation completion signal indicative of the completion of the accommodating operation for the sheet set is produced to the sorter at step S2023, and the operation returns to step 2001. If the timer counts up before the detection of the trailing edge of the sheet set at step 2012, the jam occurrence is discriminated, and the operation proceeds to step 2025, where the sheet set conveying motor is deactuated at step S2027, and the jam clearance operation is waited for at step 2029. If the jam is cleared, the operation returns to step 2001.

In the foregoing, the stacker disabling means has been described. However, the image formation system is difficult to handle unless the stacker disablement state is known to the operator. Therefore, by the provision of the disablement state display means, the apparatus becomes easy to handle. For example, in the foregoing example, when the use of the stacker is selected, the stacker disablement state can be displayed on the message display.

Figure 42:
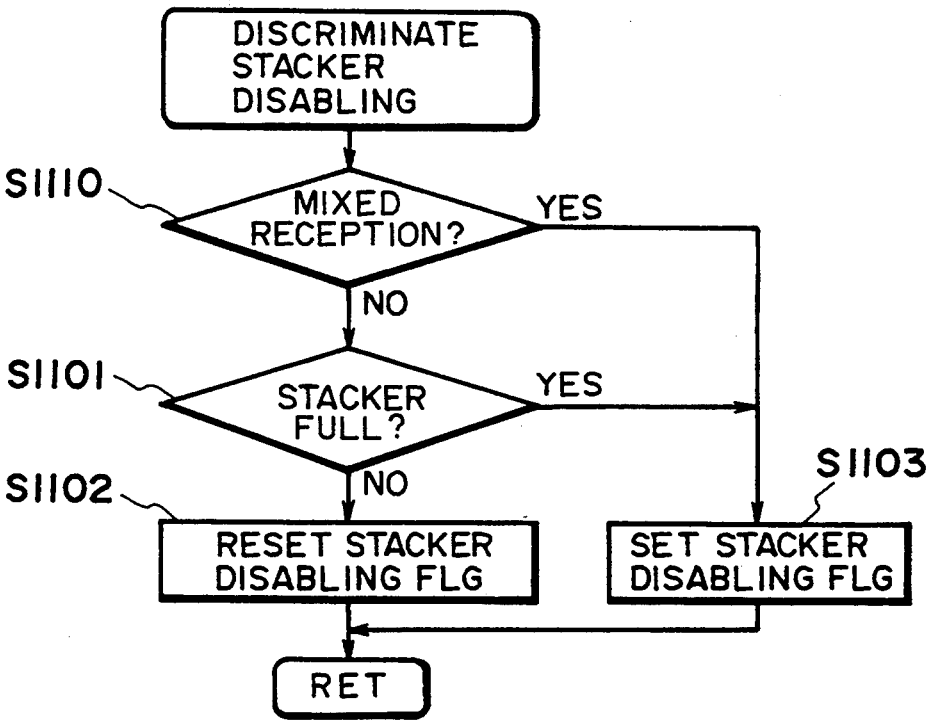
FIG. 42 is a flow chart of stacker disabling operations according to a fifth example.

Referring to FIG. 42, a fifth example of another control will be described. FIG. 42 is a flow chart of stacker disablement discrimination. First, at step 1110, the discrimination is made as to whether or not the sheet stacking on the tray of the sheet post-processing apparatus is the mixed stacking or not. If it is mixed stacking, the operation proceeds to step 1103. If not, the operation proceeds to step 1101 where the discrimination is made as to whether or not the stacker is full. If so a further stacking is not possible, and the operation proceeds to step 1103, and the stacker disablement flag is set, and the operation is completed. If the result of discrimination at step 1101 indicates non-full of the stacker, a further stacking is possible, and therefore, the stacker disablement flag is reset.

Referring to FIGS. 43–47, a sixth example of another control will be described.

Figure 43:
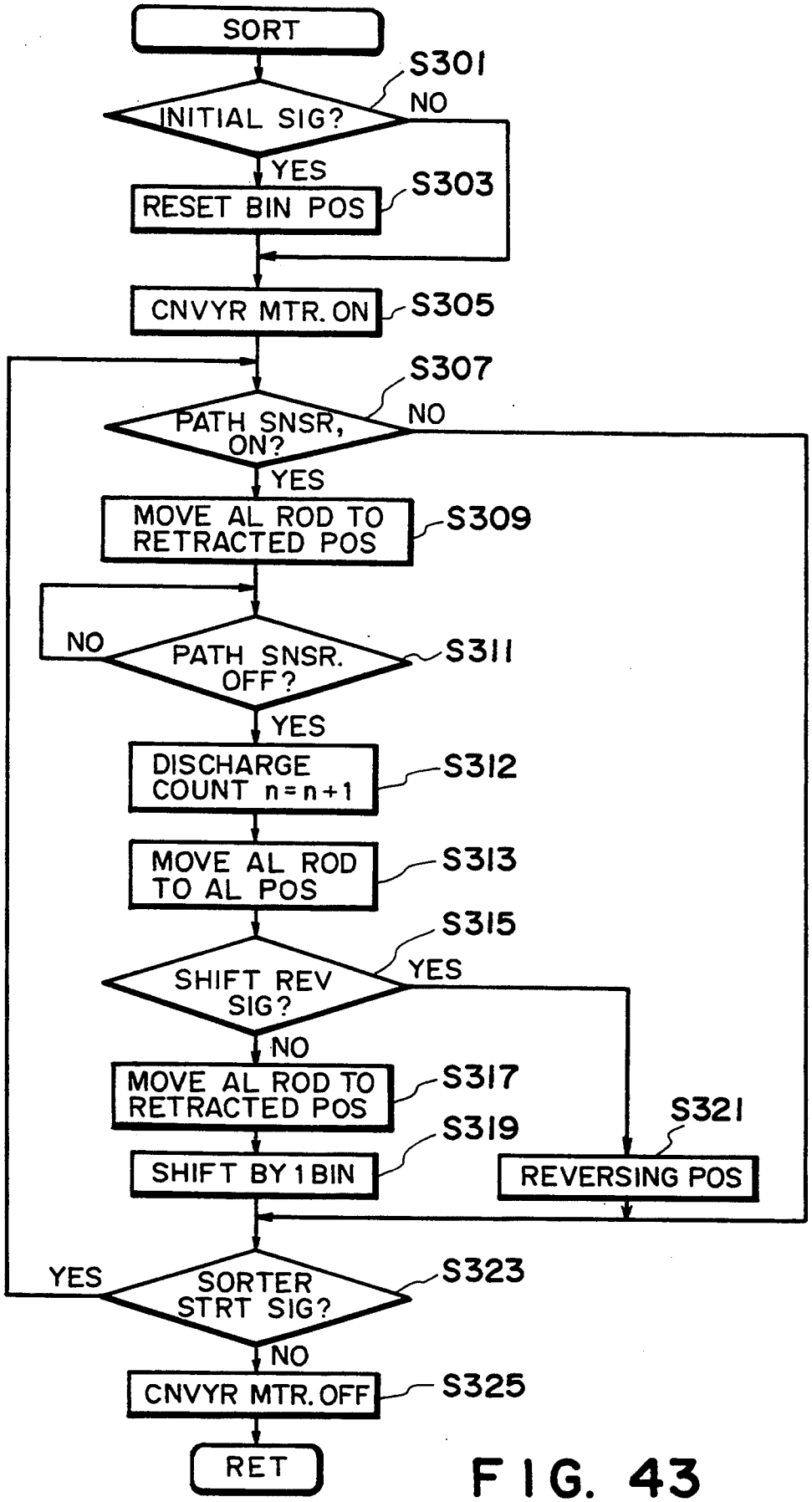
FIG. 43 is a flow chart of sorting operations according to a sixth example.

Referring to FIG. 43, the operation in the sorting mode will be described. Unlike the sorting mode operation in FIG. 17, the sheet discharging counter is incremented by 1 at step S312 when the deactuation of the path sensor is detected at step S311 after retraction of the aligning means. Then, the sheet aligning operation is carried out at step S313.

Figure 44:
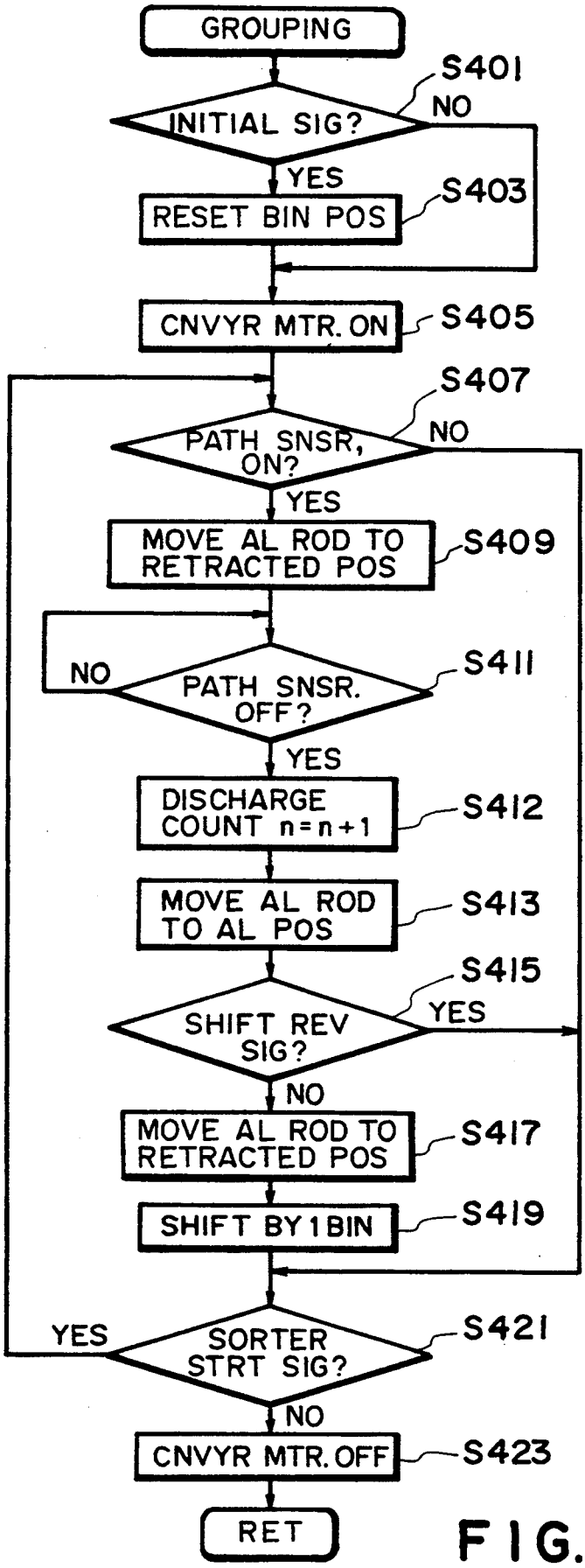
FIG. 44 is a flow chart of grouping operations.

Referring to FIG. 44, the operation in the grouping mode will be described. Unlike the operation of the grouping mode in FIG. 18, the sheet discharging counter is incremented by 1 at step S412 when the deactuation of the path sensor is detected at step S411 after retraction of the aligning means. Then, the sheet aligning operation is carried out at step S413.

Figure 45:
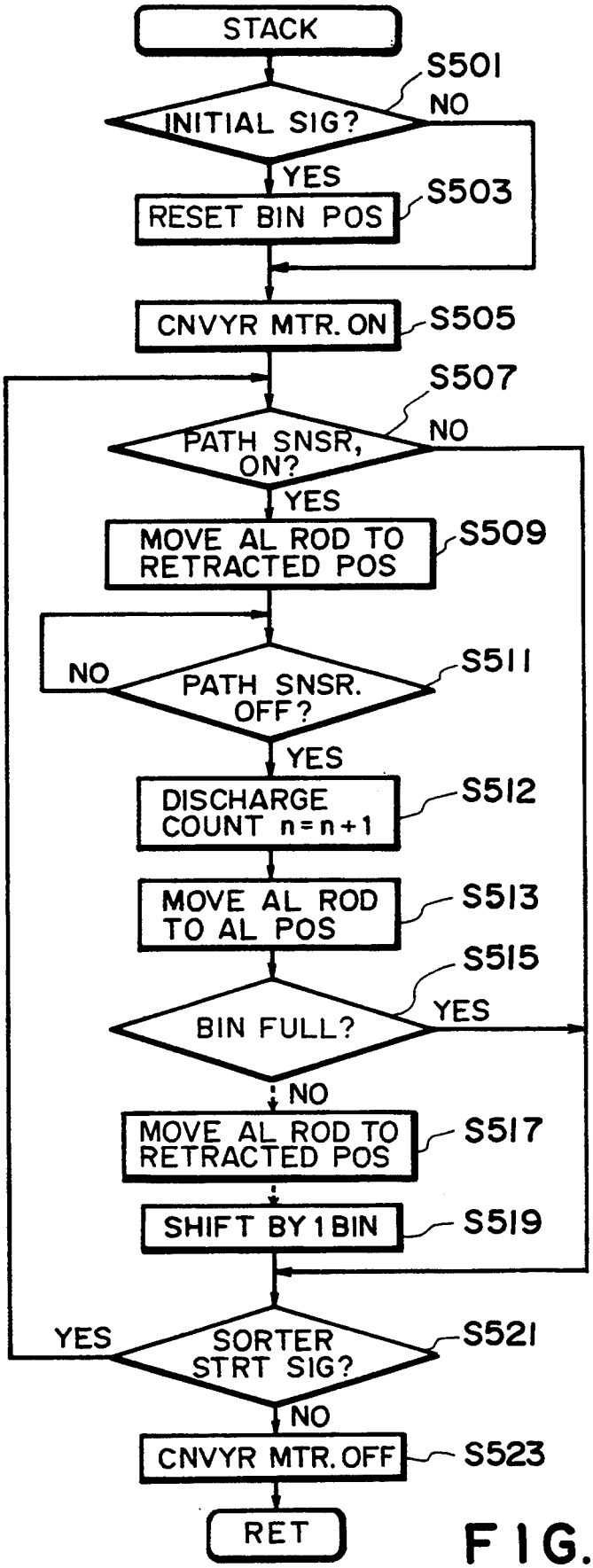
FIG. 45 is a flow chart of stacking operations.

Referring to FIG. 45, the operation in the stacking mode will be described. Unlike the stacking mode operation in FIG. 19, the sheet discharging counter is incremented by 1 at step S512 when the deactuation of the path sensor is detected after retraction of the aligning part. Then, the sheet aligning operation is carried out at step 513.

Figure 46:
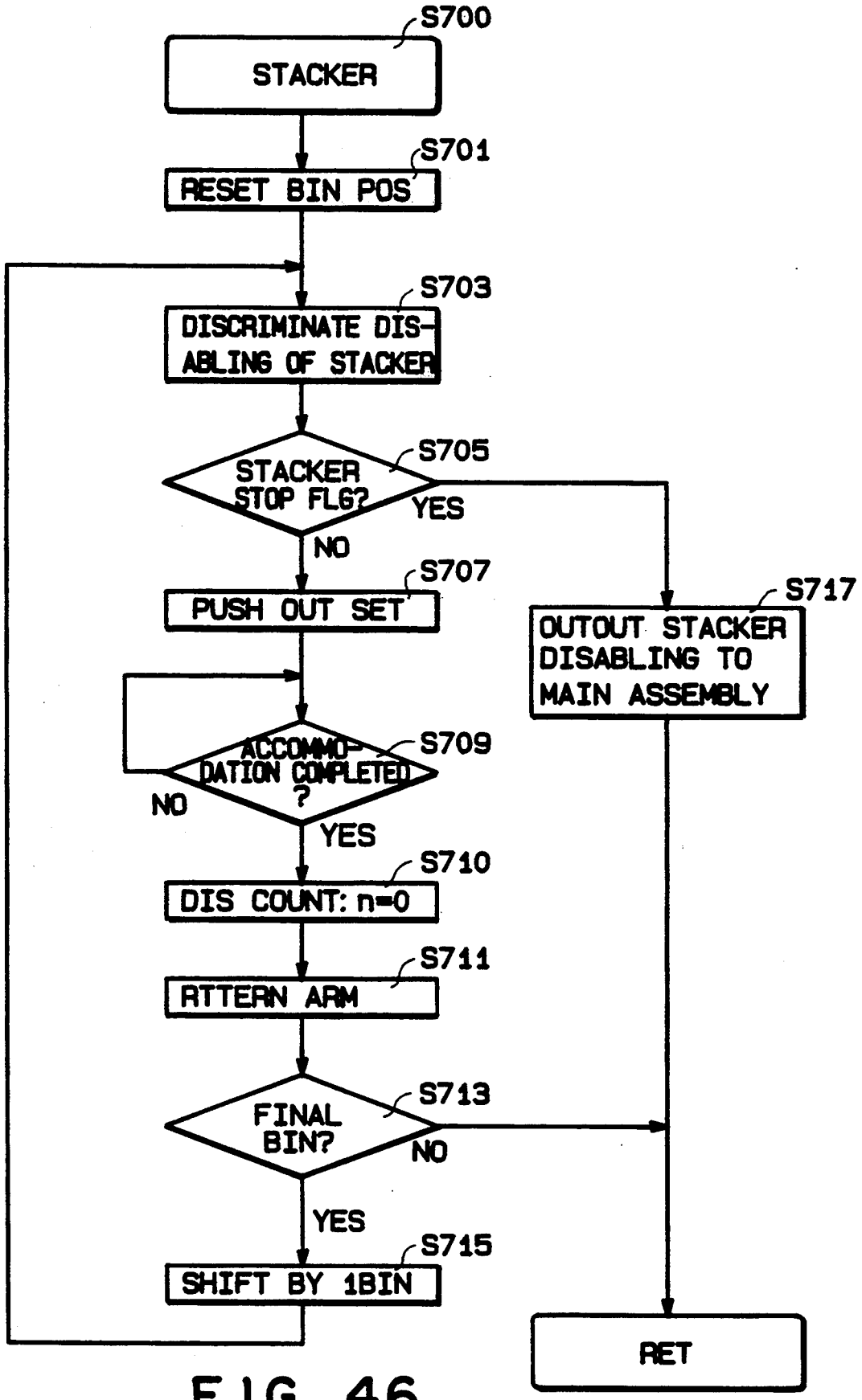
FIG. 46 is a flow chart of stacking operations.

Referring to FIG. 46, the flow chart of the stacking operation will be described. Unlike the stacking operation in FIG. 23, the sorter waits for the stacker accommodation completion signal at step S709. If the stacking operation is completed, the sheet discharging counter is cleared at step S710 (n=0), and the arm 405*b* for pushing the sheet set is returned at step S711.

Figure 47:
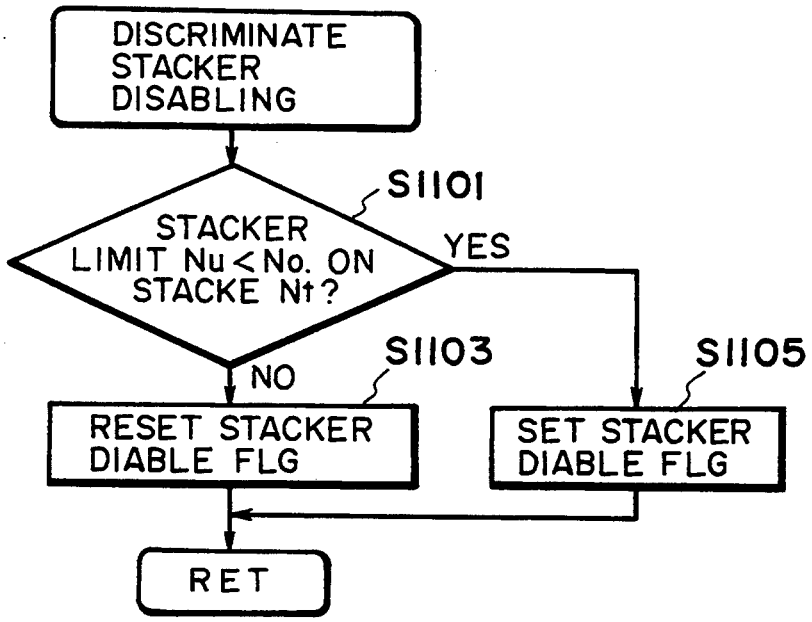
FIG. 47 is a flow chart of stacker disabling operations.

FIG. 47 is a flow chart of stacker disablement discrimination. First, the discrimination is made at step 1101 whether the stacker is full or not. More particularly, the comparison is made between the stacked sheet number (Nt) and the upper limit of the stackable number (Nu). If the comparison indicates that the stack is full, a further stacking is not possible, and therefore, the operation proceeds to step 1103, where the stacker disablement flag is set, and the operation is completed. If the comparison at step 1101 indicates the non-full of the stacker, a further stacking is possible, and therefore, the stacker disablement flag is reset, and the operation is completed.

Figure 48:
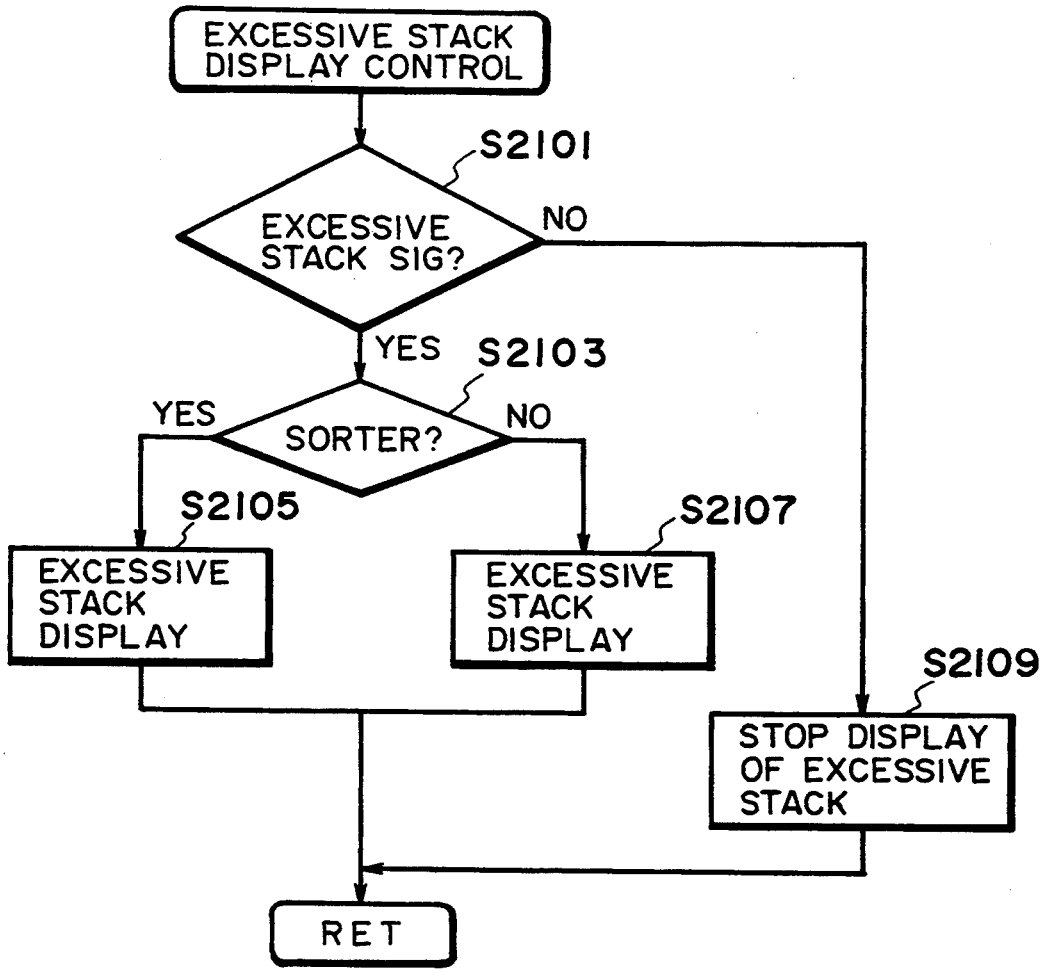
FIG. 48 is a flow chart of excessive stacking display control according to a seventh example.
Figure 49:
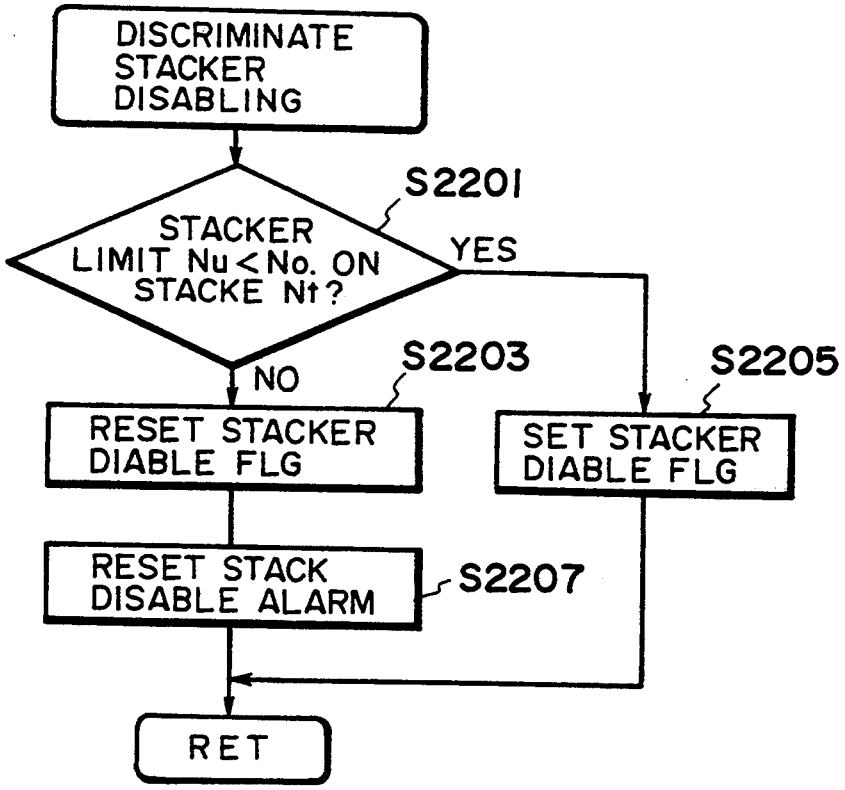
FIG. 49 is a flow chart of stacker disabling operations.

Referring to FIGS. 48 and 49, a seventh example of another control will be described. In the foregoing sixth example, the system is stopped when the overstacking is detected. However, it is not known whether the overstacking occurs in the sheet post-processing apparatus or in the sheet set accommodating apparatus. In consideration of such a situation, there is provided a display for displaying where the overstacking occurs.

Referring to FIG. 48 flow chart, the discrimination is made first as to whether or not the overstacking signal is produced at step 2101. If not, each of the overstacking displays is reset at step 2109. If so, the step 2103 is executed in which the discrimination is made as to whether the overstacking signal comes from the sorter or not. If so, the occurrence of the overstacking of the sorter is displayed at step S2105. If not, the overstacking occurs in the sheet set accommodating apparatus (stacker), and therefore, the occurrence of the overstacking in the stacker is displayed at step S2107.

By effecting the similar discrimination, it can be made clear where the overstacking occurs by the provision of the corresponding displays even if a plurality of sheet set accommodating apparatuses are used or even if a plurality of sheet post-processing apparatuses are used.

In the foregoing sixth example, the system is stopped when the overstacking is detected. It is possible to permit the continued operation of the image formation after the overstacking state is cleared.

FIG. 49 is a flow chart of the stacker disablement discrimination 2. At step 2201, the discrimination is made as to whether or not the stacker is full. More particularly, the comparison is made between the stacked number Nt and the stacking limit Nu. If the results of comparison indicates the stack-full, a further stacking is not possible, and therefore, the operation proceeds to step 2203, where the stacker disablement flag is set. Then, the operation is completed. If the non-full is indicated by the result of the comparison at step 2201, a further stacking is possible, and therefore, the stacker disablement flag is reset at step 2205. Further, the stacker disablement alarm to the main assembly is cleared at step 2207. Then, the operation is completed. Here, by clearing the alarm to the main assembly, the main assembly can continue the operation, and therefore, the unnecessary reduction of the successive image formation rate can be avoided.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus, comprising:

tray means for accommodating discharged sheets;

binding means for binding the sheets discharged to said tray means;

stacking means, juxtaposed with said tray means, for accommodating a set of sheets on said tray means; and control means for discriminating whether binding mode or non-binding mode is selected, wherein said control means permits only the bound set of sheets to be transferred from said tray means to said stacking means for changing stacking way of the set of sheets on said.

2. An apparatus according to claim 1, wherein said control means includes offset means for offsetting bound sheet set from non-bound sheet set.

3. A sheet post-processing apparatus, comprising:

tray means for accomodating discharged sheets;

binding means for binding the sheets discharged to said tray means;

stacking means, juxtaposed with said tray means, for accommodating a set of sheets on said tray means; and control means for discriminating whether binding mode or non-binding mode is selected, wherein said control means includes stack-full detecting means in which stackable limit number is smaller for a binding mode than for the non-binding mode.

4. A Sheet post-processing apparatus, comprising:

tray means for accommodating discharged sheets;

binding means for binding the sheets discharged to said tray means;

stacking means, juxtaposed with said tray means, for accommodating a set of sheets on said tray means; and control means for discriminating whether binding mode or non-binding mode is selected, wherein said control means includes jam detecting means having a jam timer having a timer period which is longer for a non-binding mode than for a binding mode.

* * * * *

UNITED STATES PATENT AND TRADEMARK OFFICE

CERTIFICATE OF CORRECTION

PATENT NO. : 5,447,297 Page 1 of 5

DATED : September 5, 1995

INVENTOR(S) : MITSUSHIGE MURATA, et al.

It is certified that error appears in the above-indentified patent and that said Letters Patent is hereby corrected as shown below:

IN THE DRAWINGS

Sheet 15 of 52

Fig. 15

"STAPCLNG" should read --STAPLING--.

Sheet 20 of 52

Fig. 19

"INITIAC" should read --INITIAL--.

Sheet 21 of 52

Fig. 20

"STAPCE" should read --STAPLE--.

Sheet 25 of 52

Fig. 25

"STAPCING" should read --STAPLING--.

Sheet 27 of 52

Fig. 27

"STPC" should read --STPL--; and "STAPCE" should read --STAPLE--.

UNITED STATES PATENT AND TRADEMARK OFFICE

CERTIFICATE OF CORRECTION

PATENT NO. : 5,447,297 Page 2 of 5

DATED : September 5, 1995

INVENTOR(S) : MITSUSHIGE MURATA, et al.

It is certified that error appears in the above-indentified patent and that said Letters Patent is hereby corrected as shown below:

IN THE DRAWINGS (continued)

Sheet 28 of 52

Fig. 28

"STPC" should read --STPL--.

Sheet 30 of 52

Fig. 29B

"RTTERN" should read --RETURN--.

Sheet 32 of 52

Fig. 30B

"RTTERN" should read --RETURN--.

Sheet 34 of 52

Fig. 32

"STACKE" should read --STACKER--.

Sheet 36 of 52

Fig. 34

"STACKE" should read --STACKER--.

UNITED STATES PATENT AND TRADEMARK OFFICE

CERTIFICATE OF CORRECTION

PATENT NO. : 5,447,297 Page 3 of 5

DATED : September 5, 1995

INVENTOR(S) : MITSUSHIGE MURATA, et al.

It is certified that error appears in the above-indentified patent and that said Letters Patent is hereby corrected as shown below:

IN THE DRAWINGS (continued)

Sheet 37 of 52

Fig. 35

"STACKE" should read --STACKER--.

Sheet 51 of 52

Fig. 47

"STACKE" should read --STACKED--; and "DIABLE" (both occurrences) should read --DISABLE--.

Sheet 52 of 52

Fig. 49

"STACKE" should read --STACKED--; and "DIABLE" (both occurrences) should read --DISABLE--.

COLUMN 1

Line 44, "effective" should read --effectively--.

COLUMN 3

Line 20, "Feeder); and" should read --Feeder).--.
Line 21 should be deleted.

COLUMN 4

Line 55, "a" should be deleted.

UNITED STATES PATENT AND TRADEMARK OFFICE

CERTIFICATE OF CORRECTION

PATENT NO. : 5,447,297 Page 4 of 5

DATED : September 5, 1995

INVENTOR(S) : MITSUSHIGE MURATA, et al.

It is certified that error appears in the above-indentified patent and that said Letters Patent is hereby corrected as shown below:

COLUMN 5

Line 10, "is" should read --are--.
Line 27, "are two" should be deleted.
Line 32, "depressed" should read --is depressed--.
Line 45, "a" should be deleted.

COLUMN 6

Line 57, "a" should read --an--.

COLUMN 7

Line 29, "turned" should read --turned on.--.

COLUMN 8

Line 65, "an" should read --a--.

COLUMN 9

Line 68, "ate" should read --at--.

COLUMN 10

Line 44, "The" should read --If the--.
Line 59, "the" should read --and the--.

COLUMN 11

Line 12, "step 05" should read --step 605--.
Line 16, "to" should read --to whether--.

UNITED STATES PATENT AND TRADEMARK OFFICE

CERTIFICATE OF CORRECTION

PATENT NO. : 5,447,297 Page 5 of 5

DATED : September 5, 1995

INVENTOR(S) : MITSUSHIGE MURATA, et al.

It is certified that error appears in the above-indentified patent and that said Letters Patent is hereby corrected as shown below:

COLUMN 13

Line 20, "27," should read --28,--.
Line 48, "As" should read --At--.
Line 53, "executed)." should read --executed.--.

COLUMN 14

Line 8, "stack" should read --set--.

COLUMN 20

Line 31, "means for changing stacking way of the" should read --means.--.
Line 32 should be deleted.
Line 35, "bound" should read --a bound--; and "non-bound" should read --a non-bound--.
Line 37, "accomodating" should read --accommodating--.
Line 48, "Sheet" should read --sheet--.

Signed and Sealed this

Fourteenth Day of May, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,447,297
DATED : September 5, 1995
INVENTOR(S) : Mitsushige Murata et al.

It is certified that error appears in the above-identified patent and that said Letters Patent is hereby corrected as shown below:

Title page,
Item [73], change "Canon Kabushiki Kaisha, Tokyo, Japan" to
-- Canon Kabushiki Kaisha, Tokyo, Japan and Canon Aptex Kabushiki Kaisha, Ibaraki-ken, Japan --.

Signed and Sealed this

Twenty-ninth Day of July, 2003

JAMES E. ROGAN
*Director of the United States Patent and Trademark Office*